US011432985B2

(12) United States Patent
Benda et al.

(10) Patent No.: US 11,432,985 B2
(45) Date of Patent: Sep. 6, 2022

(54) REHABILITATION DEVICE PROVIDING LOCOMOTION TRAINING AND METHOD OF USE

(71) Applicant: Healing Innovations, Inc., Nashville, TN (US)

(72) Inventors: Scott Douglas Benda, Hendersonville, TN (US); Luke Scott Benda, Nashville, TN (US); Braden Joseph Davidson, Nashville, TN (US); Evan Andrew Reese, Nashville, TN (US); Christopher Zaro, Arlington Heights, IL (US)

(73) Assignee: Healing Innovations, Inc., Nashville, TN (US)

( * ) Notice: Subject to any disclaimer, the term of this patent is extended or adjusted under 35 U.S.C. 154(b) by 0 days.

(21) Appl. No.: 16/902,836

(22) Filed: Jun. 16, 2020

(65) Prior Publication Data

US 2020/0360219 A1 Nov. 19, 2020

Related U.S. Application Data

(63) Continuation of application No. 16/565,131, filed on Sep. 9, 2019, now Pat. No. 10,736,808.
(Continued)

(51) Int. Cl.
*A61H 1/02* (2006.01)
*A63B 22/00* (2006.01)
(Continued)

(52) U.S. Cl.
CPC ..... *A61H 1/0262* (2013.01); *A63B 21/0058* (2013.01); *A63B 21/00181* (2013.01);
(Continued)

(58) Field of Classification Search
CPC .... A61H 2201/1652; A61H 2201/1664; A61H 2201/1676; A61H 2201/50;
(Continued)

(56) References Cited

U.S. PATENT DOCUMENTS 5,209,223 A * 5/1993 McGorry ..... A63B 21/00178 482/100
5,403,251 A * 4/1995 Belsito ..... G16H 20/30 482/4
(Continued)

OTHER PUBLICATIONS

International Search Report and Written Opinion dated Nov. 12, 2019 for International Patent Application No. PCT/US2019/050239.

*Primary Examiner* — Tu A Vo
*Assistant Examiner* — Alexander Morales
(74) *Attorney, Agent, or Firm* — Morris, Manning & Martin, LLP; Daniel E. Sineway, Esq.

(57) ABSTRACT

In various embodiments, provided herein are systems, methods, processes, and devices for providing locomotive rehabilitation to a subject via one or more gait motions that substantially accurately mimic motions performed in healthy, natural gait cycles. The system may mimic natural gait motions via footplates and handles, and one or more linkage systems. In particular embodiments, the system may further include a motor unit and/or clutch for providing controlled forces assisting or resisting motions of a linkage system. Further, the system may include a tower for operating in a standing or seated position. In at least one embodiment, the system includes a body weight support system that provides offloading forces to a subject.

13 Claims, 22 Drawing Sheets

Related U.S. Application Data

(60) Provisional application No. 62/728,762, filed on Sep. 8, 2018.

(51) Int. Cl.

| | |
|---|---|
| ***A63B 22/06*** | (2006.01) |
| ***A63B 21/005*** | (2006.01) |
| ***A63B 21/00*** | (2006.01) |
| ***A63B 21/22*** | (2006.01) |

(52) U.S. Cl.
CPC ..... *A63B 21/157* (2013.01); *A63B 21/225* (2013.01); *A63B 22/001* (2013.01); *A63B 22/0017* (2015.10); *A63B 22/0664* (2013.01); *A61H 2001/0211* (2013.01); *A61H 2201/1215* (2013.01); *A61H 2201/1269* (2013.01); *A61H 2201/50* (2013.01); *A63B 2022/0676* (2013.01); *A63B 2208/0204* (2013.01); *A63B 2208/0233* (2013.01)

(58) Field of Classification Search
CPC .... A61H 2201/5007; A61H 2201/5035; A61H 2201/5038; A61H 2201/5043; A61H 2201/5058; A61H 2201/5061; A61H 2201/5064; A61H 2203/0406; A61H 2203/0431; A61H 2205/06; A61H 2205/10; A61H 2205/12; A61H 2230/805; A63B 21/00181; A63B 21/0058; A63B 21/157; A63B 21/225; A63B 22/001; A63B 22/0017; A63B 22/0664; A63B 71/0622; A63B 2022/0676; A63B 2071/0081; A63B 2208/0204; A63B 2208/0233; A63B 2220/10; A63B 2220/51; A63B 2220/80; A63B 2220/801; A63B 2220/808; A63B 2225/09; A63B 2225/093; A63B 2225/20; A63B 2225/50
See application file for complete search history.

(56) References Cited

U.S. PATENT DOCUMENTS

| | | | | |
|---|---|---|---|---|
| 5,529,560 | A * | 6/1996 | Davies, III | A61H 1/0244 482/131 |
| 5,536,224 | A * | 7/1996 | Hsieh | A63B 22/001 482/70 |
| 5,595,555 | A * | 1/1997 | Chen | A63B 22/0056 434/255 |
| 5,735,778 | A * | 4/1998 | Piaget | A63B 21/00192 482/114 |
| 5,876,307 | A | 3/1999 | Stearns et al. | |
| 5,876,308 | A * | 3/1999 | Jarvie | A63B 21/154 482/52 |
| 5,908,373 | A | 6/1999 | Pitre | |
| 5,916,065 | A * | 6/1999 | McBride | A63B 22/0664 482/57 |
| 6,926,646 | B1 * | 8/2005 | Nguyen | A63B 22/001 428/70 |
| 6,955,632 | B2 | 10/2005 | Wang et al. | |
| 8,113,996 | B1 * | 2/2012 | Allen | A63B 22/0605 482/57 |
| 9,248,071 | B1 | 2/2016 | Benda et al. | |
| 9,295,874 | B1 | 3/2016 | Chen | |
| 9,873,014 | B1 | 1/2018 | Kuo | |
| 2002/0123412 | A1 | 9/2002 | Nguyen et al. | |
| 2004/0053748 | A1 | 3/2004 | Lo et al. | |
| 2005/0049117 | A1 | 3/2005 | Rodgers, Jr. | |
| 2005/0107224 | A1 * | 5/2005 | Akhmetov | A63B 23/03583 482/95 |
| 2006/0199702 | A1 | 9/2006 | Eschenbach | |
| 2008/0004163 | A1 * | 1/2008 | Husted | A63B 22/0056 482/57 |
| 2011/0118090 | A1 * | 5/2011 | Ellis | A63B 21/4035 482/54 |
| 2012/0042917 | A1 * | 2/2012 | Workman | A61H 3/04 135/66 |
| 2015/0246260 | A1 | 9/2015 | Giannelli et al. | |
| 2015/0250675 | A1 * | 9/2015 | Kalinowski | A61H 1/0262 482/69 |
| 2016/0213970 | A1 * | 7/2016 | Eschenbach | A63B 22/0015 |
| 2016/0263427 | A1 * | 9/2016 | Mueller | A63B 24/0087 |
| 2016/0361597 | A1 * | 12/2016 | Cole | A63F 13/245 |
| 2020/0360762 | A1 * | 11/2020 | Akhmetov | A63B 22/0664 |

* cited by examiner

REHABILITATION DEVICE PROVIDING LOCOMOTION TRAINING AND METHOD OF USE

CROSS-REFERENCE TO RELATED APPLICATIONS

This application:

is a continuation and claims the benefit of, and priority to, U.S. patent application Ser. No. 16/565,131, filed Sep. 9, 2019, entitled "REHABILITATION DEVICE PROVIDING LOCOMOTION TRAINING AND METHOD OF USE," which claims the benefit of and priority to U.S. Patent Application No. 62/728,762, filed Sep. 8, 2018, entitled "REHABILITATION DEVICE PROVIDING LOCOMOTIVE TRAINING AND METHOD OF USE"; and references U.S. Pat. No. 9,248,071, each of which are incorporated herein by reference in their entireties.

TECHNICAL FIELD

The present systems and methods relate generally to providing locomotion training for rehabilitation or other uses.

BACKGROUND

A primary objective of locomotive rehabilitation may be to restore a subject's strength and retrain the subject to walk in a natural gait cycle, under their own power. An exemplary locomotive rehabilitation subject may lack sufficient strength (e.g., in their legs, feet, core, etc.) to move their extremities through a normal gait cycle. Alternatively, or in addition, an exemplary subject may lack sufficient coordination to correctly position and direct their extremities through a gait cycle. For example, a stroke patient may experience muscle weakness and diminished coordination in their legs, and, thus, may be incapable of walking under their own power. Previous approaches to providing locomotive rehabilitation have attempted to address strength and coordination issues via multiple machines that may iteratively progress a subject through a locomotive rehabilitation program. For example, a subject may use a wheelchair and, at an initial phase of a rehabilitation program, may use locomotive rehabilitation systems and machines designed exclusively for use by wheelchair-confined subjects. Such systems and machines may operate only in a seated configuration and, thus, may be unsuitable for training a standing subject. In the same example, the subject may, at a certain phase of their program, be capable of standing and, thus, may be directed to proceed with locomotive rehabilitation via systems and machines designed only for operation by a standing subject.

In the above example, the subject required at least two systems or machines to experience locomotive rehabilitation. Because locomotive rehabilitation systems and may be costly, previous solutions that require multiple systems may be prohibitively expensive for both patients and care providers. In addition, locomotive rehabilitation systems may occupy a large space and, thus, a care provider may be unable to provide a full and necessary spectrum of rehabilitation systems, because they lack the space to house each system. Accordingly, there exists a long-felt, but unmet need for a single locomotive rehabilitation system that provides locomotive rehabilitation in both standing and seated positions.

In addition, an exemplary locomotive rehabilitation subject may lack sufficient strength to support their full weight in a standing position; however, they may have sufficient strength to support a portion of their weight in a standing position. Previous approaches to locomotive rehabilitation fail to provide apparatuses and/or mechanisms that allow a subject to receive locomotive rehabilitation in a standing position supporting a less than total portion of their weight. Accordingly, there exists a long-felt, but unmet need for a locomotive rehabilitation system that allows a subject to perform locomotive rehabilitation exercises in a standing position and while supporting only a portion of their total weight.

BRIEF SUMMARY OF THE DISCLOSURE

Briefly described, and according to one embodiment, aspects of the present disclosure generally relate to devices and methods for providing therapeutic locomotive training.

In various embodiments, provided herein are systems, methods, processes, and devices for providing locomotive rehabilitation to a subject. In one or more embodiments, the system may be operated in a standing position or a seated position, and the system may include one or more apparatuses that transition the system between a standing configuration mode and a seated configuration mode. In at least one embodiment, the system may allow a subject to transition between a standing configuration and a seated configuration (and vice versa) without requiring the patient to exit the machine. In one or more embodiments, a portion of the system that receives a subject may also be capable of rotating such that a subject may more easily position themselves onto a seating system therein.

In at least one embodiment, the system may include one or more apparatuses that allow a subject to experience locomotive rehabilitation while supporting only a portion of their own weight. In at least one embodiment, the system includes a body weight support (BWS) system that can controllably and incrementally offload a subject's weight, potentially reducing stresses and strains experienced by the subject during training, and, in some instances, providing standing locomotive training to subjects that may otherwise be incapable of performing standing exercises.

In at least one embodiment, the system may include a linkage system that allows a subject to experience locomotive rehabilitation via a mechanically facilitated and, in some instances, power-assisted gait cycle. In one or more embodiments, the linkage system may provide an artificial gait cycle that accurately performs foot, leg, and arm movements involved in a natural gait cycle. In one or more embodiments, the linkage system may include footplates that receive a subject's feet and handles that a subject may grip. In various embodiments, the linkage system may direct the footplates and handles through coordinated, simultaneous footplate and handle movements that recreate foot and arm movements demonstrated in a natural gait cycle.

In one or more embodiments, the system may include a clutch that allows the system to provide variable resistance opposing a subject's motions during locomotive rehabilitation. In at least one embodiment, the system may include a motor unit that can be controllably connected and disconnected from the clutch. For example, the clutch may be operative to controllably connect and disconnect the motor unit thereto. In one or more embodiments, the motor unit, upon activation, may generate rotational forces that provide powered assistance to a subject receiving locomotive rehabilitation. In at least one embodiment, the clutch connected to the motor unit may allow for precise control and manipulation of a magnitude of assistance provided to a subject.

In one or more embodiments, the present system may be configurable and capable of adjusting one or more system parameters and apparatuses to accommodate a variety of subject dimensions and weights. In one or more embodiments, the system may include mechanisms that increase or decrease a stride length experienced during locomotive training. In at least one embodiment, the system may include mechanisms for adjusting height of a seating system, for adjusting a distance between a subject and a linkage system, and/or for adjusting a distance between a subject and handles and/or footplates.

According to a first aspect, a gait training device including A) a handle for training arm motion; and B) a footplate for training leg motion, wherein motion of the footplate causes: 1) motion of an inner footplate link thereby causing a curved link operatively connected to the inner footplate link to rotate and engage a gear system; 2) the gear system to rotate a first connecting link, wherein: i) the first connecting link is substantially parallel with a second connecting link; ii) the first connecting link and the second connecting link are operatively connected near opposite ends of a portion of the handle link; and iii) rotation of the first connecting link causes the handle link to move in an arc, thereby causing the handle to move with the handle link in the arc, substantially mimicking hand motion of a human walking gait.

According to a second aspect, the gait training device of the first aspect or any other aspect, wherein the gait training device includes a linkage system operatively connected to the handle and the footplate for synchronizing the leg motion and the arm motion, the linkage system including: A) the first connecting link; B) the handle link; C) the curved link; D) the inner footplate link; E) the gear system; and F) a sled plate substantially perpendicular to a surface.

According to a third aspect, the gait training device of the second aspect or any other aspect, wherein: A) the curved link is operatively connected to the inner footplate link, the sled plate at a forward fixed point, and a gear system; and B) the curved link is operative for rotating about the forward fixed point.

According to a fourth aspect, the gait training device of the third aspect or any other aspect, wherein: A) the portion of the handle link is a first portion; B) the first portion of the handle link is substantially parallel to the surface; and C) the handle link includes a second portion forming an acute angle to the first portion.

According to a fifth aspect, the gait training device of the fourth aspect or any other aspect, wherein the footplate is configured to move along a base.

According to a sixth aspect, the gait training device of the fifth aspect or any other aspect, wherein the footplate: A) includes a toe end nearest the sled plate and a heel end furthest from the sled plate; and B) is configured to pivot such that the toe end and heel end raise or lower as the footplate moves along the base.

According to a seventh aspect, the gait training device of the sixth aspect or any other aspect, wherein moving the footplate a first particular distance parallel to the base causes the handle to move along the arc a second particular distance parallel to the base, wherein the second particular distance is less than the first particular distance.

According to an eighth aspect, the gait training device of the seventh aspect or any other aspect, wherein a difference between the second particular distance and the first particular distance are proportional to a difference between an average person's arm length and leg length.

According to a ninth aspect, the gait training device of the eighth aspect or any other aspect, wherein the difference between the second particular distance and the first particular distance is at least partially controlled by the gear system.

According to a tenth aspect, the gait training device of the ninth aspect or any other aspect, wherein the linkage system includes a driving link operatively connected to the sled plate at a central fixed point, the driving link operative for rotating about the central fixed point.

According to an eleventh aspect, the gait training device of the tenth aspect or any other aspect, wherein the driving link is operatively connected to a clutch and transmission system.

According to a twelfth aspect, the gait training device of the eleventh aspect or any other aspect, wherein the clutch is a magnetic particle clutch.

According to a thirteenth aspect, the gait training device of the twelfth aspect or any other aspect, wherein the gait training device includes an outer footplate link operatively connected to the driving link and the footplate.

According to a fourteenth aspect, the gait training device of the thirteenth aspect or any other aspect, wherein a motor is operatively connected to the clutch and transmission system and causes rotation of the driving link, thereby causing motion of the outer footplate link and the footplate.

According to a fifteenth aspect, the gait training device of the thirteenth aspect or any other aspect, wherein the clutch and transmission system provide resistance to motion of the footplate via the driving link and outer footplate link.

According to a sixteenth aspect, a gait training device including: A) a handle for training arm motion; B) a footplate for training leg motion; and C) a linkage system operatively connected to the handle and the footplate for synchronizing the leg motion and the arm motion, the linkage system including: 1) a first connecting link; 2) a handle link; 3) a curved link; 4) an inner footplate link; 5) a gear system; and 6) a sled plate substantially perpendicular to a surface, wherein motion of the footplate causes: i) motion of the inner footplate link thereby causing the curved link operatively connected to the inner footplate link to rotate and engage the gear system; and ii) the gear system to rotate a first connecting link, wherein: a) the first connecting link is substantially parallel with a second connecting link; b) the first connecting link and the second connecting link are operatively connected near opposite ends of a portion of the handle link; and c) rotation of the first connecting link causes the handle link to move in an arc, thereby causing the handle to move with the handle link in the arc, substantially mimicking hand motion of a human walking gait.

According to a seventeenth aspect, the gait training device of the sixteenth aspect or any other aspect, wherein the linkage system includes a driving link operatively connected to the sled plate at a central fixed point, the driving link operative for rotating about the central fixed point.

According to a eighteenth aspect, the gait training device of the seventeenth aspect or any other aspect, wherein the gait training device includes an outer footplate link operatively connected to the driving link and the footplate.

According to a nineteenth aspect, the gait training device of the eighteenth aspect or any other aspect, wherein a motor is operatively connected to the clutch and transmission system and causes rotation of the driving link, thereby causing motion of the outer footplate link and the footplate.

According to a twentieth aspect, the gait training device of the eighteenth aspect or any other aspect, wherein the clutch and transmission system provide resistance to motion of the footplate via the driving link and outer footplate link.

According to a twenty-first aspect, a gait training device including: A) a handle for training arm motion; B) a footplate for training leg motion; and C) a linkage system operatively connected to the handle and the footplate for synchronizing the leg motion and the arm motion, the linkage system including: 1) a sled plate substantially perpendicular to a surface; 2) a driving link operatively connected to the sled plate at a central fixed point, the driving link operative for rotating about the central fixed point; 3) an inner footplate link operatively connected to the footplate; 4) a curved link operatively connected to the inner footplate link, the sled plate at a forward fixed point, and a gear system, the curved link operative for rotating about the forward fixed point; 5) a handle link operatively connected to the handle, a first connecting link, and a second connecting link; and 6) the first connecting link operatively connected to the gear system and rotatably connected to the sled plate at a medial fixed point, wherein: i) the first connecting link and the second connecting link are substantially parallel and rotatably connected to the sled plate; ii) the handle link includes: a) a first portion substantially parallel to the surface; and b) a second portion forming an acute angle to the first portion; iii) movement of the footplate causes retraction and extension of the inner footplate link thereby causing the curved link to rotate about the forward fixed point and engage the gear system; and iv) the gear system rotates the first connecting link about the medial fixed point, causing the first portion of the handle link and the handle to translate.

According to a twenty-second aspect, the gait training device of the twenty-first aspect or any other aspect, wherein the driving link is operatively connected to a clutch and transmission system.

According to a twenty-third aspect, the gait training device of the twenty-second aspect or any other aspect, wherein the clutch is a magnetic particle clutch.

According to a twenty-fourth aspect, the gait training device of the twenty-third aspect or any other aspect, wherein the footplate is configured to move along a base.

According to a twenty-fifth aspect, the gait training device of the twenty-fourth aspect or any other aspect, wherein the footplate: A) includes a toe end nearest the sled plate and a heel end furthest from the sled plate; and B) is configured to pivot such that the toe end and heel end raise or lower as the footplate moves along the base.

According to a twenty-sixth aspect, the gait training device of the twenty-fifth aspect or any other aspect, wherein moving the footplate a first particular distance causes the handle to translate via the gear system a second particular distance, wherein the second particular distance is less than the first particular distance.

According to a twenty-seventh aspect, the gait training device of the twenty-sixth aspect or any other aspect, wherein a difference between the second particular distance and the first particular distance are proportional to a difference between an average person's arm length and leg length.

According to a twenty-eighth aspect, the gait training device of the twenty-seventh aspect or any other aspect, wherein the difference between the second particular distance and the first particular distance is at least partially controlled by the gear system.

According to a twenty-ninth aspect, the gait training device of the twenty-eighth aspect or any other aspect, wherein the gait training device includes an outer footplate link operatively connected to the driving link and the footplate.

According to a thirtieth aspect, the gait training device of the twenty-ninth aspect or any other aspect, wherein a motor is operatively connected to the clutch and transmission system and causes rotation of the driving link, thereby causing motion of the outer footplate link and the footplate.

According to a thirty-first aspect, the gait training device of the thirtieth aspect or any other aspect, wherein the clutch and transmission system provide resistance to motion of the footplate via the driving link and outer footplate link.

According to a thirty-second aspect, the gait training device of the thirty-first aspect or any other aspect, wherein motion of the footplate causes motion of the outer footplate link and rotation of the driving link.

According to a thirty-third aspect, a gait training device including: A) a handle for training arm motion; B) a footplate for training leg motion; and C) a linkage system operatively connected to the handle and the footplate for synchronizing the leg motion and the arm motion, the linkage system including: 1) a sled plate substantially perpendicular to a surface; 2) a driving link operatively connected to the sled plate at a central fixed point, the driving link operative for rotating about the central fixed point; 3) an inner footplate link operatively connected to the footplate; 4) a curved link operatively connected to the inner footplate link, the sled plate at a forward fixed point, and a gear system, the curved link operative for rotating about the forward fixed point; 5) a handle link operatively connected to the handle, a first connecting link, and a second connecting link; and 6) the first connecting link operatively connected to the gear system and rotatably connected to the sled plate at a medial fixed point, wherein: i) the first connecting link and the second connecting link are substantially parallel and rotatably connected to the sled plate; ii) movement of the footplate causes retraction and extension of the inner footplate link thereby causing the curved link to rotate about the forward fixed point and engage the gear system; and iii) the gear system rotates the first connecting link about the medial fixed point, causing the handle to translate via the handle link.

According to a thirty-fourth aspect, the gait training device of the thirty-third aspect or any other aspect, wherein the driving link is operatively connected to a clutch and transmission system.

According to a thirty-fifth aspect, the gait training device of the thirty-forth aspect or any other aspect, wherein the clutch is a magnetic particle clutch.

According to a thirty-sixth aspect, the gait training device of the thirty-third aspect or any other aspect, wherein the footplate is configured to move along a base.

According to a thirty-seventh aspect, the gait training device of the thirty-sixth aspect or any other aspect, wherein the footplate: A) includes a toe end nearest the sled plate and a heel end furthest from the sled plate; and B) is configured to pivot such that the toe end and heel end raise or lower as the footplate moves along the base.

According to a thirty-eighth aspect, the gait training device of the thirty-sixth aspect or any other aspect, wherein moving the footplate a first particular distance causes the handle to translate via the gear system a second particular distance, wherein the second particular distance is less than the first particular distance.

According to a thirty-ninth aspect, the gait training device of the thirty-eighth aspect or any other aspect, wherein a difference between the second particular distance and the first particular distance are proportional to a difference between an average person's arm length and leg length.

According to a fortieth aspect, the gait training device of the thirty-eighth aspect or any other aspect, wherein the difference between the second particular distance and the first particular distance is at least partially controlled by the gear system.

According to a forty-first aspect, the gait training device of the thirty-forth aspect or any other aspect, wherein the gait training device includes an outer footplate link operatively connected to the driving link and the footplate.

According to a forty-second aspect, the gait training device of the forty-first aspect or any other aspect, wherein a motor is operatively connected to the clutch and transmission system and causes rotation of the driving link, thereby causing motion of the outer footplate link and the footplate.

According to a forty-third aspect, the gait training device of the forty-first aspect or any other aspect, wherein the clutch and transmission system provide resistance to motion of the footplate via the driving link and the outer footplate link.

According to a forty-fourth aspect, a gait training process including: A) training arm motion via a handle; and B) training leg motion via a footplate, wherein: 1) a linkage system is operatively connected to the handle and the footplate for synchronizing the leg motion and the arm motion, the linkage system including: i) a sled plate substantially perpendicular to a surface; ii) a driving link operatively connected to the sled plate at a central fixed point, the driving link operative for rotating about the central fixed point; ii) an inner footplate link operatively connected to the footplate; iii) a curved link operatively connected to the inner footplate link, the sled plate at a forward fixed point, and a gear system, the curved link operative for rotating about the forward fixed point; iv) a handle link operatively connected to the handle, a first connecting link, and a second connecting link; and v) the first connecting link operatively connected to the gear system and rotatably connected to the sled plate at a medial fixed point; 2) the first connecting link and the second connecting link are substantially parallel and rotatably connected to the sled plate; 3) the handle link includes: i) a first portion substantially parallel to the surface; and ii) a second portion forming an acute angle to the first portion; 4) movement of the footplate causes retraction and extension of the inner footplate link thereby causing the curved link to rotate about the forward fixed point and engage the gear system; and 5) the gear system rotates the first connecting link about the medial fixed point, causing the first portion of the handle link and the handle to translate.

According to a forty-fifth aspect, the gait training process of the forty-forth aspect or any other aspect, wherein the driving link is operatively connected to a clutch and transmission system.

According to a forty-sixth aspect, the gait training process of the forty-fifth aspect or any other aspect, wherein the clutch is a magnetic particle clutch.

According to a forty-seventh aspect, the gait training process of the forty-sixth aspect or any other aspect, wherein the footplate is configured to move along a base.

According to a forty-eighth aspect, the gait training process of the forty-seventh aspect or any other aspect, wherein the footplate: A) includes a toe end nearest the sled plate and a heel end furthest from the sled plate; and B) is configured to pivot such that the toe end and heel end raise or lower as the footplate moves along the base.

According to a forty-ninth aspect, the gait training process of the forty-eighth aspect or any other aspect, wherein moving the footplate a first particular distance causes the handle to translate via the gear system a second particular distance, wherein the second particular distance is less than the first particular distance.

According to a fiftieth aspect, the gait training process of the forty-ninth aspect or any other aspect, wherein a difference between the second particular distance and the first particular distance are proportional to a difference between an average person's arm length and leg length.

According to a fifty-first aspect, the gait training process of the fiftieth aspect or any other aspect, wherein the difference between the second particular distance and the first particular distance is at least partially controlled by the gear system.

According to a fifty-second aspect, the gait training process of the fifty-first aspect or any other aspect, wherein the linkage system includes an outer footplate link operatively connected to the driving link and the footplate.

According to a fifty-third aspect, the gait training process of the fifty-second aspect or any other aspect, wherein a motor is operatively connected to the clutch and transmission system and causes rotation of the driving link, thereby causing motion of the outer footplate link and the footplate.

According to a fifty-forth aspect, the gait training process of the fifty-second aspect or any other aspect, wherein the clutch and transmission system provide resistance to motion of the footplate via the driving link and outer footplate link.

According to a fifty-fifth aspect, the gait training process of the fifty-forth aspect or any other aspect, wherein motion of the footplate causes motion of the outer footplate link and rotation of the driving link.

According to a fifty-sixth aspect, a gait cycle training device including: A) a handle for training arm motion; and B) a footplate for training leg motion, wherein motion of the footplate a first particular distance causes: 1) motion of an inner footplate link thereby causing a curved link operatively connected to the inner footplate link to rotate and engage a gear system; and 2) the gear system to rotate a first connecting link, causing the handle to translate in a direction substantially parallel to a longitudinal axis of the handle a second particular distance via a handle link operatively connected to the handle and the first connecting link, wherein: i) the second particular distance is less than the first particular distance; and ii) a difference between the second particular distance and the first particular distance is proportional to a difference between an average person's arm length and an average person's leg length.

According to a fifty-seventh aspect, a gait cycle training device including: A) a handle for training arm motion; B) a footplate for training leg motion; and C) a linkage system operatively connected to the handle and the footplate for synchronizing the leg motion and the arm motion, the linkage system including: 1) a driving link operatively connected to an outside footplate link; 2) the outside footplate link operatively connected to the footplate; 3) an inner footplate link operatively connected to the footplate; 4) a curved link operatively connected to the inner footplate link and a gear system; 5) a handle link operatively connected to the handle, a first connecting link, and a second connecting link; and 6) the first connecting link operatively connected to the gear system, wherein: i) the first connecting link and the second connecting link are substantially parallel; ii) the handle link includes: a) a first portion substantially parallel to a longitudinal axis of the handle; and b) a second portion forming an acute angle to the first portion; iii) rotation of the driving link causes retraction and extension of the outer footplate link thereby causing the footplate to move; iv) movement of the footplate causes retraction and extension of the inner footplate link thereby causing the curved link to rotate and engage the gear system; and v) the gear system rotates the first connecting link, causing the first portion of the handle link and the handle to translate in a direction substantially parallel to the longitudinal axis of the handle.

According to a fifty-eighth aspect, a gait cycle training device including: A) a handle for training arm motion; and B) a footplate for training leg motion, wherein motion of the footplate causes: 1) motion of an inner footplate link thereby causing a curved link operatively connected to the inner footplate link to rotate and engage a gear system; and 2) the gear system to rotate a first connecting link, causing the handle to translate in a direction substantially parallel to a longitudinal axis of the handle via a handle link operatively connected to the handle and the first connecting link.

According to a fifty-ninth aspect, a gait cycle training device including: A) a handle for training arm motion; and B) a footplate for training leg motion, wherein: 1) rotation of a driving link causes retraction and extension of an outer footplate link thereby causing the footplate to move; 2) movement of the footplate causes retraction and extension of an inner footplate link thereby causing an operatively connected curved link to rotate about a fixed point and engage a gear system; and 3) the gear system rotates a first connecting link about a second fixed point, causing the handle to translate in a direction substantially parallel to a longitudinal axis of the handle via a handle link operatively connected to the first connecting link and the handle.

According to a sixtieth aspect, a gait cycle training device including: A) a handle for training arm motion; and B) a footplate for training leg motion, wherein motion of the footplate a first particular distance causes: 1) motion of an inner footplate link thereby causing a curved link operatively connected to the inner footplate link to rotate and engage a gear system; and B) the gear system to rotate a first connecting link, causing the handle to translate in a direction substantially parallel to a longitudinal axis of the handle a second particular distance via a handle link operatively connected to the handle and the first connecting link, wherein: 1) the second particular distance is less than the first particular distance; and 2) a difference between the second particular distance and the first particular distance is proportional to a difference between an average person's arm length and an average person's leg length.

According to a sixty-first aspect, a gait cycle training device including: A) a footplate for training leg motion in contact with a base, wherein motion of the footplate a first particular distance causes: 1) motion of an inner footplate link thereby causing a curved link operatively connected to the inner footplate link to rotate and engage a gear system; and 2) the gear system to rotate a first connecting link, causing a handle to translate in a direction substantially parallel to a longitudinal axis of the handle a second particular distance via a handle link operatively connected to the handle and the first connecting link, wherein: i) the second particular distance is less than the first particular distance; and ii) a difference between the second particular distance and the first particular distance is proportional to a difference between an average person's arm length and an average person's leg length.

According to a sixty-second aspect, a gait cycle training device including: A) a footplate for training leg motion in contact with a base; B) a handle operatively connected to the footplate via a linkage and gear system, wherein: 1) the linkage and gear system cause the handle to move a handle distance substantially parallel to the base in response to movement of the footplate a footplate distance along the base; and 2) a difference between the handle distance and the footplate distance is proportional to a difference between an average person's arm length and an average person's leg length.

According to a sixty-third aspect, the gait cycle training device of the sixty-second aspect or any other aspect, wherein: A) the gait training device includes an inner footplate link operatively connected to the footplate; and B) in response to movement of the footplate the footplate distance along the base, the inner footplate link moves thereby causing a curved link operatively connected to the inner footplate link to rotate and engage the gear system According to a sixty-forth aspect, the gait cycle training device of the sixty-third aspect or any other aspect, wherein, in response to movement of the footplate the footplate distance along the base, the gear system causes a first connecting link to rotate, causing the handle to translate in a direction substantially parallel to the base the handle distance via a handle link operatively connected to the handle and the first connecting link.

According to a sixty-fifth aspect, a device for seated or standing gait training including: A) a sled coupled to a base, the sled including: 1) a handle for training arm motion; and 2) a linkage and gear system operatively connected to the handle for synchronizing the arm motion with the leg motion at a ratio proportional to a ratio of an average person's arm length and leg length, the linkage and gear system operatively connected to a footplate; B) the footplate operatively connected to a base, the at least one footplate for securing the foot of a user for gait training; C) a tower operatively connected to the base, the tower including: 1) at least one adjustable seat; and 2) a body weight system for supporting a weight of a user during gait training.

According to a sixty-sixth aspect, the device of the sixty-fifth aspect or any other aspect, wherein the tower includes a seat back assembly for supporting a user's back during gait training.

According to a sixty-seventh aspect, the device of the sixty-sixth aspect or any other aspect, wherein: A) the tower includes a seat bottom assembly including the at least one adjustable seat; and B) the seat bottom assembly is operatively connected to the seat back assembly.

According to a sixty-eighth aspect, the device of the sixty-seventh aspect or any other aspect, wherein the seat back assembly and the seat bottom assembly are adjustable for seated or standing gait training.

According to a sixty-ninth aspect, the device of the sixty-eighth aspect or any other aspect, wherein: A) the seat bottom assembly is operatively connected to the seat back assembly; and B) upon adjustment of the seat back assembly, the seat bottom assembly substantially automatically adjusts.

According to a seventieth aspect, the device of the sixty-ninth aspect or any other aspect, wherein: A) the seat bottom assembly is hingedly connected to the seat back assembly via a pivot mechanism; and B) horizontal adjustment of the seat back assembly causes the seat bottom assembly to rotate about the pivot mechanism.

According to a seventy-first aspect, the device of the seventieth aspect or any other aspect, wherein: A) the seat back assembly is fixed to a pivot plate defining a pivot track; B) the seat bottom assembly is operatively connected to a roller positioned with the pivot track; and C) horizontal adjustment of the seat back assembly causes the roller to travel along the pivot track thereby causing the seat bottom assembly to rotate about the pivot mechanism.

According to a seventy-second aspect, the device of the seventy-first aspect or any other aspect, wherein: A) the pivot plate is a first pivot plate; B) the seat back assembly is fixed to the first pivot plate and a second pivot plate; C) the pivot track is a first pivot track; D) the second pivot plate defines a second pivot track; E) the roller is positioned within the first pivot track and the second pivot track; and F) the first pivot plate and the second pivot plate are substantially parallel.

According to a seventy-third aspect, the device of the seventy-second aspect or any other aspect, wherein the seat back assembly is adjustable via an actuator.

According to a seventy-fourth aspect, a device for seated or standing gait training including: A) a sled coupled to a base, the sled including: 1) a handle for training arm motion; and 2) the footplate operatively connected to a base, the at least one footplate for securing the foot of a user for gait training; and B) a tower operatively connected to the base, the tower including: 1) a seat back assembly adjustable via an actuator for supporting a user's back during gait training and fixed to at least one pivot plate defining a pivot track; 2) an adjustable seat bottom assembly hingedly connected to the seat back assembly via a pivot mechanism, operatively connected to a roller positioned within the pivot track, and including at least one adjustable seat, wherein horizontal adjustment of the seat back assembly by the actuator causes the roller to travel along the pivot track and the seat bottom assembly to rotate about the pivot mechanism.

According to a seventy-fifth aspect, the device of the seventy-forth aspect or any other aspect, wherein: A) the pivot plate is a first pivot plate; B) the seat back assembly is fixed to the first pivot plate and a second pivot plate; C) the pivot track is a first pivot track; D) the second pivot plate defines a second pivot track; E) the roller is positioned within the first pivot track and the second pivot track; and F) the first pivot plate and the second pivot plate are substantially parallel.

According to a seventy-sixth aspect, the device of the seventy-fifth aspect or any other aspect, wherein rotation of the bottom seat assembly is substantially proportional to horizontal translation of the seat back assembly.

According to a seventy-seventh aspect, the device of the seventy-sixth aspect or any other aspect, wherein the tower is operatively connected to a rotation system, the rotation system for rotating the tower with respect to the base.

According to a seventy-eighth aspect, the device of the seventy-seventh aspect or any other aspect, wherein: A) the tower is configured to rotate from a first position to a second position; B) in the first position, the tower is positioned approximately 90 degrees with respect to the base; C) in the second position, the tower is positioned approximately 0 degrees with respect to the base.

According to a seventy-ninth aspect, the device of the seventy-eighth aspect or any other aspect, wherein: A) a user can sit on a portion of the seat assembly in the first position; and B) a user can sit on the portion of the seat assembly in the second position and attach a foot to the footplate.

According to an eightieth aspect, the device of the seventy-ninth aspect or any other aspect, wherein the tower assembly including a lock-pin system for locking to tower in the first position or the second position.

According to an eighty-first aspect, the device of the eightieth aspect or any other aspect, wherein the tower includes a lock-pin system release positioned on an exterior portion.

According to an eighty-second aspect, the device of the eighty-first aspect or any other aspect, wherein the tower is configured to raise and lower the seat assembly.

According to an eighty-third aspect, the device of the eighty-second aspect or any other aspect, wherein the tower includes a body weight support (BWS) system for providing weight offloading of the user.

According to an eighty-forth aspect, the device of the eighty-third aspect or any other aspect, wherein the BWS system includes an overhead support operatively connected to a tower, the overhead support including a harness system for supporting weight of the user.

According to an eighty-fifth aspect, the device of the eighty-forth aspect or any other aspect, wherein the BWS system wherein the overhead support is operatively connected to a force transfer beam and a spring.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE FIGURES

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
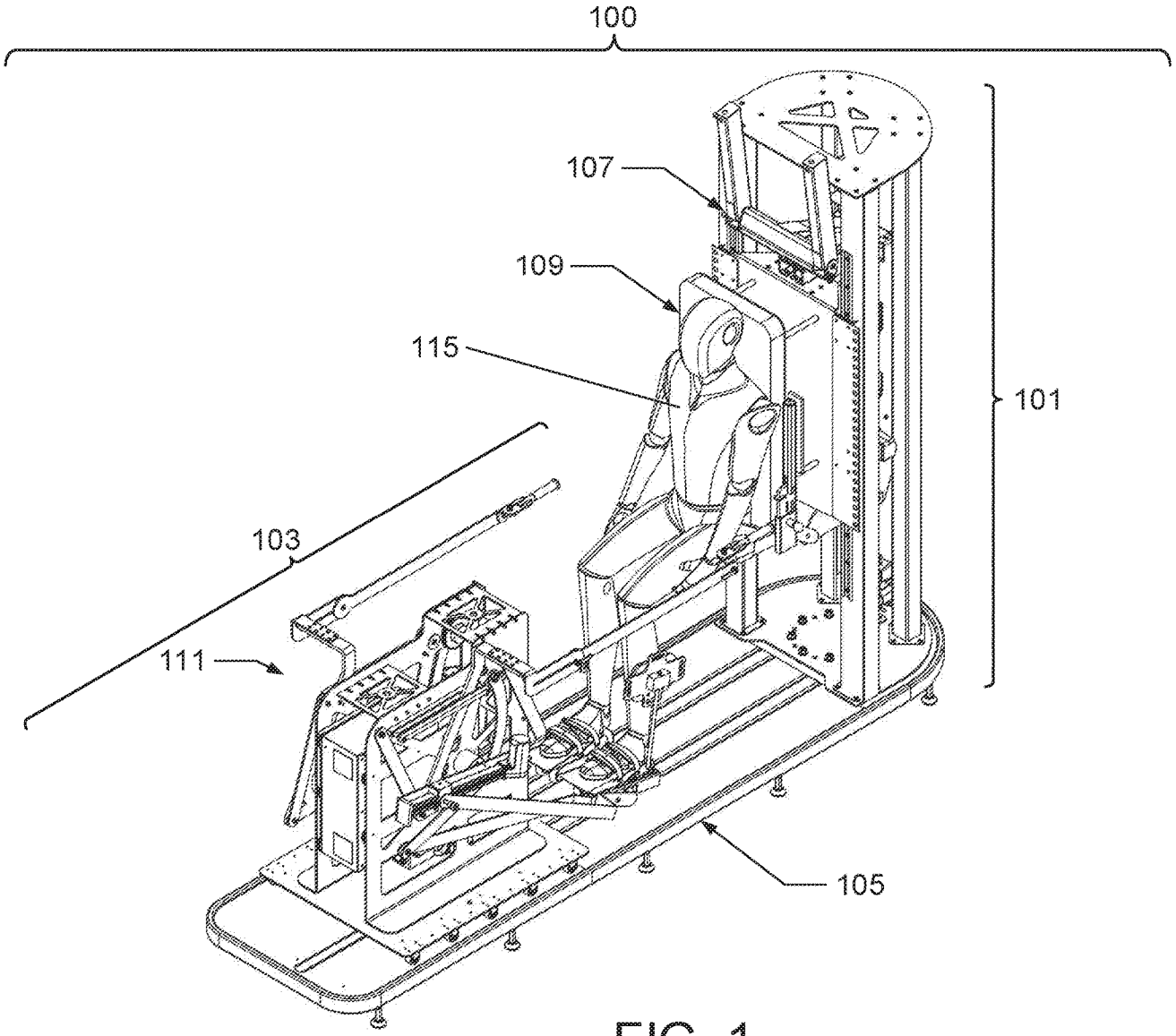
FIG. 1 is a perspective view of an exemplary rehabilitation device, according to one embodiment of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Whether a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

Overview

Aspects of the present disclosure generally relate to systems and methods for providing walking rehabilitation.

In various embodiments, provided herein are systems, methods, processes, and devices for providing locomotive rehabilitation to a subject. In one or more embodiments, the system may be operated in a standing position or a seated position, and the system may include one or more apparatuses that transition the system between a standing configuration mode and a seated configuration mode. For example, the system may include a tower containing a seating system that may be converted between a seated configuration (e.g., where the seating system is configured to receive a seated subject) and a standing configuration (e.g., where the seating system is withdrawn, thereby providing space for the system to receive a standing subject). In at least one embodiment, the system may allow a subject to transition between a standing configuration and a seated configuration (and vice versa) without requiring the subject to exit the machine. In one or more embodiments, a tower may also be capable of rotating such that a subject may more easily position themselves onto a seating system therein. For example, a seating system may be configured in a seated configuration, and a tower, containing the seating system, may be rotated outward by 90 degrees, thereby allowing a wheelchair-confined subject to more easily orient themselves therein.

In at least one embodiment, the system may include one or more apparatuses that allow a subject to experience locomotive rehabilitation while supporting only a portion of their own weight. In at least one embodiment, the system includes a body weight support (BWS) system that can controllably and incrementally offload a subject's weight, potentially reducing stresses and strains experienced by the subject during training, and, in some instances, providing standing locomotive training to subjects that may otherwise be incapable of performing standing exercises.

In at least one embodiment, the system may include a sled containing one or more linkage systems that allow a subject to experience locomotive rehabilitation via a mechanically facilitated and, in some instances, power-assisted gait cycle. In one or more embodiments, a linkage system may provide an artificial gait cycle that substantially accurately performs foot, leg, and arm movements involved in a natural gait cycle. For example, the linkage system may allow a subject to proceed through all phases of a typical gait cycle (as described herein), including, but not limited to, a terminal stance phase, a toe-off phase, swing phase, an initial contact phase, a loading response phase, and a mid-stance phase. In one or more embodiments, the linkage system may include footplates that receive a subject's feet and handles that a subject may grip (e.g., with their hands). In various embodiments, the linkage system may direct the footplates and handles through coordinated, simultaneous footplate and handle movements that recreate foot and arm movements demonstrated in a natural gait cycle.

For example, the linkage system may include one or more links that rotate and/or translate in response to translational forces applied by a subject (e.g., at footplates and/or handles), and/or in response to rotational forces applied by a connected motor unit. During a typical gait cycle, a forward translation of a foot may be accompanied by a simultaneous reverse translation. Accordingly, the linkage system may allow for simultaneous forward translation of a footplate and reverse translation of a handle, thereby providing a realistic mechanical recreation of a natural gait cycle.

In one or more embodiments, the system may include a clutch that allows the system to provide resistance to a subject's motions throughout locomotive rehabilitation. For example, the system may include a magnetic particle clutch that can provide controlled, incremented resistances to movements of a linkage system. In at least one embodiment, the system may include a motor unit that can be controllably connected and disconnected via the clutch. In one or more embodiments, the motor unit, upon activation, may generate rotational forces that provide powered assistance to a subject receiving locomotive rehabilitation. In at least one embodiment, the clutch connected to the motor unit may allow for precise control and manipulation of a magnitude of assistance provided to a subject. In an exemplary scenario, a subject may begin a first phase of training by operating a linkage system in a seated position, with partial assistance provided via a motor unit. The subject may then proceed to a second phase of training by operating the linkage system in a standing position, with a portion of the subject's weight being offloaded via a BWS system and a motor unit and clutch providing diminished partial assistance. The subject may then proceed to a third phase of training by operating the linkage system in a standing position, with a clutch providing a small amount of resistance and a motor unit providing no assistance. In various embodiments, a clutch may allow the rehabilitation system to safely accommodate involuntary (or voluntary) subject motions such as falls, spasms, etc., because the clutch may allow system footplates to "slip." For example, the clutch may allow the footplates to slip, if a subject falls and/or experiences a spasm that overcomes an assistance level configured by the clutch. In at least one embodiment, slip of the footplates may reduce stress loading experienced by a subject during a fall, spasm, etc.

In one or more embodiments, the present system may be configurable and capable of adjusting one or more system parameters and apparatuses to accommodate a variety of subject dimensions and weights. For example, a BWS system may be capable of providing offloading forces in a selectable range between about 0-300 pounds and/or in a selectable range between about 0-285 pounds. As another example, the system may include an actuation mechanism that can incrementally increase or decrease a stride length experienced during locomotive training. As an additional example, the system may include actuation mechanisms for incrementally increasing or decreasing height of a seating system, for adjusting a distance between a subject and a linkage system, and/or for adjusting a distance between a subject and handles and/or footplates.

In at least one embodiment, the system may include one or more displays, interfaces, controllers, and/or computing systems that can receive inputs and, based on inputs, adjust one or more system configurations and/or parameters. In various embodiments, the system may include one or more sensors for confirming safe configuration of the system and/or a subject therein, for collecting metrics describing locomotive rehabilitation training performed by a subject, and/or for providing inputs to system configuration processes. For example, the system may include positional and/or proximity sensors for measuring positions of one or more system components. As another example, the system may include one or more safety contact sensors that, if engaged or disengaged, cause the system to suspend training activities (e.g., via application of brakes, disengagement of a motor, etc.).

Exemplary Embodiments

Referring now to the figures, for the purposes of example and explanation of the fundamental processes and components of the disclosed systems and methods, reference is made to FIG. 1, which illustrates an exemplary, high-level overview of one embodiment of a rehabilitation system 100. As will be understood and appreciated, the exemplary rehabilitation system 100 shown in FIG. 1 represents merely one approach or embodiment of the present system, and other aspects are used according to various embodiments of the present system.

FIG. 1 is a perspective view of the exemplary rehabilitation system 100, according to one embodiment of the present disclosure. In at least one embodiment, the rehabilitation system 100 includes a tower 101 and a sled 103. In one or more embodiments, the tower 101 and/or the sled 103 may be mounted atop a base 105. In various embodiments, a base 105 may lie directly against a ground surface, or may be displaced upwards from a ground surface via one or more risers, or the like.

In various embodiments, a tower 101 and/or sled 103 may be mounted atop a base 105 in a manner such the tower 101 and/or sled 103 may translate (e.g., slide) forward and/or backwards along the base 105. For example, a base 105 may include one more channels for receiving wheels (or another mechanism facilitating a translating motion). In the same example, a sled 103 may include wheels, and the wheels may be positioned in alignment within the one or more channels of the base 105 (thereby facilitating translational motions along the base 105).

In one or more embodiments, a tower 101 may function independently of a track 105 and/or a sled 103. For example, a tower 101 may be sold and may function without being oriented atop a track 105 and/or without being oriented proximate to a sled 103. In at least one embodiment, a sled 103 may function independently of a tower 101 and/or a track 105. For example, a sled 103 may be sold and may function without being oriented atop a track 105 and/or without being oriented proximate to a tower 101. As another example, a tower 101 and a sled 103 may sold together, without a track 105. In the same example, the sled 103 and tower 101 may function (as described herein) without a track 105.

In at least one embodiment, the tower 101 may include a body weight support (BWS) system 107 and a seating system 109. In one or more embodiments, the BWS system 107 may provide weight offloading to a subject 115. For example, a BWS system 107 may generate and transmit a lifting force to the subject 115. The lifting force may reduce a weight experienced by the subject 115, thereby advantageously offloading downward forces (e.g., gravitational forces) experienced by the subject 115. In at least one embodiment, weight offloading may be desirable to a subject undergoing locomotive rehabilitation, because the subject may lack sufficient strength to support their full body weight in a standing position. Accordingly, weight offloading (via the BWS system 107) may proportionally reduce a magnitude of the body weight supported by the subject, thereby advantageously allowing the subject to perform locomotive rehabilitation exercises in a potentially less cumbersome, less tiring, and, less painful manner.

Figure 2:
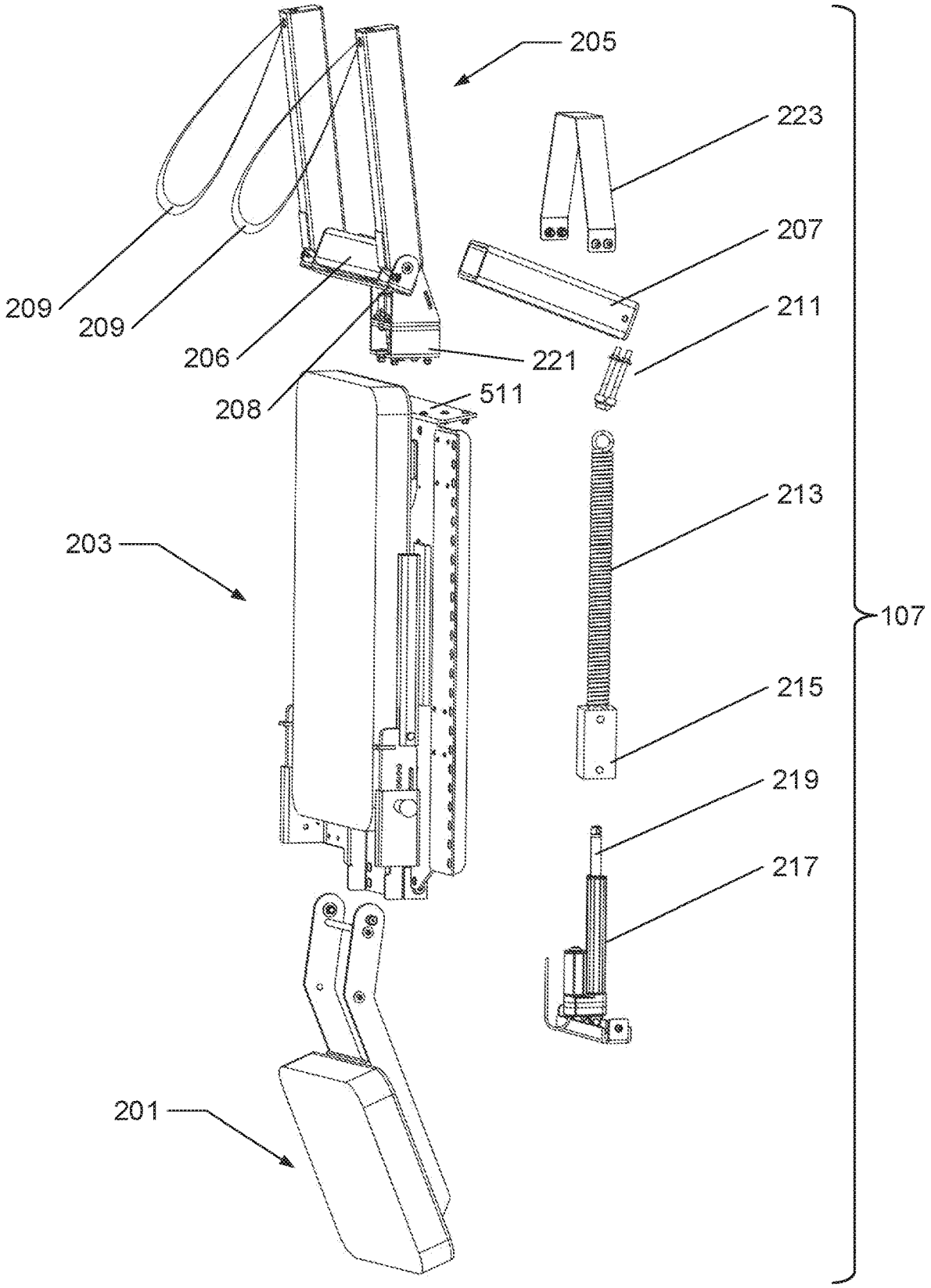
FIG. 2 is an exploded view of an exemplary weight offloading system, according to one embodiment of the present disclosure.

In at least one embodiment, the seating system 109 may provide a sit-stand configurability to the rehabilitation system 100. In one or more embodiments, a seating system 109 may include a seated configuration and a standing configuration (and/or other configurations). For example, the seating system 109 may include a seat bottom assembly 201 and a seat back assembly 203 (FIG. 2). In the same example, while in a seated configuration, the seat bottom assembly 201 may be rotated such that a seat bottom 501 (FIG. 5) is positioned orthogonal to the tower 101 (e.g., as is illustrated in FIG. 1, such that a subject can sit on the seat assembly 109). Also, while in the seated configuration, the seat back assembly may be translated and/or extended horizontally such that a seat back 507 (FIG. 5) is positioned proximate to and/or in partial contact with the seat bottom 501.

Figure 4:
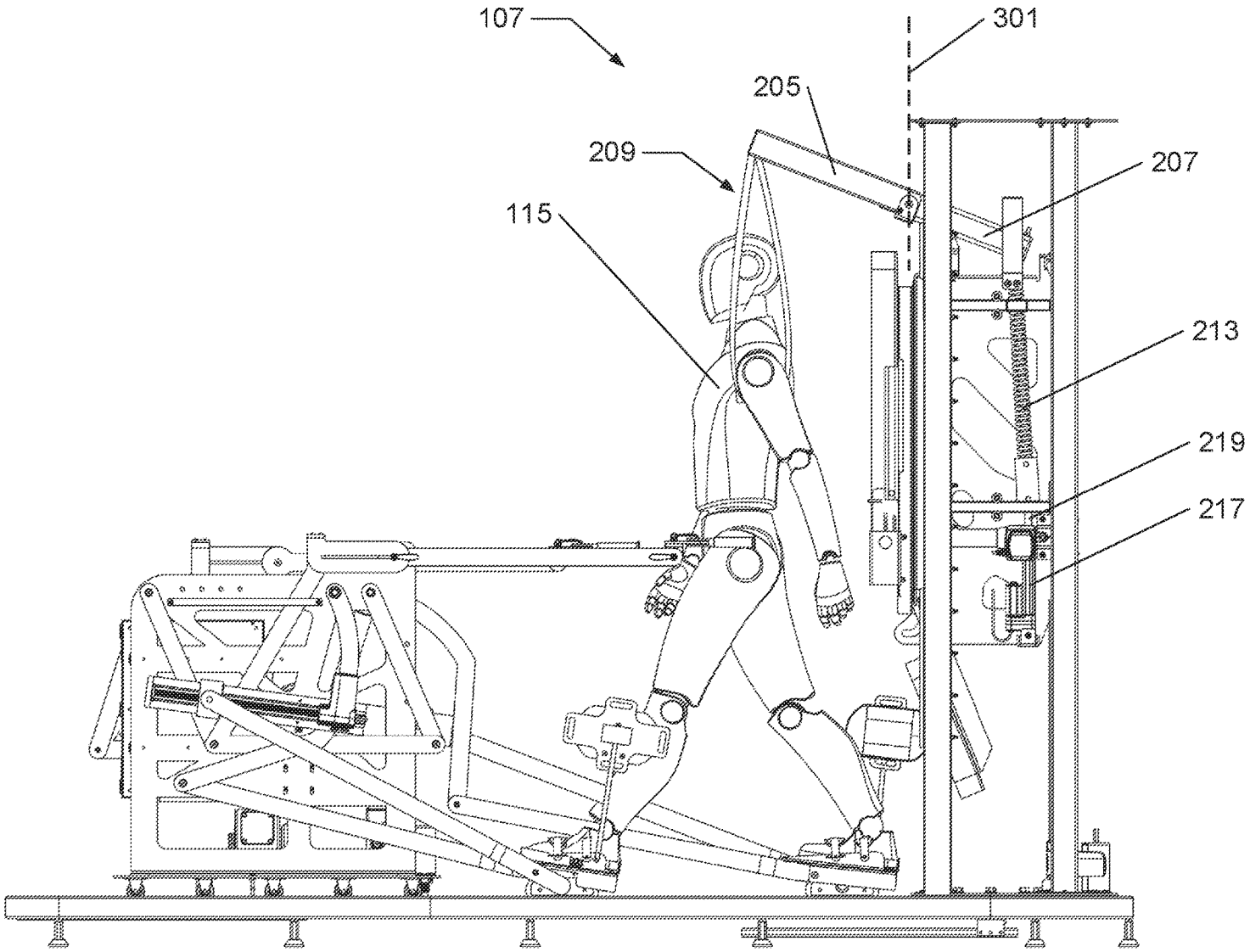
FIG. 4 is a side view of an exemplary rehabilitation device, according to one embodiment of the present disclosure.

In another example, while in a standing configuration, the seat bottom assembly 203 may be rotated downward from its position in the seated configuration, and the seat bottom assembly 203 may be drawn underneath the seat back assembly 203 and at least partially within the tower 101 (e.g., as shown in FIG. 4). In the same example, the seat back assembly 203 may be translated and/or retracted horizontally (e.g., becoming flush against the tower 101). In at least one embodiment, configuration of the seating system 109 may be determined via movement of one or more actuators (as described herein), and actuator movement may cause coordinated movement between the seat back assembly 203 and the seat bottom assembly 201. In various embodiments, the sit-stand configurability of the seating system 109 allows the rehabilitation system 100 to operate in a sitting mode or a standing mode, and permits powered transition between modes.

In one or more embodiments, providing seated and standing locomotive rehabilitation capabilities in a single system may be advantageous, because a subject 115 may need only one system, instead of two or more, to perform seated and standing locomotive rehabilitation. Previous solutions may require two or more systems (e.g., two or more separate, distinct machines) to provide seated and standing locomotive rehabilitation, thus the rehabilitation system 100 may advantageously reduce costs of performing position-varying locomotive rehabilitation. In addition, the rehabilitation system 100 may advantageously reduce the amount of training session time dedicated to moving patients between multiple machines, thereby allowing for a greater proportion of training session time to be spent performing rehabilitation exercises.

In at least one embodiment, the tower 101 may partially or fully rotate (e.g., with respect to the base 105) to allow a subject (e.g., subject 115) to enter or exit the apparatus. For example, the tower 101 may rotate outward (e.g., in a counter-clockwise or clockwise direction) in a manner such that the tower 101 faces left and outward (or right and outward) from the rehabilitation system 100.

In one or more embodiments, the sled 103 may include a linkage system 111. In at least one embodiment, the linkage system 111 provides a gait cycle motion to a subject 115. For example, legs of the subject 115 may be secured within footplates connected to the linkage system 111. In the same example, the linkage system 111 may facilitate movement of the footplates along the base 105, in a controlled gait cycle. In various embodiments, the linkage system 111 may move (e.g., translate) one or more handles in a motion synchronized with the footplates to a provided gait cycle. For example, the linkage system 111 may coordinate substantially accurate horizontal translations of one or more handles 1202 (FIG. 12) in synchronization with translations of one or more footplates 1204. In at least one embodiment, the linkage system 111 facilitates synchronization of hand and foot movements in a manner that mimics natural hand and foot movements experienced in an unassisted, typical gait cycle. In one or more embodiments, synchronized hand and foot movements may advantageously improve locomotive rehabilitation, because exercises therein may be more anatomically holistic and physiologically realistic. In at least one embodiment, synchronized hand and foot movements facilitated by the rehabilitation system 100 may be distinct from hand and foot movements facilitated by an elliptical machine, or the like. For example, an elliptical machine does not facilitate hand, leg, and foot motions that substantially accurately mimic hand, leg, and foot motions experienced during a natural, healthy gait cycle. An elliptical machine may facilitate exaggerated leg and foot movements intended for use in recreational exercises where a primary object may be to mimic athletic movements, or movements that purposefully generate substantial exertion from a subject therein (e.g., as opposed to training a subject to perform a healthy, natural gait cycle, and incrementally developing subject strength by mitigating exertion through powered assistance).

As described herein, a "natural", "normal", "healthy," and/or "typical" gait cycle generally refers to a sequence of events (e.g., leg movements) that occur during bipedal locomotion. A gait cycle may be divided into an advancing movement and a retreating movement. In one or more embodiments, an advancing movement includes, but is not limited to: 1) a terminal stance, wherein: a) a subject's heel rises from a ground surface while the subject's toes (on the same foot) remain grounded; b) the subject's hand (on the same side of the body) is positioned forward of the subject's foot, partially or wholly in front of the subject's body); 2) a toe-off, wherein: a) the subject's toes rise with the raised heel; and b) the subject's hand is drawn to a position closer to the subject's body; and 3) a swing phase, wherein: a) the subject's raised foot swings forward of the subject's hand, and the subject's heel and toes rotate upward; and b) the subject's hand moves across and partially or wholly behind the subject's body. In various embodiments, a retreating movement includes, but is not limited to: 1) an initial contact, wherein: a) the subject's heel, following the swing phase, makes contact with a ground surface while the subject's toes remain ungrounded; and b) the subject's hand is positioned behind the subject's body further back from the position experienced at the swing phase; 2) a loading response, wherein: a) the subject's foot rotates about the grounded heel and the subject's toes become grounded; and b) the subject's hand is positioned behind the subject's body, but forward of the point experienced at the initial contact phase; and 3) a mid-stance, wherein: a) the subject aligns and/or balances their weight atop their other foot (e.g., to begin the next gait cycle); and b) the subject's hand is positioned near the subject's body, forward of the subject's foot (e.g., the foot that experienced the mid-stance phase). In at least one embodiment, a gait cycle may be represented by a first arc, traced by a foot, and a second arc, traced by a hand. In one or more embodiments, the first arc may be relatively larger than the second arc. For example, during a gait cycle, a foot may trace a first arc of relatively similar angular magnitude, but relatively greater radius than a second arc traced by a hand. In the same example, as the foot traces the first arc in a counterclockwise direction, the hand may trace the second arc in a clockwise direction (e.g., and vice versa).

In at least one embodiment, the rehabilitation system 100 may include one or more position detection sensors that track and record orientations and positions of various system components and elements described herein. In one or more embodiments, the one or more position detectors may include, but are not limited to, hall sensors, inductive sensors, infrared sensors, and other sensors configured to measure and record positional data. For example, one or more actuators described herein may include one or more hall sensors that measure, record, and report a current positional state of the actuator. In the same example, the rehabilitation system 100 may include a computing environment that receives positional data from each hall sensor of each actuator. In at least one embodiment, the rehabilitation system 100 may store positional data and other information received from sensors distributed therein in memory or via cloud-based data storage.

FIG. 2 includes an exploded view of an exemplary body weight support (BWS) system 107 and portions of a seating system 109, according to one embodiment of the present disclosure. In at least one embodiment, the BWS system 107 may offload weight of a subject. For example, a subject may be situated in front of a tower 101 of a rehabilitation system 100 (FIG. 1). The subject may lack physical strength necessary for standing, or otherwise properly positioning themselves, within the tower 101. In other words, the subject, without offloading, may be incapable of supporting at least a portion of their own weight. The BWS system 107 may generate an offloading force and transfer the offloading force to the subject (as described herein) in a manner that effectively reduces (or eliminates) the weight experienced by the subject. For example, the BWS system 101 may generate an upward force that opposes a downward force (e.g., caused by gravity and the subject's mass), thereby reducing or eliminating the effective magnitude of the downward force.

Figure 5:
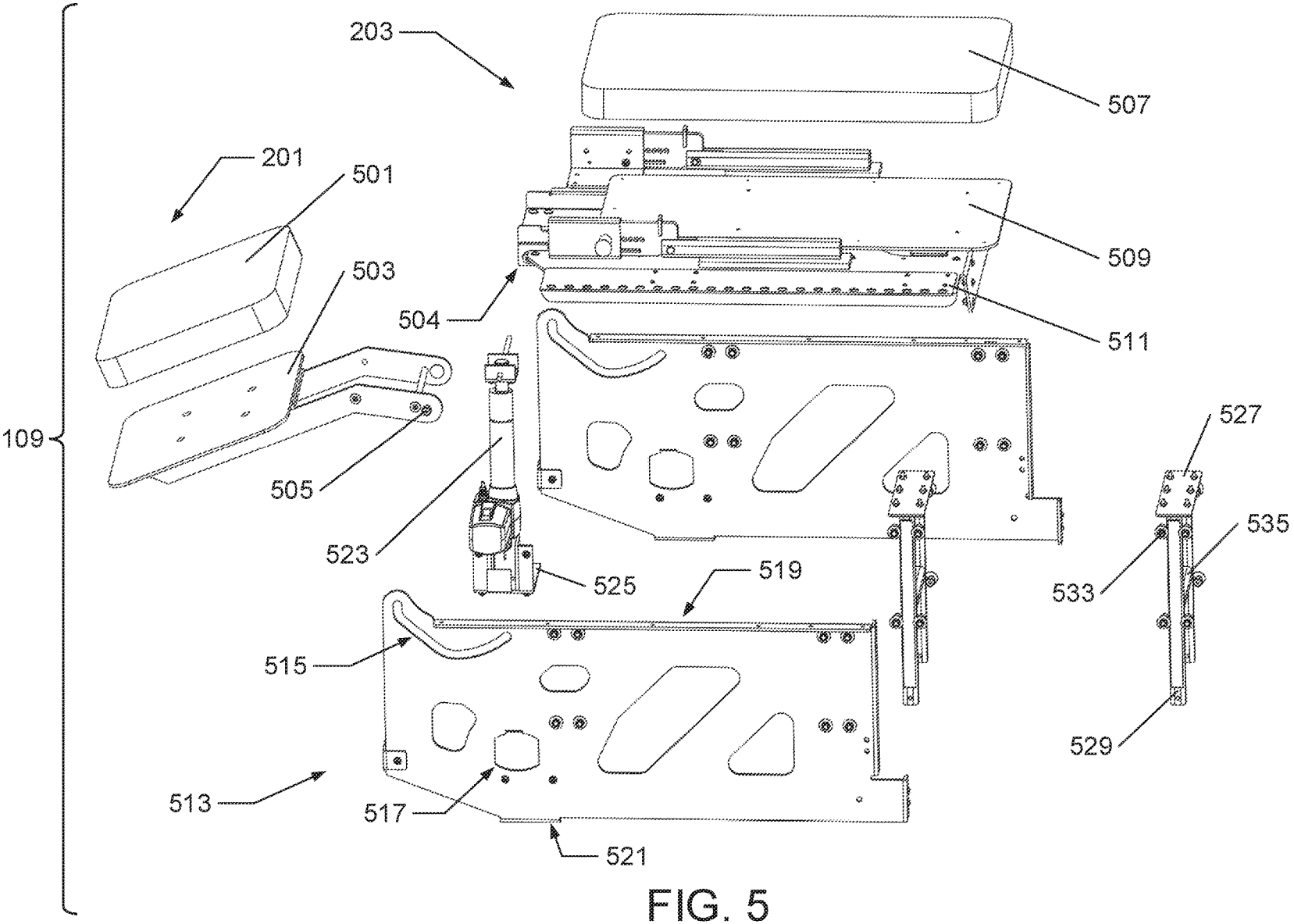
FIG. 5 is an exploded view of an exemplary sit-stand system, according to one embodiment of the present disclosure.

In one or more embodiments, the seating system 109 may include a seat bottom assembly 201 that may be operatively connected to a seat back assembly 203. For example, the seat bottom assembly 201 may be connected to the seat back assembly 203 via one or more pivot plates 513 (FIG. 5). In various embodiments, the seat back assembly 203 may be operatively connected to an overhead support 205 via a BWS linkage 221.

In various embodiments, the BWS system 107 can include, but is not limited to, an overhead support 205, a force transfer beam 207, a spring 213, a spring actuator 217, and a controller (not illustrated). In one or more embodiments, the overhead support 205 may be operatively connected to a body harness 209, and the body harness 209 may connect to or be worn by a subject 115. In at least one embodiments, a harness 209 may include one or more straps and/or may be secured around, over, and/or under a subject 115. For example, a harness 209 may include a vest that surrounds a subject 115. The vest may include one or more attachment points for attaching cables, straps, or another connector, which may then be used to connect the harness 115 to an overhead support 205. As another example, a harness 209 may include a plurality of cables, straps, and/or other connectors and fasteners that may attach to a subject 115 (or a harness receipt worn by or attached to the subject 115).

In at least one embodiment, the overhead support 205 may also be operatively connected, via a central support 206, to the force transfer beam 207. In one or more embodiments, the central support 206 and force transfer beam 207 may present a substantially quadrilateral cross-section, or may present a substantially circular cross-section. The force transfer beam 207 can be configured to rotate about a pivot point included in the BWS linkage 221. The force transfer beam 207 may be connected to the overhead support 205 at a first end. For example, the force transfer beam may be attached (e.g., fastened, adhered, welded, etc.) to a central support 206. The force transfer beam 207 may also be connected to a first spring anchor 211 (e.g., on an end opposite the attachment to the central support 206), thereby linking the force transfer beam 207 to the spring 213. The spring 213 may be attached and/or affixed to a second spring anchor 215, and the second spring anchor 215 may be secured to a spring actuator rod 219 included in a spring actuator 217. The spring actuator rod 219, via the spring actuator 217, may be configured to reversibly and controllably translate down and up, thereby stretching and contracting the spring 213. In at least one embodiment, stretching of the spring 213 may increase a downward tensile force acting upon the force transfer beam 207 (e.g., via the connection between the spring and the force transfer beam 207). In one or more embodiments, the force transfer beam 207 may convert (via the pivot point) downward tensile forces into upward lifting forces experienced by the overhead support 205, and the overhead support 205 may transfer upward lifting forces to a subject 115 via the harness 209, thereby offloading a portion or all of the subject's weight.

In an exemplary gait cycle, a subject's effective height may deviate up and down as the subject performs a step and proceeds through phases of the gait cycle. In one or more embodiments, to accommodate the height deviations, the overhead support 205 and force transfer beam 207 may pivot upwards and downwards (e.g., for example, 2 inches upwards and downward) in synchronization with the gait-precipitated height deviations. In at least one embodiment, the spring 213 may tolerate the upward and downward deviations of the subject by contracting (from an initial position) and extending (back to the initial position) in synchronization with the upward and downward deviations. In various embodiments, accommodation of gait-precipitated height deviations may provide for more consistent weight offloading (e.g., as compared to previous, non-accommodating rehabilitation systems), thereby advantageously maintaining a realistic gait cycle and potentially reducing stresses and strains experienced by the subject (e.g., because the subject will experience weight off-loading throughout the entirety of their gait cycle). In other words, a natural gait cycle may include "bumps" (e.g., slight deviations). Accordingly, a gait cycle provided via a rehabilitation system 100 may accommodate for "bumps" via a BWS system 107 that allows for slight vertical deviations as a subject walks (or otherwise proceeds through a gait cycle).

In one or more embodiments, a position of the spring actuator rod 219 may control a stretch length of the spring 213, and the stretch length of the spring 213 may determine a downward tensile force and subsequent lifting force provided by the BWS system 107. In at least one embodiment, positions of the spring actuator rod 219 may be configured via one or more controllers. For example, a position of the spring actuator rod 219 may be configured via an electronic controller configured to communicate with and transmit commands to the spring actuator. The electronic controller may transmit commands that cause the spring actuator 217 to increase or decrease displacement of the spring actuator rod 219 (e.g., thereby configuring the rod position). Also, the electronic controller may receive positional information from the spring actuator, and may also receive weight and/or force information from one or more position, weight and/or force sensors included in the spring actuator 223 and/or the BWS system 107 (e.g., configured between the overhead support 205 and the force transfer beam 207, between the force transfer beam 207 and the spring anchor 211, and/or between the first spring anchor 211 and the spring 213). Thus, by controlling the stretch of the spring 213, the BWS system 107 can controllably and incrementally provide an offloading, lifting force to a subject 115 configured within the rehabilitation system 100.

In various embodiments, the BWS system 107 may include a fail-safe 223. In at least one embodiment, the fail-safe 223 may provide a maximum pivot for the force transfer beam 207, and may prevent the force transfer beam 207 and overhead support 205 from over-rotating (e.g., for example, if the force transfer beam 207 were to become disconnected from the spring 213). For example, if the first spring anchor 211 were to fail and the spring 213, loaded with tensile force, were to become disconnected from the force transfer beam 207, the fail-safe 223 may prevent the force transfer beam from over-rotating (e.g., which may cause an undesirably rapid, extended drop of a subject 115 configured in the BWS system 107). In the same example, the force transfer beam 207 may experience an initial pivot, but, upon coming into contact with the fail-safe 223, the force transfer beam 207 may be halted (e.g., and thus an extended drop of a subject 115 may be stopped). In the same example, a harness 209 may also provide for an elastic buffer against rapid stops and/or halted drops, because the harness 209 may flex to cushion a subject 115 against an undesirably abrupt drop.

In at least one embodiment, the system includes an overhead support 205. In various embodiments, the overhead support may be operatively connected to the seat back brace 511 (FIG. 2) via a BWS linkage 221. In one or more embodiments, an overhead support 205 may include a substantially "U"-shaped configuration of support elements. For example, an overhead support may include a first supporting arm that is oriented parallel to a second supporting arm. The first and second supporting arms may be operatively connected via a central support 206, thereby forming a substantially "U"-shaped configuration. In various embodiments, as described herein, the central support 206 may be attached to a force transfer beam 207, thereby allowing the central support 206 and force transfer beam 207 to move as a single unit.

In at least one embodiment, the substantially "U"-shaped configuration may allow the overhead support 205 to equally distribute an offloading force between two or more subject lift points (e.g., such as a subject's underarms and/or shoulders). Equal distribution of offloading forces between two or more points may advantageously provide additional support and stability to a subject 115 connected to the BWS apparatus 107. Also, equal distribution of offloading forces may reduce stress and strain concentrations experienced by a subject and/or the offloading system. Reduction of stress and strain concentrations may be especially advantageous and desirable for subjects experiencing conditions and/or illnesses that weaken skeletomuscular structures, increase likelihood of pressure-related injuries (for example, contusions) and/or present one or more other ambulatory complications. In one or more embodiments, the substantially "U"-shaped configuration to allow the overhead support 205 to be oriented substantially over at least a portion of a subject (for example, a subject's head or shoulders).

In one or more embodiments, an overhead support 205 may include one or more shapes that allow for equal distribution of lifting and/or offloading forces about a subject. In at least one embodiment, an overhead support 205 shape may include, but is not limited to: 1) a "U"-shape; 2) one or more arcs; 3) one or more circles; 4) one or more quadrilaterals; and 5) one or more polygons, polyhedrons, or other shapes. For example, an overhead support 205 may include a circular shape that allows for a plurality of attachment points about which to distribute offloading forces (e.g., and also attach a harness 209).

In various embodiments, the central support 206 may be operatively connected to the BWS linkage 221, thereby securing the overhead support 205 to a seat back brace 511. In one or more embodiments, the central support 206 may be secured to the BWS linkage via a fixture mechanism that also allows the central support 206 (e.g., and thus the overhead support 205) to pivot about the fixture mechanism. In at least one embodiment, pivot of the central support 206 about the BWS linkage 221 may convert downward forces from a spring 213 into upward forces (e.g., that are transmitted to a connected overhead support 205, harness 209, and a subject 115).

In at least one embodiment, the support attachment 208 may include one or more hinges operatively connecting the support attachment 208 to each arm of an overhead support 205, and each arm may rotate about the one or more hinges. In one or more embodiments, each arm of the overhead support 205 may freely rotate about the support attachment 208 (e.g., and a connected central support 206) by a magnitude measuring between about 0-90 degrees. In at least one embodiment, rotation of the overhead support 205 may advantageously permit configuration of the overhead support 205 away from the seat back assembly 203, for example, in instances where a subject 115 does not require the BWS system 107. As another example, rotation of the overhead support 205 may also advantageously increase ease of entry into and exit from the seating system 109.

Figure 3:
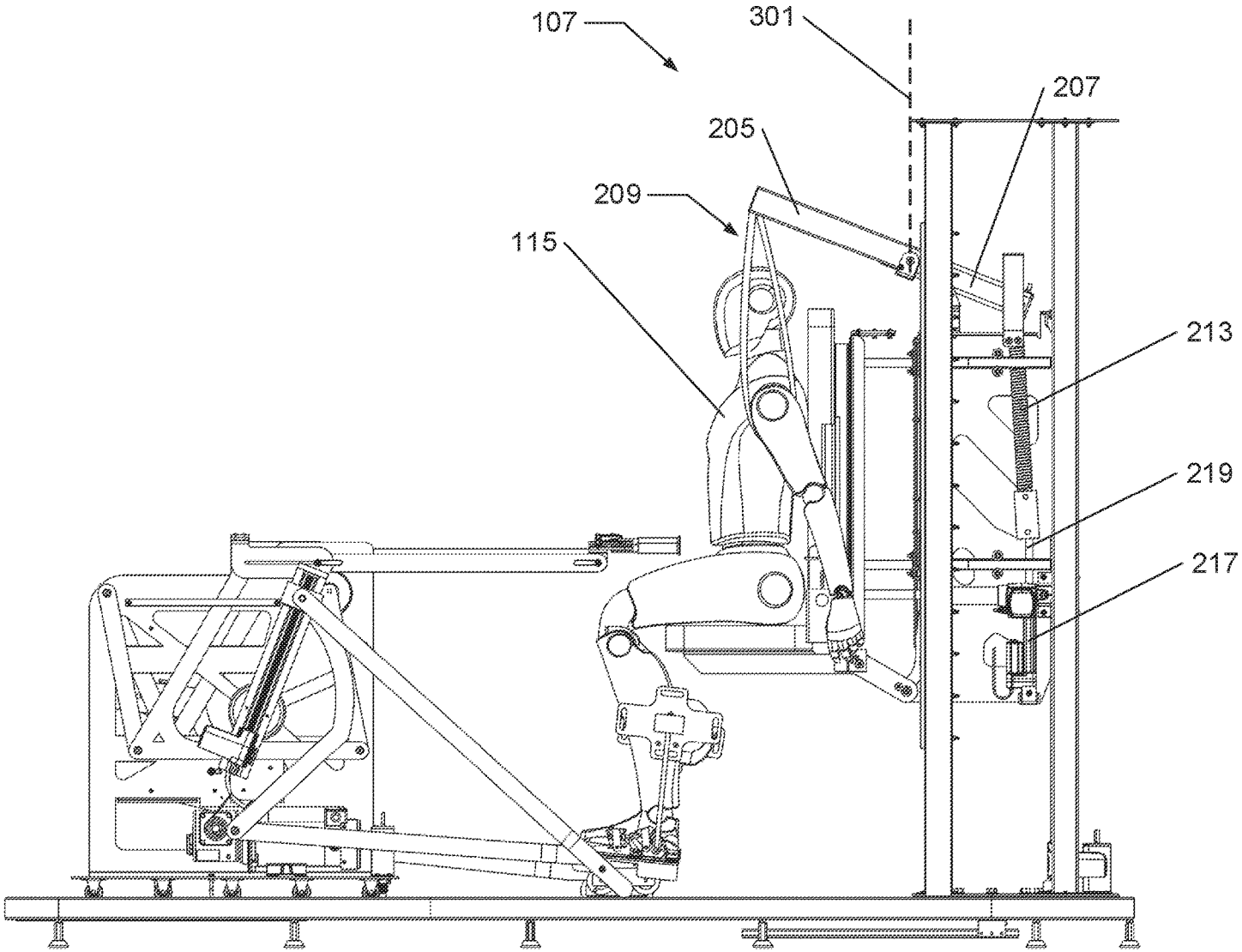
FIG. 3 is a side view of an exemplary rehabilitation device, according to one embodiment of the present disclosure.

In one or more embodiments, the overhead support 205 may be rotatable in a counterclockwise manner from a maximum counterclockwise position to a maximum clockwise position. In one or more embodiments, a maximum counterclockwise position may refer to an orientation where the overhead support 205 is positioned substantially orthogonal to a medial axis 301 (FIG. 3). In one or more embodiments, a maximum clockwise position may refer to an orientation where the overhead support 205 is positioned substantially parallel to and/or greater than 0 degrees clockwise from a medial axis 301 (e.g., as illustrated in FIG. 3). In at least one embodiment, the support attachment 208 may include one or more stops that limits rotation of the overhead support 107 about the support attachment 208. In one or more embodiments, the one or more stops may permit rotation of the overhead support within the angular movement ranges described herein, but may prevent rotation past a maximum counterclockwise position. For example, the one or more stops may allow the overhead support 205 to rotate between about 0-90 degrees (e.g., clockwise), but may prevent the overhead support 205 from rotating greater than 0 degrees counterclockwise or greater than 90 degrees clockwise. In the same example, the one or more stops may include a back plate that, upon the overhead support 205 being rotated to about 0 degrees with respect to the support attachment 208, comes into contact with the support attachment 208 and prevents further counterclockwise rotation of the overhead support 205.

FIG. 3 is a side view of an exemplary rehabilitation system 100 as would be configured prior to activation of a BWS system 107. For illustrative and descriptive purposes, in FIG. 3, one or more portions of the rehabilitation system 100 may be excluded to allow for presentation and discussion of various internal system elements provided herein. In at least one embodiment, the BWS system 107, prior to activation, may include a spring 213 configured in a relaxed, un-stretched state (or a first stretched state measuring less than a secondary, activated stretched state). In one or more embodiments, a spring actuator 217 and a spring actuator rod 219 may be in a first, extended position. In various embodiments, a force transfer beam 207 and overhead support 205 may be in a non-flexed and/or rest state, and a harness 209 may be in a slackened state (or may otherwise be substantially devoid of tension). In at least one embodiment, a subject 115 configured within the rehabilitation system 100 and the BWS system 107 may experience, prior to activation of the BWS system 107, a full magnitude of the subject's own weight or the subject's weight may be supported by the seat assembly 109.

In an exemplary, non-offloading scenario, a subject 115 may be secured to an overhead support 205 via a body harness 209. The overhead support 205 may be rotated slightly above a maximum counterclockwise position, lying slightly less than orthogonal to a medial axis 301. The body harness 209 may be absent significant tensile forces (e.g., due to lack of experiencing a lifting force). A spring actuator 217 and a spring actuator rod 219 may be configured in an extended position, thereby relaxing a spring 213. The spring 213, being in a relaxed state (or at least a first stretched state measuring less than a second stretched state), may provide a minimum or resting downward force (to the force transfer beam 207) that is insufficient for offloading a significant portion of the subject 115's weight.

FIG. 4 is a side view of an exemplary rehabilitation system 100 as would be configured during activation of a BWS system 107. In at least one embodiment, the BWS system 107, upon activation, may include a spring 213 configured in a stretched state (or an activated, stretched state measuring greater than a first stretched state). In one or more embodiments, a spring actuator 217 and spring actuator rod 219 may be in a secondary, retracted position (thereby causing stretch of the spring). In various embodiments, a force transfer beam 207 and an overhead support 205 may be in a flexed, loaded state (e.g., due to stretch of the spring generating additional downward, tensile forces), and may convert a downward force (from the spring 213) into a lifting force. In at least one embodiment, the lifting force may be translated to a body harness 209, thereby configuring the body harness 209 into a tensed state and transferring the lifting force to a subject 115. In at least one embodiment, a subject 115 configured within the BWS system 107 may experience a partial magnitude of the subject's own weight (e.g., in proportion to a stretch length of the spring). In one or more embodiments, because the subject 115 experiences an offloading of a portion of their weight, the subject 115 may be better capable of performing locomotive rehabilitation activities.

In an exemplary, non-offloading scenario, a subject 115 may be secured to an overhead support 105 via a body harness 209. The overhead support 205 may be rotated to a maximum counterclockwise position (e.g., lying slightly less than orthogonal to a medial axis 301). The body harness 209 may be absent significant tensile forces (e.g., due to lack of experiencing a lifting force). A spring actuator 217 and a spring actuator rod 219 may be configured in an extended position, thereby relaxing a spring 213. The spring 213, being in a relaxed state (or at least a first stretched state measuring less than a second stretched state), may provide a minimum or resting downward force (to the force transfer beam 207) that is insufficient for offloading a significant portion of the subject 115's weight.

FIG. 5 is an exploded view of an exemplary seating system 109, according to one embodiment of the present disclosure. In at least one embodiment, the seating system 109 may include, but is not limited to, a seat bottom assembly 201, a seat back assembly 203, and one or more pivot plates 513. For example, a seating system 109 may include two pivot plates 513. In the same example, a seat back assembly 203 may be securely attached to the two pivot plates 513, and a seat bottom assembly 201 may be attached to both the seat back assembly 203 and the two pivot plates 513. In one or more embodiments, the seat back assembly 203 may include, but is not limited to, a seat back 507, a seat back plate 509, and a seat back brace 511. In at least one embodiment, a seating system 109, and elements included therein, may include one or more materials including, but not limited to: 1) metal (such as, for example, stainless steel); 2) polymers (e.g., durable plastics capable of withstanding stresses and strains generated during actions described herein); 3) padding materials (e.g., such as, for example, rubber padding, polymer-based padding, etc.).

In various embodiments, the seat bottom assembly 201 may include, but is not limited to: 1) a seat bottom 501 attached to a seat bottom brace 503; 2) a pivot mechanism 504; and 3) one or more pivot plate rollers 505. In one or more embodiments, a pivot plate 513 may include, but is not limited to, a pivot track 515, an actuator clearance hole 517, and an actuator plate receipt 521. In at least one embodiment, the pivot plate roller 505 may be positioned within the pivot track 515, and may be configured to freely translate along the pivot track 515. To continue the above example, the two pivot plates 513 may each include a pivot track 515. In the same example, the two pivot tracks 515 may receive a pivot plate roller 505. In at least one embodiment, a pivot plate roller 505 may include a bearing and/or wheel system that allows for rotation along a pivot track 515. In one or more embodiments, a pivot plate 513, and elements thereof, may include one or materials including, but not limited to: 1) metal (such as, for example, stainless steel); 2) polymers (e.g., durable plastics capable of withstanding stresses and strains generated during actions described herein); 3) padding materials (e.g., such as, for example, rubber padding, polymer-based padding, etc.).

In at least one embodiment, the seat back brace 511 may include a pivot mechanism 504. In various embodiments, the seat bottom brace 503 may be operatively attached to the pivot mechanism 504 (e.g., via a rod, roller, or the like). In one or more embodiments, the pivot mechanism 504 may include, but is not limited to, a rod, roller, hinge, or the like, that permits rotation of the seat bottom assembly 201 about the pivot mechanism 504.

In at least one embodiment, horizontal translation of the seat back assembly 203 may be converted, via the pivot mechanism 504, pivot track 515, and pivot rollers 505, into a rotational pitch of the seat bottom assembly 201. Accordingly, in various embodiments, the pivot mechanism 504, pivot track 515, and one or more pivot rollers 505 may allow the seat bottom assembly 201 to automatically rotate in proportion to a horizontal translation of the seat back assembly 203. In one or more embodiments, simultaneous translation and rotation of the seat back assembly 203 and the seat bottom assembly 201 may be referred to as a "sit-stand" transition. In various embodiments, a sit-stand transition may include, but is not limited to: 1) extension (or retraction) of a sit-stand actuator 523 and one or more actuator control rods 529; 2) forward (or backward) horizontal translation of a seat back assembly 203; and 3) clockwise (or counterclockwise) rotation of the seat bottom assembly 201, in proportion to horizontal translation of the seat back assembly 203.

For example, a pivot mechanism 504 may be connected to a seat bottom brace 503 via a freely rotatable rod. The pivot mechanism 504 may be attached to and/or integrally formed with a lower rear portion of the seat back brace 511. The seat back brace 511 may be connected to a sit-stand actuator 523 via four actuator control rods 529 (or any suitable number thereof), and the sit-stand actuator 523 may extend and retract, thereby causing horizontal translations of the seat back assembly 201. The seat apparatus 109 may be attached to and configured between two parallel pivot plates 513, and two pivot rollers may be positioned within a pivot track 515 of each pivot plate 513. Prior to extension of the sit-stand actuator 523, the two pivot rollers may be positioned at the top of each pivot track 515. Upon extension of the sit-stand actuator 523, the four actuator control rods and the seat back assembly 203 may translate horizontally outward from the seating system 109. As the seat back assembly 203 translates horizontally, a rod within the pivot mechanism 504 may also translate laterally, attempting to horizontally translate the seat bottom assembly 201. Simultaneously, the pivot rollers 515 may translate downward along the pivot tracks 515, and the movement of the pivot rollers 515 may transform the horizontally translating interaction (occurring at the pivot mechanism 504) into a rotational interaction. The rotational interaction may cause the seat bottom assembly 201 to rotate, about the pivot mechanism 504, by a magnitude proportional to the magnitude of horizontal translation experienced by the seat back assembly 203. For example, the seat bottom assembly 201 may rotate 5 degrees clockwise for every 5 cm of horizontal translation experienced by the seat back assembly 203 (e.g., in a direction away from the seating system 109). In at least one embodiment, rotation of the seat bottom assembly 201 and translation of the seat back assembly 203 may occur at a fixed ratio measuring between about 0:1 and 0:10, between about 1:1 and 1:10, between about 1:0 and 10:0, between about 1:1 and 10:1, or on or more other ratios.

In various embodiments, rotation of the seat bottom assembly 201 about the pivot mechanism 504 may cause the pivot rollers 505 to translate up or down the pivot track 515. For example, the seat bottom assembly 201 may be oriented at a first angle of −30 degrees from vertical. In the same example, as the seat bottom assembly 201 rotates clockwise about the pivot mechanism 504 (e.g., towards a second angle about +90 degrees from vertical) the pivot rollers 505 may translate downwards along two pivot tracks 515 (e.g., arranged in two pivot plates 513 oriented parallel to each other).

In at least one embodiment, an actuator clearance hole 517 may receive a portion of a sit-stand actuator 523. In one or more embodiments, the sit-stand actuator 523 may be attached to an actuator back plate 525, and the actuator back plate 525 may be operatively coupled to the actuator plate receipt 521. In various embodiments, the sit-stand actuator 523 may be operatively coupled to the seat back brace 511. In one or more embodiments, extension of the sit-stand actuator 523 may cause horizontal translation of the seat back assembly 203. In at least one embodiment, the seat back brace 511 may also be secured to the pivot mechanism 504. In various embodiments, translation of the seat back assembly 203 may cause horizontal translation of the pivot mechanism 504. In at least one embodiment, horizontal translation of the pivot mechanism 504 may cause the seat bottom assembly 201 to rotate about the pivot mechanism 504, thereby causing the pivot rollers 505 to translate along the pivot track 515.

In various embodiments, a seat bottom assembly 201 may rotate independently of a seat back assembly 203. For example, a seat bottom assembly 201 may be operatively connected to a seat bottom assembly actuator that provides a translating force to a seat bottom brace 503, which is translated into a rotational force via one or more pivot rollers 505 and one or more pivot tracks 515. In the same example, the seat bottom assembly 201 may not be attached to a seat back assembly 203, thereby allowing for independent motions therebetween. In the same example, because the seat bottom assembly 201 is connected to its own seat bottom assembly actuator, the seat bottom assembly 201 may rotate independently of seat back assembly 203 translation and/or actuation. In at least one embodiment, rotation of the seat bottom assembly 201 may be achieved via extension and retraction of a wedge, or the like, that translates beneath the seat bottom assembly 201. For example, a wedge may be translated beneath a seat bottom assembly 201 and may drive the seat bottom assembly 201 upward, and causing the seat bottom assembly 201 to rotate via one or more pivot rollers 505 and one or more pivot tracks 515.

In at least one embodiment, the seat back brace 511 may be connected (e.g., attached) to one or more sit-stand plates 527. In one or more embodiments, each sit-stand plate 527 may be connected to one or more control rods 529. For example, each sit-stand plate 527 may be a substantially rectangular plate, and a control rod 529 may be attached to each end of one side of the sit-stand plate 527. In the same example, a control rod crossbeam 535 may be connected to and form a connection between the control rods 529. In various embodiments, one or more control rod wheels 533 may be attached to a pivot plate 513 in manner such that the wheels 533 are positioned above and/or below, and are in contact with one or more control rods 529. In the above example, each control rod 529 may rest atop two control rod wheels 533 and two additional control wheels 533 may be in contact with a top surface of each control rod 529. In the same example, the control rod wheels 533 may permit the control rods 529 to translate horizontally (e.g., in response to retraction and extension of the actuator 523). In various embodiments, translation of one or more control rods 529 may cause translation of the seat back assembly 203, thereby causing rotation of the seat bottom assembly 201 via the pivot mechanism 504, pivot rollers 505, and one or more pivot tracks 515.

Figure 6:
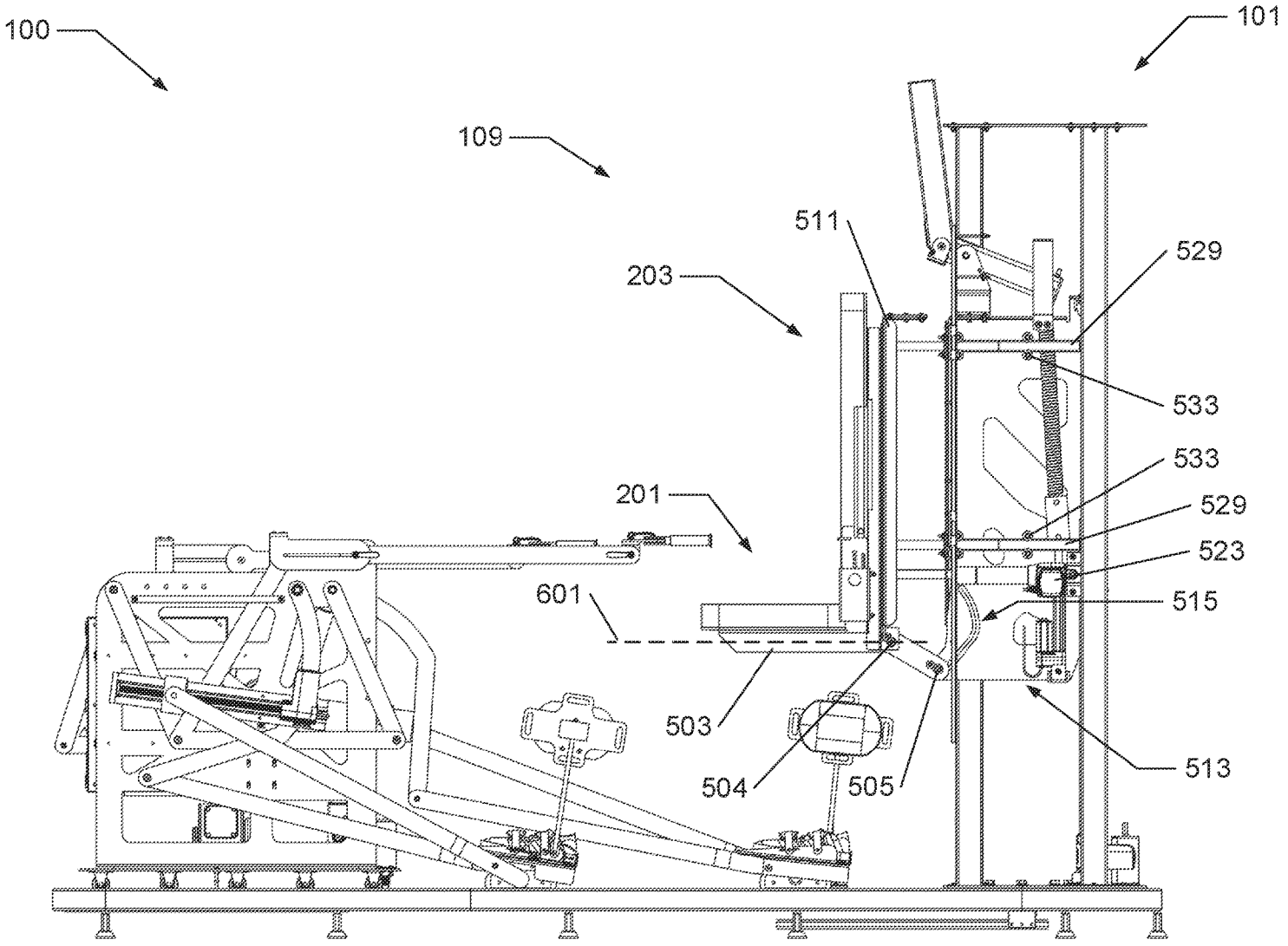
FIG. 6 is a side view of an exemplary rehabilitation device, according to one embodiment of the present disclosure.

FIG. 6 is a side view of an exemplary rehabilitation system 100, which is shown in an exemplary seated configuration. In various embodiments, the rehabilitation system 100 includes a tower 101 that includes a seating system 109 configured in a seated configuration. In at least one embodiment, for illustrative and descriptive purposes only, FIGS. 6-8 may show a tower 101 with a front column removed to permit better view of components therein. In one or more embodiments, the seated configuration includes, but is not limited to: 1) a seat bottom assembly 201 positioned substantially parallel to a horizontal axis 601; 2) a seat back assembly 203 extending outward from the tower 101; 3) one or more actuator control rods 529 extending outward from the tower 101; 4) a sit-stand actuator 523 in an extended position and projecting outward from the tower 101; and 5) one or more pivot rollers 505 positioned at a bottom point of a pivot track 515. In at least one embodiment, in the seated configuration, extension of the sit-stand actuator 523 causes horizontal translation of the seat back assembly 203 via connections between a seat back brace 511, the sit-stand actuator 523, and one or more actuator control rods 529. In various embodiments, horizontal translation of the seat back assembly 203 away from the tower 101 generates a translational force at a pivot mechanism 504. In at least one embodiment, the translational force is converted, via one or more pivot rollers 505 and one or more pivot tracks 515, into a clockwise rotational movement of the seat bottom assembly 201 about the pivot mechanism 504. In one or more embodiments, the rotational movement about the mechanism 504 proceeds continuously as the seat back assembly 203 horizontally translates, and the magnitude of the rotational movement may be proportional to the magnitude of horizontal translation. For example, maximum horizontal translation (e.g., away from the tower 101) may cause maximum clockwise rotation about the pivot mechanism 504.

In one or more embodiments, the one or more control rods 529 may be positioned atop one or more control rod wheels 533 and/or in between two or more control rod wheels 533. In at least one embodiment, the one or more rod wheels 533 may reduce a magnitude of force required to horizontally translate the seat back assembly 203 and rotate the seat bottom assembly 201 (e.g., via a pivot mechanism 504, pivot tracks 515, and pivot rollers 505). For example, the one or more rod wheels 533 may reduce a static and a kinetic coefficient of friction due to formation of a wheel and track system that supports the seat back assembly 203 and seat bottom assembly 201, and provides a wheeled mechanism for translating the seat back assembly 203.

Figure 7:
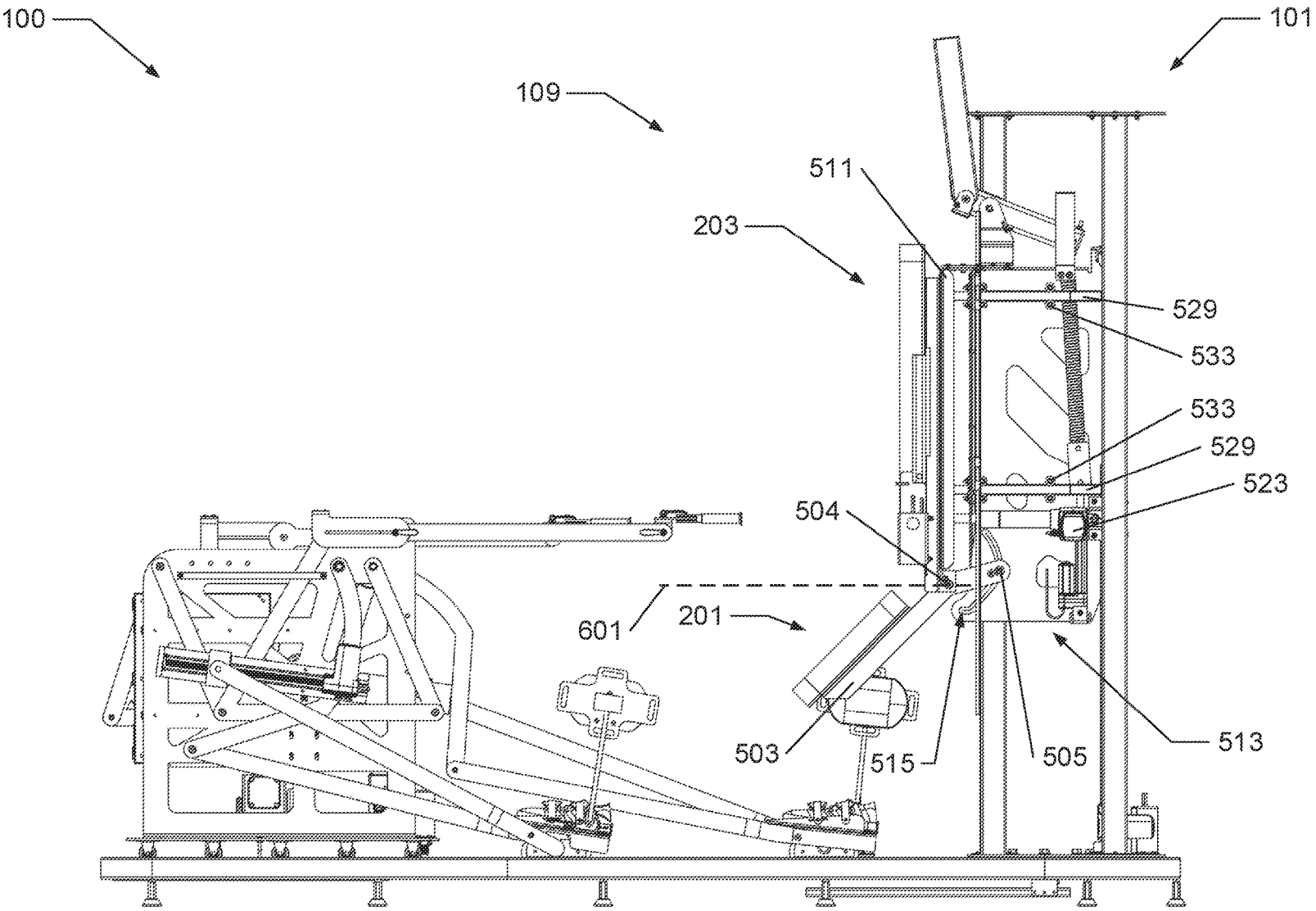
FIG. 7 is a side view of an exemplary rehabilitation device, according to one embodiment of the present disclosure.

FIG. 7 is a side view of an exemplary rehabilitation system 100, which is shown in an exemplary transitioning configuration. In various embodiments, the rehabilitation system 100 includes a tower 101 that includes a seating system 109 arranged in a transitional configuration as would be experienced during a sit-stand transition (e.g., between a seated and a standing configuration). In one or more embodiments, the transitional configuration includes, but is not limited to: 1) a seat bottom assembly 201 positioned at an angle acute and/or generally complementary to a horizontal axis 601 (for example, positioned an angle greater than 0 degrees and less than 120 degrees from the axis 601); 2) a seat back assembly 203 retracting towards the tower 101 from an outwardly extended position; 3) one or more actuator control rods retracting towards the tower 101 from an outwardly extended position; 4) a sit-stand actuator 523 in a retracting position and translating backwards toward the tower 101; and 5) one or more pivot rollers 505 positioned at a midpoint of a pivot track 515. In at least one embodiment, in the transitional configuration, retraction of the sit-stand actuator 523 causes horizontal translation of the seat back assembly 203 via connections between a seat back brace 511, the sit-stand actuator 523, and one or more actuator control rods 529. In various embodiments, horizontal translation of the seat back assembly 203 towards the tower 101 generates a translational force at a pivot mechanism 504. In at least one embodiment, the translational force is converted, via one or more pivot rollers 505 and one or more pivot tracks 515, into a counterclockwise rotational movement of the seat bottom assembly 201 about the pivot mechanism 504. In one or more embodiments, the rotational movement about the mechanism 504 proceeds continuously as the seat back assembly 203 horizontally translates, and the magnitude of the rotational movement may be proportional to the magnitude of horizontal translation. For example, partial horizontal translation (e.g., towards the tower 101) may cause partial counterclockwise rotation about the pivot mechanism 504. In at least one embodiment, a ratio between rotation of the seat bottom assembly 201 and a translation of the seat back assembly 203 may measure about 7.5 degrees of rotation per inch of translation. For example, for a seat back assembly 203 translation measuring about 16 inches, the seat bottom assembly 201 may rotate about 120 degrees. In one or more embodiments, a translation-rotation ratio may be adjustable via modification and/or replacement of one or more pivot tracks 515, or other system elements described herein.

Figure 8:
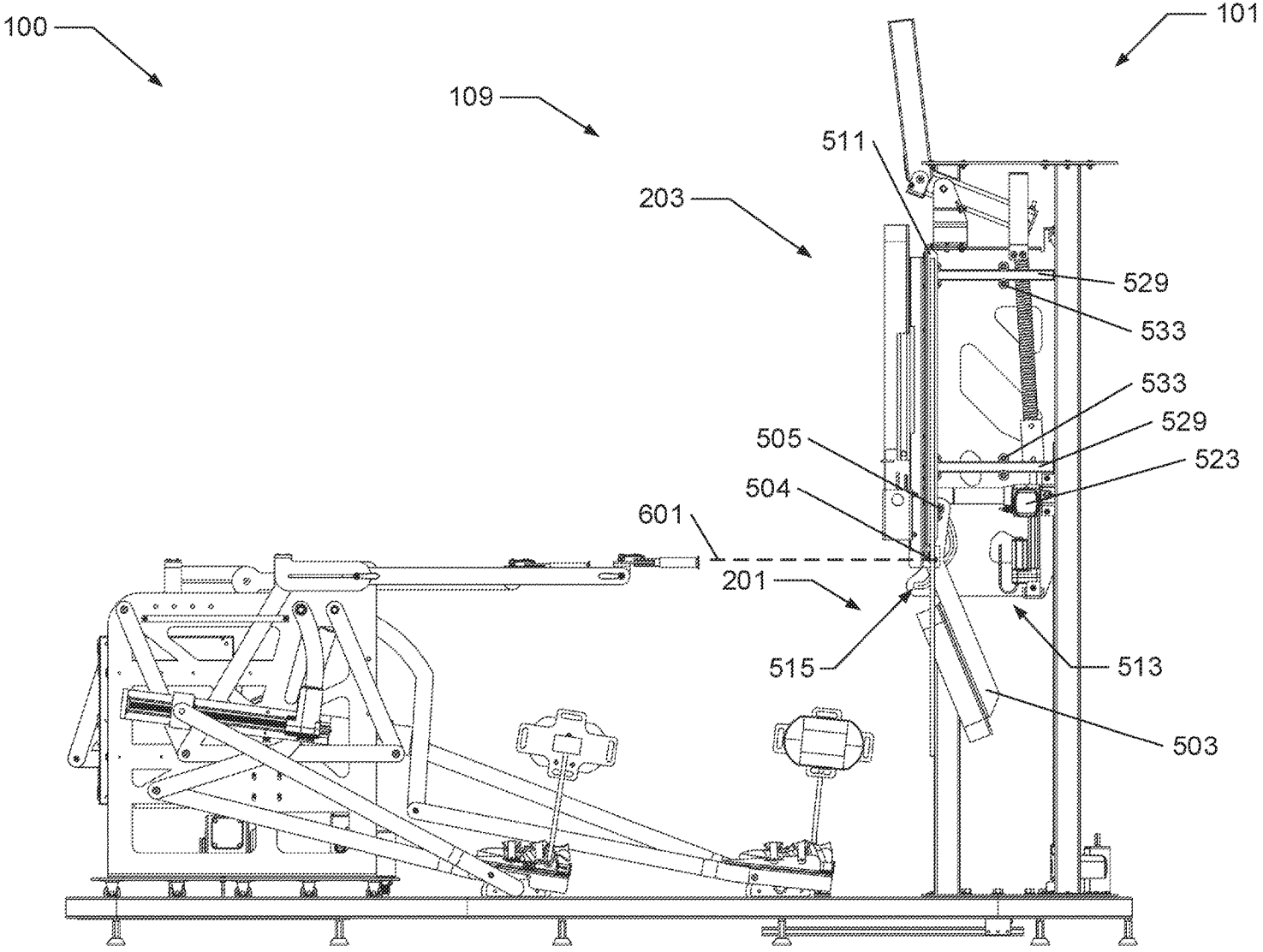
FIG. 8 is a side view of an exemplary rehabilitation device, according to one embodiment of the present disclosure.

FIG. 8 is a side view of an exemplary rehabilitation system 100, which is shown an exemplary standing configuration. In various embodiments, the rehabilitation system 100 includes a tower 101 that includes a seating system 109 arranged in a standing configuration as would be achieved via a sit-stand transition (e.g., following transition from a seated to the standing configuration). In one or more embodiments, the standing configuration includes, but is not limited to: 1) a seat bottom assembly 201 positioned at an angle obtuse to a horizontal axis 601 (for example, positioned an angle about 120 degrees from the axis 601); 2) a seat back assembly 203 fully retracted against the tower 101; 3) one or more actuator control rods 529 fully retracted into the tower 101 from an outwardly extended position; 4) a sit-stand actuator 523 in a fully retracted position within the tower 101; and 5) one or more pivot rollers 505 positioned at a top point of a pivot track 515. In at least one embodiment, in the standing configuration, full retraction of the sit-stand actuator 523 causes full horizontal translation of the seat back assembly 203 against the tower 101. In various embodiments, full horizontal translation of the seat back assembly 203 against the tower 101 generates and maintains a translational force at a pivot mechanism 504 that causes full counterclockwise rotation of the seat bottom assembly 201. In at least one embodiment, the translational force is converted, via one or more pivot rollers 505 and one or more pivot tracks 515, into a counterclockwise rotational movement of the seat bottom assembly 201 about the pivot mechanism 504. In one or more embodiments, the counterclockwise rotational movement about the mechanism 504 proceeds continuously as the seat back assembly 203 horizontally translates. For example, full horizontal translation (e.g., against the tower 101) may cause full counterclockwise rotation (e.g., measuring about 120 degrees) about the pivot mechanism 504.

Figure 9:
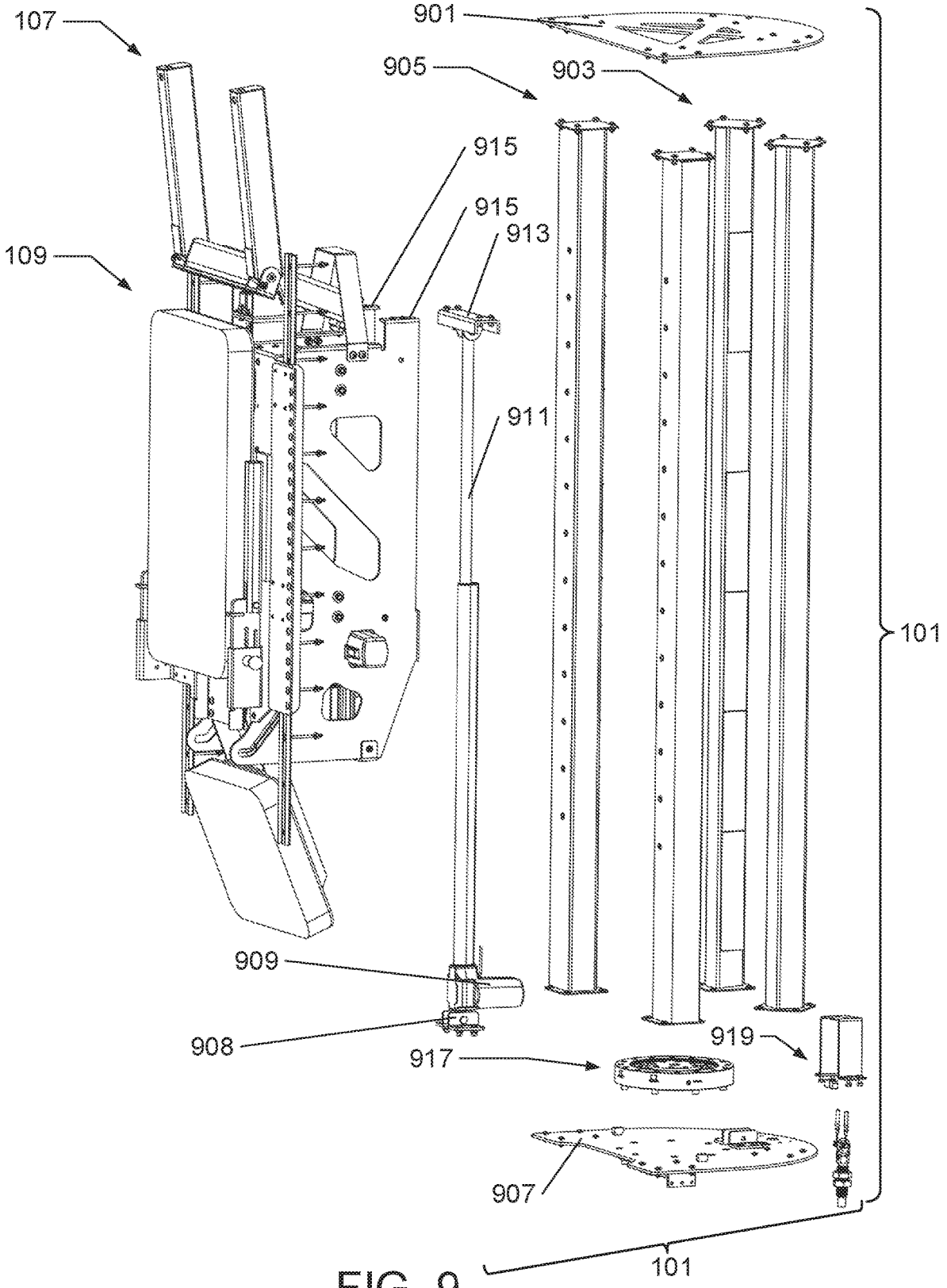
FIG. 9 is an exploded view of an exemplary tower, according to one embodiment of the present disclosure.

FIG. 9 is an exploded view of an exemplary tower 101. In one or more embodiments, the tower 101 includes a top plate 901 and a bottom plate 907. In at least one embodiment, one or more rear columns 903 and one or more front columns 905 may be attached to and positioned between the top plate 901 and the bottom plate 907. In at least one embodiment, a rear column 903 and/or a front column 905 may present a quadrilateral cross-section, a circular cross-section, or one or more other cross-section shapes. In one or more embodiments, the tower 101 may include a seat height linkage 908 attached to the bottom plate 907 and a seat height actuator 909 (e.g., securing the seat height actuator 909 to the bottom plate 907). In at least one embodiment, the seat height actuator 909 includes a height arm 911 that may be secured to a height plate 913. In various embodiments, the height arm 911 may be received beneath and be operatively connected to one or more height plate receipts 915. In one or more embodiments, extension and retraction of the height arm 911 may cause lift and descent of the height plate 913. Because the height plate 913 may be attached to the seating system 109, lift and descent of the height plate 913 may cause corresponding lift and descent of the seating system 109 and a BWS system 107. In one or more embodiments, the seat height actuator may allow the seating system 109 and BWS system 107 to be positioned vertically at a height between about 1-6 feet. For example, via the seat height actuator 909, the seating system 109 and BWS system 107 may be positioned at a height between about 1.0-1.5 feet, between about 1.5-2.0 feet, between about 2.0-2.5 feet, between about 2.5-3.0 feet, between about 3.5-4.0 feet, between about 4.0-4.5 feet, between about 4.5-5.0 feet, between about 5.0-5.5 feet, or between about 5.5-6.0 feet.

For example, a seat height actuator 909 and height arm 911 may be initially configured in a fully retracted position. While in the retracted position, a seating system 109 and BWS system 107 may be positioned at a first height (for example, 16 inches relative to a bottom plate 907). Upon activation and extension of the seat height actuator 909 and the height arm 911, the seating system 109 and BWS system 107 may experience a lifting force at two height plates 909 connected to the height arm 911. The lifting force may elevate the seating system 109 and the BWS system 107 to a second height (for example, 5 feet relative to the bottom plate 907) that is greater than the first height.

As another example, a seat height actuator 909 and height arm 911 may be initially configured in a maximum extended position, thereby causing a connected seating system 109 and BWS system 107 to be positioned at maximum heights. For example, the seating system 109 may be positioned at a maximum height of about 60 inches (e.g., as measured between an underside of the seat bottom brace 503 and a top surface of the bottom plate 907). In the same example, the BWS system 107 may be positioned at a maximum height of about 82 inches (e.g., as measured between an underside of the overhead support 205 and the top surface of the bottom plate 907). Upon activation and retraction of the seat height actuator 909 and the height arm 911, the seating system 109 and BWS system 107 may experience a downward force at two height plates 909 connected to the height arm 911. The downward force may lower the seating system 109 and the BWs system 107 to a second height (e.g., 16 inches relative to the bottom plate 907) that is less than the first height.

In various embodiments, the seat-height actuator 909 and height arm 911 may support a full weight of a seating system 109 and BWS system 107, and may also support a full weight of a subject 115 positioned therein. In at least one embodiment, the seat-height actuator 909 and height arm 911 may support a subject 115 weighing up to about 300 pounds. For example, the seat-height actuator 909 and height arm 919 may support a subjecting 115 weighing between about 0-50 pounds, between about 50-100 pounds, between about 75-200 pounds, between about 200-250 pounds, or between about 250-300 pounds.

In at least one embodiment, the tower 101 may further include, but is not limited to, a rotation system 917. In various embodiments, the rotation system 917 may be attached to an underside surface of the bottom plate 907. In one or more embodiments, the rotation system 917 may include one or more bearing subsystems that permit rotation of the bottom plate 907 about the rotation system 917. In one or more embodiments, because the tower 101 may be attached to the bottom plate 907, and the bottom plate 907 may rotate via the rotation system 917, the tower 101 may be also be rotated via the rotation system 917. For example, a tower 101 may be rotated counterclockwise by about 90 degrees from an initial position. In at least one embodiment, an initial position of the tower 101 may refer to an angular position wherein the tower 101 is at a rotation of 0 degrees with respect to a track 105 (FIG. 1).

In various embodiments, rotation of the tower 101, via the rotation system 917, may be controlled via a lock-pin system 919. In at least one embodiment, a base 105 may include one or more voids for receiving a pin, or the like, that prevents rotation of the tower 101 via the bottom plate 907 and the rotation system 917. For example, a lock-pin system 919 may include a spring-loaded pin mechanism that is automatically engaged when the pin is in alignment with one or more locking voids included in a base plate of a base 105. In the same example, one or more locking voids may be positioned periodically along an arc, thereby providing incremental rotational positions to which the tower 101 may be rotated. The tower 101 may be rotated to any of the incremental positions by withdrawing the spring-loaded pin mechanism (e.g., thereby disengaging the lock-pin system 919) and rotating the tower until the lock-pin system 919 is aligned with a particular locking void. Upon the lock-pin system 919 being aligned with the particular locking void, the spring-loaded pin mechanism may be released and may project downward into the locking void, thereby securing the new rotational orientation of the tower 101.

In one or more embodiments, rotation of the tower 101 may be controlled and/or facilitated electronically. For example, rotation may be controlled via a motor system operative to rotate the tower 101 upon receiving commands or inputs (e.g., from a control panel, via GUI selections, etc.). In various embodiments, a rotation system 907 and/or lock-pin system 919 may include components for engaging and disengaging locks and/or for facilitating rotation, and may include components for receiving inputs that cause engagement/disengagement of locks and/or facilitation of rotation.

In at least one embodiment, a tower 101, and elements included therein, may include one or more materials including, but not limited to: 1) one or more metals (e.g., such as, for example, stainless steel); 2) one or more polymers (e.g., such as, for example, durable polymers capable of withstanding stresses and strains generated during one or more operations described herein); and 3) padding materials (e.g., such as, for example, rubber, soft polymers, and other soft materials).

Figure 10:
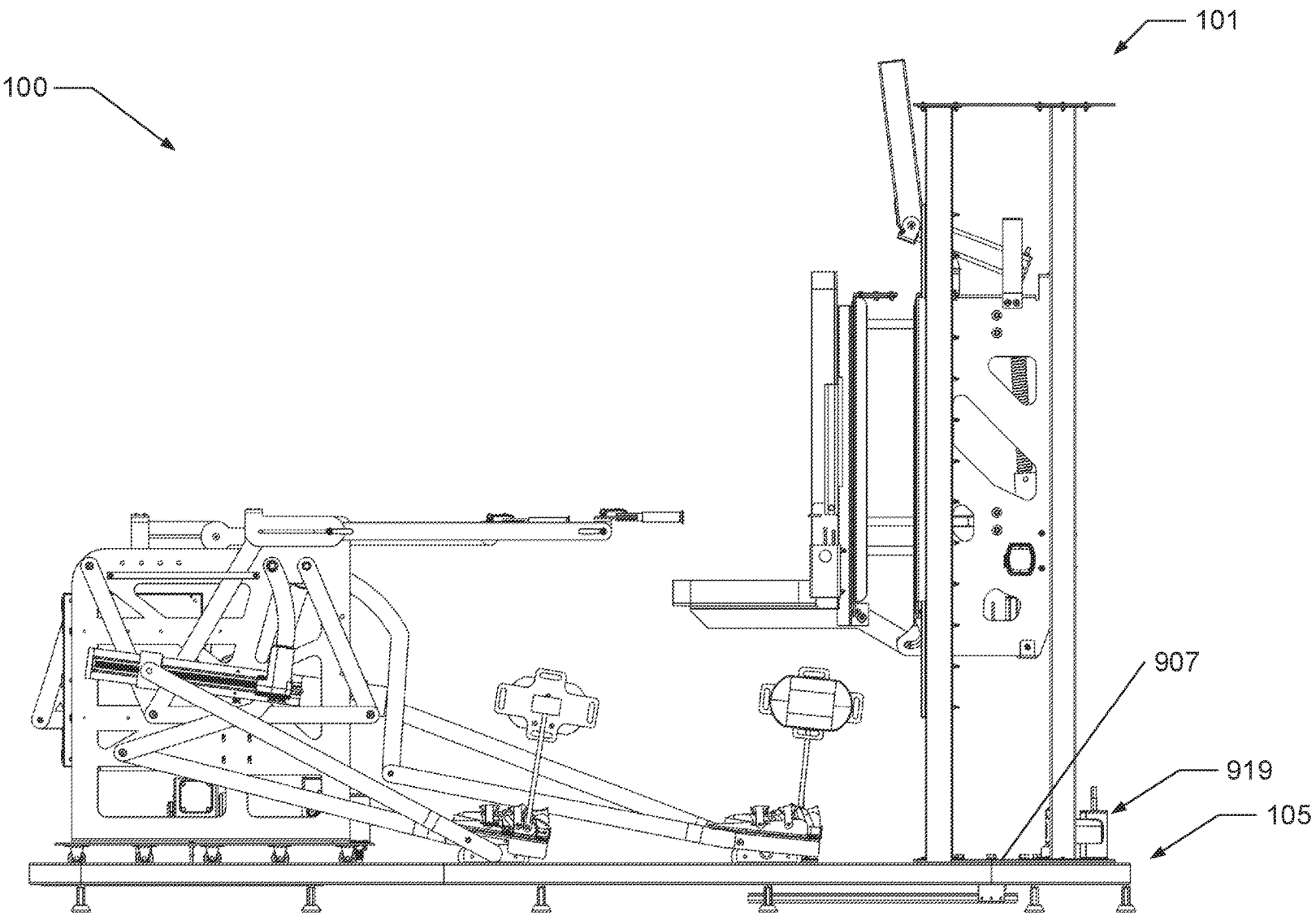
FIG. 10 is a side view of an exemplary rehabilitation device, according to one embodiment of the present disclosure.

FIG. 10 is a side view of an exemplary rehabilitation system 100. In various embodiments, in FIG. 10, the rehabilitation system 100 is shown in a configuration prior to rotation of a tower 101. In one or more embodiments, the tower 101 may be attached atop a bottom plate 907, and the bottom plate 907 may be attached to a rotation system 917. In at least one embodiment, the rotation system 917 may be positioned between the bottom plate 907 and a base 105. In various embodiments, the tower 101 may be shown, in FIG. 10, in an initial angular position, being positioned at 0 degrees with respect to the base 105. In at least one embodiment, rotation of the tower 101 may be controlled via a lock-pin system 919.

Figure 11:
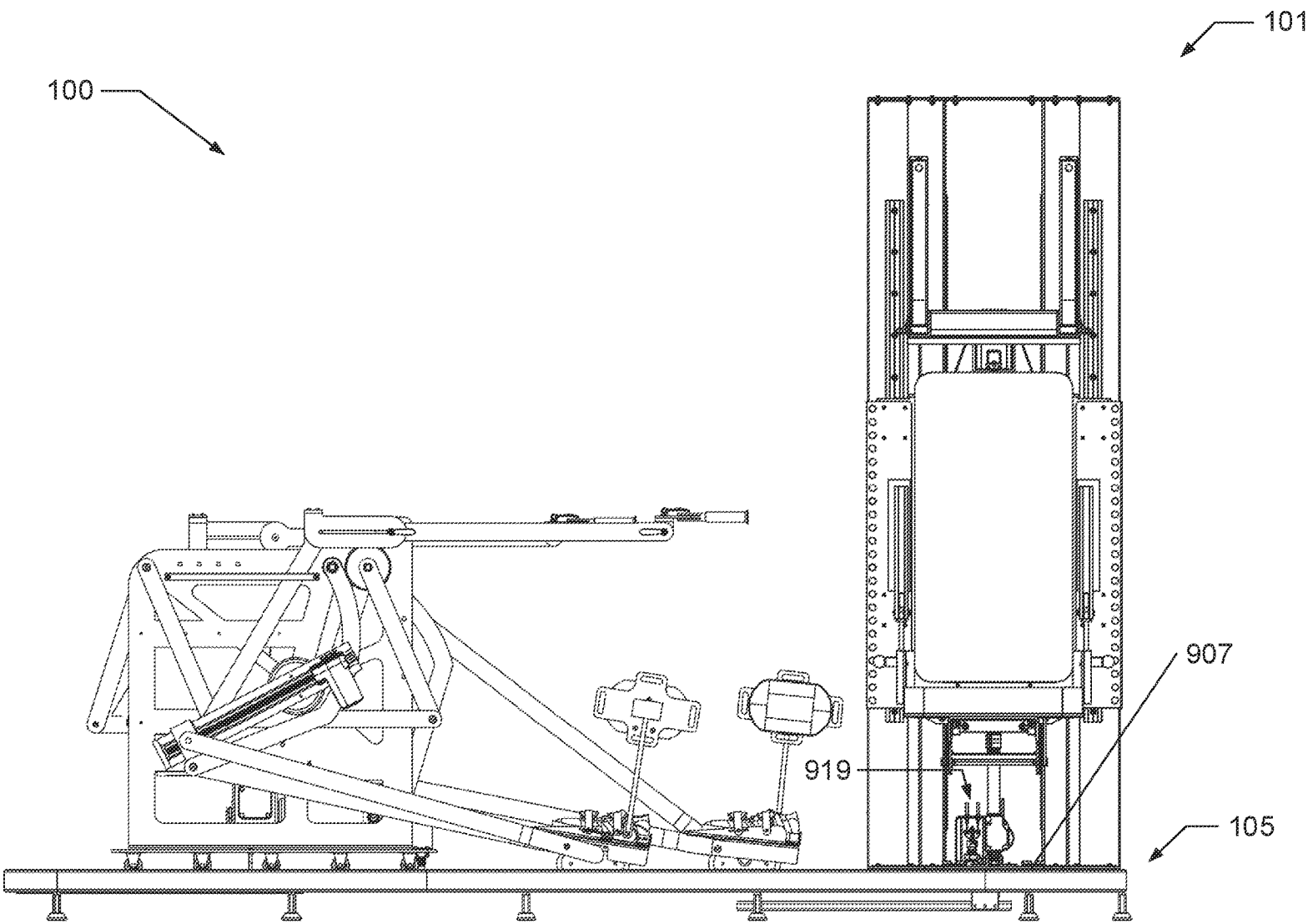
FIG. 11 is a side view of an exemplary rehabilitation device, according to one embodiment of the present disclosure.

FIG. 11 is a side view of an exemplary rehabilitation system 100. For illustrative and descriptive purposes, in FIG. 11, one or more portions of the rehabilitation system 100 may be excluded to allow for presentation and discussion of various internal system elements provided herein. In various embodiments, in FIG. 11, the rehabilitation system 100 is shown in a configuration following rotation of a tower 101. In one or more embodiments, the tower 101 may be attached atop a bottom plate 907, and the bottom plate 907 may be attached to a rotation system 917. In at least one embodiment, the rotation system 917 may be positioned between the bottom plate 907 and a base 105. In various embodiments, the tower 101 may be shown, in FIG. 11, in a rotated angular position, being positioned at a rotation of about 90 degrees with respect to the base 105. In at least one embodiment, rotation of the tower 101 may be controlled via a lock-pin system 919 that includes a spring-loaded pin mechanism. In one or more embodiments, the rotated angular position of the tower 101 may be secured via receipt of a spring-loaded pin within a locking void included in a base plate of the base.

For example, to rotate the tower 101, a lock pin mechanism may be withdrawn from a first locking void. Upon withdrawal of the lock pin mechanism, the lock-pin system 919 may be disengaged, and the tower 101 may rotate freely via a rotation system 917. After rotating the tower 101 (e.g., by about 90 degrees in a counterclockwise direction), the lock pin mechanism may automatically deploy into a second locking void positioned along an arc about 90 degrees counterclockwise from the first locking void. Deployment of the lock pin mechanism may engage the lock-pin system 919 and secure the new rotated angular position of the tower 101.

Figure 12:
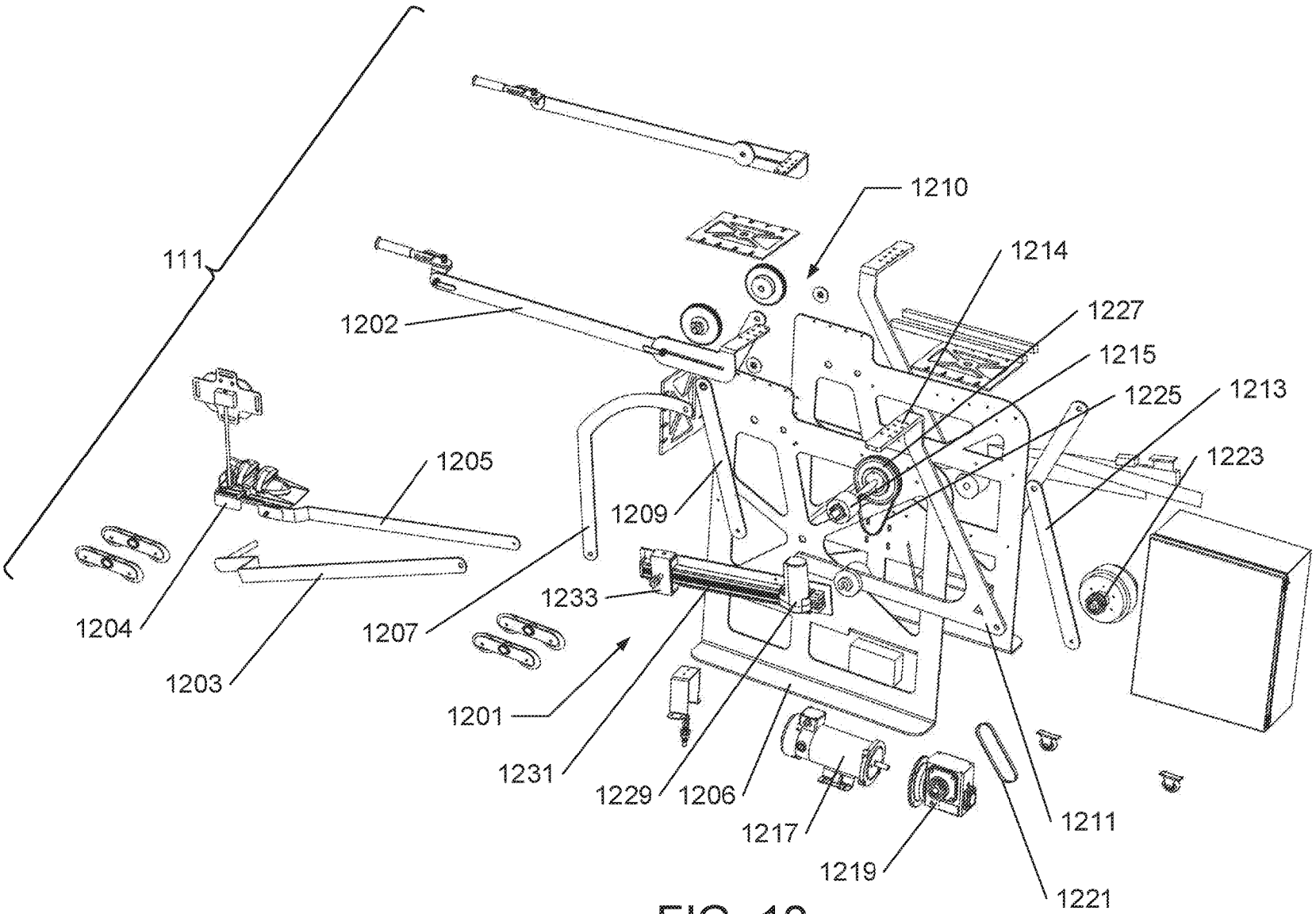
FIG. 12 is an exploded view of an exemplary sled, according to one embodiment of the present disclosure.

FIG. 12 is an exploded view of an exemplary sled 103, according to one embodiment of the present disclosure. In one or more embodiments, the sled 103 may include a linkage system 111. In at least one embodiment, the linkage system 111 may provide a walking motion that synchronizes a striding leg motion with a translating hand motion, thereby providing a substantially physiologically accurate gait cycle. In various embodiments, the linkage system 111 may include, but is not limited to, a driving link 1201, an outer footplate link 1203, an inner footplate link 1205, a curved link 1207, a first connecting link 1209, a handle link 1211, and a second connecting link 1213. In at least one embodiment, the linkage system 111 is operatively connected to and synchronously coordinates movement of a footplate 1204 and a handle 1202. In one or more embodiments, a linkage system 111, and elements included therein, may include materials including, but not limited to: 1) metal (e.g., such as, for example, stainless steel); and 2) plastics (e.g., polymers suitable for mechanical operations and capable of withstanding stresses and strains generated therefrom). In one or more embodiments, one or more links described herein may present a substantially quadrilateral cross-section (e.g., such as a rectangular cross-section), or may present circular cross-sections, triangular cross-sections, or one or more other cross-section shapes.

In at least one embodiment, the driving link 1201 may be connected to a sled plate 1206 in a manner such that the driving link 1201 may rotate about the connection point. For example, the driving link 1201 may be connected to a driving link mechanism 1215 that secures the driving link 1201 within the sled plate 1206, but also allows for rotation of the driving link 1201. In one or more embodiments, the footplate 1204 may be connected to the outer footplate link 1203 and the inner footplate link 1205. In at least one embodiment, a driving linkage 1233 may operatively connect the outer footplate link 1203 to the driving link 1201 in a manner such that rotation of the driving link 1201 causes retraction and extension of the outer footplate link 1203 (e.g., with respect to the footplate 1204).

In an exemplary scenario, the driving link 1201 may rotate clockwise between 0-360 degrees about a central axis. At 0 degrees, an outer footplate link 1203 (connected to the driving link 1201 via a driving linkage 1233) may be positioned at initial stride position, a footplate 1204 connected to the outer footplate link 1203 may be in a mid-stance phase, and a handle 1202 may be positioned at a mid-stance phase. As the driving link 1201 rotates from 0 degrees, a driving linkage 1233 may draw the outer footplate link 1203 forwards, translating the outer footplate link 1203 towards the sled 103. The translation of the outer link 1203 may cause translation of the footplate 1204, drawing the footplate 1204 through a terminal stance phase and a toe-off phase. The translation of the outer link 1205, may cause the handle 1202 to partially trace an arc, thereby drawing the handle 1202 through a terminal stance phase and a toe-off phase. Once the driving link 1201 is rotated about 180 degrees, the outer footplate link 1203 may be at a maximum forward translation point. As the outer footplate link 1203 approaches the maximum forward translation point, the connected footplate 1204 and the handle 1202 (continuing to trace the arc) may experience an initial contact phase and, upon reaching 180 degrees of rotation, a loading response phase. As the driving link 1201 continues to rotate, the driving linkage 1233 may cause the outer footplate link 1203 to translate backwards, away from the sled 103, and the footplate 1204 and the handle 1202 (e.g., now tracing the arc in an opposite direction) may be drawn into a subsequent mid-stance phase. Accordingly, in one or more embodiments, a complete rotation of the driving link 1201 may correspond to a complete gait cycle.

In various embodiments, the inner footplate link 1205 may be operatively connected to the curved link 1207, and the curved link 1207 may be operatively connected to a gear system 1210, thereby securing the curved link 1207 to the sled plate 1206, but still allowing for rotations about the connection. In one or more embodiments, the curved link 1207 may be generally sickle-shaped. For example, the curved link 1207 may include a substantially straight first section and a substantially curved second section. A terminal point of the curved second section may be angled between about 15-85 degrees from a terminal point of the straight first section. In various embodiments, a curved link 1207 may demonstrate a radius of curvature measuring between about 15-20 inches. For example, a curved link 1207 may demonstrate a radius of curvature measuring about 16 inches. In at least one embodiment, curvature of the curved link 1207 may reduce a spatial profile of the curved link 1207, and may allow for an increased density of components within the linkage system 111, thereby advantageously minimizing size of the sled 103.

In various embodiments, as the driving link 1201 rotates and the footplate 1204 and outer footplate link 1203 translate, the inner footplate link 1205 may also translate. In at least one embodiment, translation of the inner footplate link 1205 may cause a partial rotation of the curved link 1207 about the connection between the curved link 1207 and the gear system 1210.

Referring to the above exemplary scenario, as the driving link 1201 rotates from about 0 to 180 degrees, the inner footplate link 1205 may translate forward from an initial translation position and cause a partial rotation (e.g., in a counterclockwise direction) of the curved link 1207 from an initial rotational position. Upon the driving link 1201 reaching about 180 degrees of rotation, the inner footplate link 1205 may be at a maximum forward translation point and the curved link 1207 may be at a maximum clockwise rotation point. As the driving link 1201 proceeds from about 180 to 360 degrees of rotation, the inner footplate link 1205 may be translated backwards, away from the sled 1203, and the curved link 1207 may rotate clockwise. Upon the driving link 1201 reaching about 360 degrees of rotation, the inner footplate link 1205 may translate back to the initial translation position, and the curved link 1207 may rotate clockwise back to the initial rotational position. Accordingly, in various embodiments, the curved link 1207 may rotate in a periodic motion. For example, during a full rotation of the driving link 1201, the curved link 1207 may rotate forward from an initial position by about 45-135 degrees (e.g., during a first half of the full rotation) and return to the initial position (e.g., during a second half of the full rotation). In one or more embodiments, periodic rotation of the curved link 1207 may synchronize movement of the footplate 1204 with movement of the handle 1202.

In at least one embodiment, the gear system 1210 may be operatively connected to the first connecting link 1209. In various embodiments, the first connecting link 1209 and the second connecting link 1213 may be connected to the sled plate 1206 in a manner that allows for rotation about the connection. In one or more embodiments, translation of the outer footplate link 1203 may cause a corresponding translation of the inner footplate link 1205. In at least one embodiment, translation of the inner footplate link 1205 may cause rotation of the curved link 1207, and, transitively, rotation of the gear system 1210. In various embodiments, rotation of the gear system 1210 may cause rotation of the first connecting link 1209 (e.g., in a direction opposite the rotation of the curved link 1207). For example, as the curved link 1207 rotates clockwise, the gear system 1210 may cause the first connecting link 1209 to rotate counterclockwise, and as the curved link 1207 transitions to a counterclockwise rotation, the gear system 1210 may cause the first connecting link 1209 to rotate clockwise.

In at least one embodiment, the first connecting link 1209 may be operatively connected to the handle link 1211, and rotation of the first connecting link 1209 may cause translation of the handle link 1211. In one or more embodiments, the handle link 1211 may be operatively connected the second connecting link 1213. In at least one embodiment, the handle link 1211 may be connected to the first connecting link 1209 and the second connecting link 1213 in a manner that allows for rotation about one or more connection points.

In various embodiments, the handle link 1211 may be connected to a handle 1202 via a handle linkage 1214. In one or more embodiments, the handle link 1211 may include a generally "V" shape that includes a first section and a second section that are oriented at an acute angle. For example, an angle between the first section and the second section may measure about 60 degrees. In at least one embodiment, the first section may be oriented parallel to a track 105 (FIG. 1). In at least one embodiment, the first connecting link 1209 may be connected at the first section, and the second connecting link 1213 and the handle 1202 may be connected at the second section. In one or more embodiments, the acute angle of the handle link 1211 may advantageously increase component density of the sled 103, thereby advantageously reducing a spatial profile of the sled 103.

In various embodiments, the first connecting link 1209 and the second connecting link 1213 may be positioned, on the sled plate 1206, substantially parallel to and level with each other. In various embodiments, the above described positioning and the rotating connections between the handle link 1211 and the first connecting link 1209 and second connecting link 1213 may allow the handle link 1211 to translate in a substantially arcuate manner as the first connecting link 1209 and second connecting link 1213 rotate about their connections to the sled plate 1206. In at least one embodiment, the first connecting link 1209 may be operative to rotate about a medial point between the first connecting link 1209 and a sled plate 1206, which may engage a gear system 1210 and/or otherwise cause rotation of a handle link 1211. In one or more embodiments, the second connecting link 1213 may be operative to rotate about fixed rear point between the first connecting link 1213 and a sled plate 1206. In at least one embodiment, a curved link 1207 may be operative to rotate about a forward fixed point between the curved link 1207 and/or a sled plate 1206 or a gear system 1210. In one or more embodiments, a curved link 1207 may be operatively connected to a sled plate 1206 at the forward fixed point in a manner that allows rotation of the curved link 1207 about the forward fixed point and rotate a gear system 1210.

For example, rotation at the gear system 1210 may cause the first connecting link 1209 to rotate. The rotation of the first connecting link 1209 may generate a rotational force at the connection between the connecting link 1209 and the handle link 1211. The connection between the handle link 1211 and the second connecting link 1213 may convert the rotational force into a substantially arcuate translation of the handle link 1211. As the first connecting link 1209 and second connecting link 1213 rotate in a parallel and counterclockwise manner, the handle link 1211 may be translated towards the footplate 1204. In various embodiments, translation of the handle link 1211 may cause reverse translation of the handle 1202 in an identical direction. In various embodiments, because rotation of the first connecting link 1209 may be periodic and occur in a clockwise and counterclockwise manner, the handle link 1211 may also translate in a periodic fashion, thereby causing periodic translation of the handle 1202 that mimics translation of an upper extremity throughout a gait cycle.

In at least one embodiment, rotation of the driving link 1201 may be caused via a motor unit 1217. In one or more embodiments, the motor unit 1217 may be operatively connected to a transmission 1219. The transmission 1219 may include an output connected to a first belt 1221 operatively connected to a clutch 1223.

In various embodiments, the clutch 1223 may be a magnetic particle clutch that uses a magnetically susceptible material to mechanically link an input and an input. In various embodiments, the clutch 1223 can receive an input rotational force at an input and transfer the input rotational force to an output rotational force received at an output. For example, a magnetic particle clutch 1223 may transmit torque mechanically via a powder of iron fillings disposed therein. Torque may be controlled by applying a magnetic field to the powder, which may cause formations of magnetically linked iron filing chains that decrease slip between an input and output of the clutch 1223. Accordingly, the clutch 1223 may be controlled via manipulation of a supply voltage or supply current that is used to generate the magnetic field. For example, the portion of magnetized particles may be configured via application of a magnetic field generated by a particular voltage, and the configuration of the magnetized particles may generate greater resistance to efficiency of force transmission as voltage is increased (e.g., and the magnetic field strengthens).

In at least one embodiment, the linkage system 111 may operate in a powered state in which the motor unit 1217 provides partial locomotive assistance via the clutch 1223 and a system of belts and linkages described herein. In another embodiment, the linkage system 111 may operate in a non-powered state in which the motor unit 1217 does not provide locomotive assistance. In various embodiments, locomotive assistance provided by the motor unit 1217 may be configured via one or more controllers that control a power the motor unit 1217 and/or control the clutch 1223. In at least one embodiment, the clutch 1223 may be configured to generate resistance to locomotive operation of the linkage system 111. For example, a magnetic particle clutch 1223 may be engaged (without engaging a motor unit 1217) and magnetized particles therein may generate resistance that opposes rotation of a driving link 1201 connected to an output of the clutch 1223 (as described herein). Because the strength of the clutch 1223 may be configured via control of electricity supplied thereto, the resistance supplied by the clutch 1223 may be metered via one or more electronic controllers.

In at least one embodiment, an output of the clutch 1223 may be operatively connected to a second belt 1225, and the second belt 1225 may be operatively connected to a driving link gear 1227. In one or more embodiments, the driving link gear 1227 may be operatively connected to a driving link mechanism 1215 that is operatively connected to and causes rotation of the driving link 1201. Accordingly, rotation at the motor unit 1217 may cause rotation of the driving link 1201, and rotation of the driving link 1201 may cause operation of the linkage system 111.

For example, a motor unit 1217 may generate a rotational force. A transmission 1219 may receive and transmit the rotational force, thereby rotating a first belt 1221. Rotation of the first belt 1221 may generate a rotational force at an input of a magnetic particle clutch 1223. The magnetic particle clutch 1223 may translate the rotational force to a second rotational force received at and causing rotation of an output (efficiency of rotational translation being determined by a strength of a magnetic field experienced by a portion of magnetized particles within the clutch 1223). Rotation at the output of the magnetic particle clutch 1223 may cause rotation of a second belt 1225. Rotation of the second belt 1225 may cause rotation of a driving link gear 1227 and a driving link mechanism 1215. Rotation of the driving link mechanism 1215 may cause rotation of the driving link 1215.

In the same example, rotation of the driving link mechanism 1215 (e.g., in a counter-clockwise direction) may cause translation of an outer footplate link 1203 towards a distal end of the sled 103. Translation of the outer footplate link 1203 can cause corresponding translations of a footplate 1204 and an inner footplate link 1205 towards the distal end of the sled 103. Translation of the inner footplate link 1205 may cause rotation of a curved link 1207 (e.g., in a clockwise direction), and rotation of the curved link 1207 may cause rotation of a first connecting gear (e.g., in a clockwise direction) and rotation of a second connecting gear (e.g., in a counter-clockwise direction). Rotation of the second connecting gear may cause rotation of a first connecting link 1209 (e.g., in a counter-clockwise direction), and rotation of the first connecting link 1209 may cause translation of a handle link 1211 towards a proximal end of the sled 103 (e.g., towards a subject 115). Because the handle link 1211 may be attached, via a handle linkage 1214, to a handle 1202, translation of the handle link 1211 may cause a corresponding translation of the handle 1202 (e.g., towards the proximal end of the sled 103). Translation of the handle link 1211 may be partially supported and facilitated via a second connecting link 1213 that rotates as a result of the handle link 1211 translation.

In at least one embodiment, the above described scenario may occur as a result of a partial rotation of the driving link 1201. In various embodiments, as the driving link 1201 proceeds through 360 degrees of rotation, the linkage system 111 may complete one full gait cycle. Accordingly, a partial rotation (e.g., such as 180 degrees) of the driving link 1201 may correspond to and cause a gait motion that is a subset of the gait cycle. In various embodiments, gait motions may include, but are not limited to, an advancing movement and a retreating movement. In at least one embodiment, an advancing movement may correspond to a rotation of the driving link 1201 measuring about 180 degrees, and a retreating movement may correspond to an additional rotation measuring about 180 degrees.

In at least one embodiment, the driving link 1201 may rotate a driving linkage 1233 about a particular radius of rotation, and the particular radius of rotation may determine a stride length. As described herein, a stride length refers to a distance traveled by a footplate 1204 after an advancing movement and prior to initialization of a retreating movement. In one or more embodiments, the radius of rotation (e.g., and, thus, stride length) may be increased and/or decreased via a stride length actuator 1229 that translates the driving linkage 1233 along a stride length track 1231. For example, retraction of the stride length actuator 1229 may cause a connected driving linkage 1229 to translate towards a center of rotation (e.g., towards the driving link mechanism 1215). Because the driving linkage 1229 has moved closer to the center of rotation, the radius of rotation (of a connected outer footplate link 1203) may correspondingly decrease and the stride length provided via the linkage system 111 may decrease. In at least one embodiment, the stride length may decrease, because an outer footplate link 1203, footplate 1204, and inner footplate link 1205 may translate by a lesser magnitude due to the decreased radius of rotation. In at least one embodiment, a ratio between radius of rotation of an outer footplate link 1203 and translation of a footplate 1204 may measure about 1 inch of rotation per 1.96 inches of translation. In other words, a ratio between radius of rotation and stride length may measure about 1:1.96. For example, an outer footplate link 1203 may demonstrate a radius of rotation of about 18.0 inches. Accordingly, a connected footplate 1204 may demonstrate a stride length of about 35.28 inches.

In one or more embodiments, a sled 103 may include two linkage systems 111 oriented parallel to each other, and each linkage system 111 may be attached to a sled plate 106. In various embodiments, a set of components may be disposed between the sled plates 106 and may be connected to both linkage systems 111. In at least one of embodiments, the set of components may be oriented outside of a sled plate 106. For example, the set of components may be oriented proximate to a sled plate 106, on an exterior side thereof. In one or more embodiments, the set of components may include, but is not limited to, a motor unit 1217, a transmission 1219, gear system 1210, first belt 1221, second belt 1225, and a driving link gear 1227. In at least one embodiment, the two linkage systems 111 may be rotationally offset from each other in a manner such that a movement of a handle 1202 and a footplate 1204 of a first linkage system 111 may be matched by a reciprocal movement of a handle 1202 and a footplate 1204 of a second linkage system 111. For example, a forward translation of a first handle 1202 and first footplate 1204 may be simultaneously accompanies by a reverse translation of a second handle 1202 and second footplate 1204. In various embodiments, offset and reciprocal movement of the first and second linkage systems 111 may provide a full bipedal gait cycle.

Figure 13:
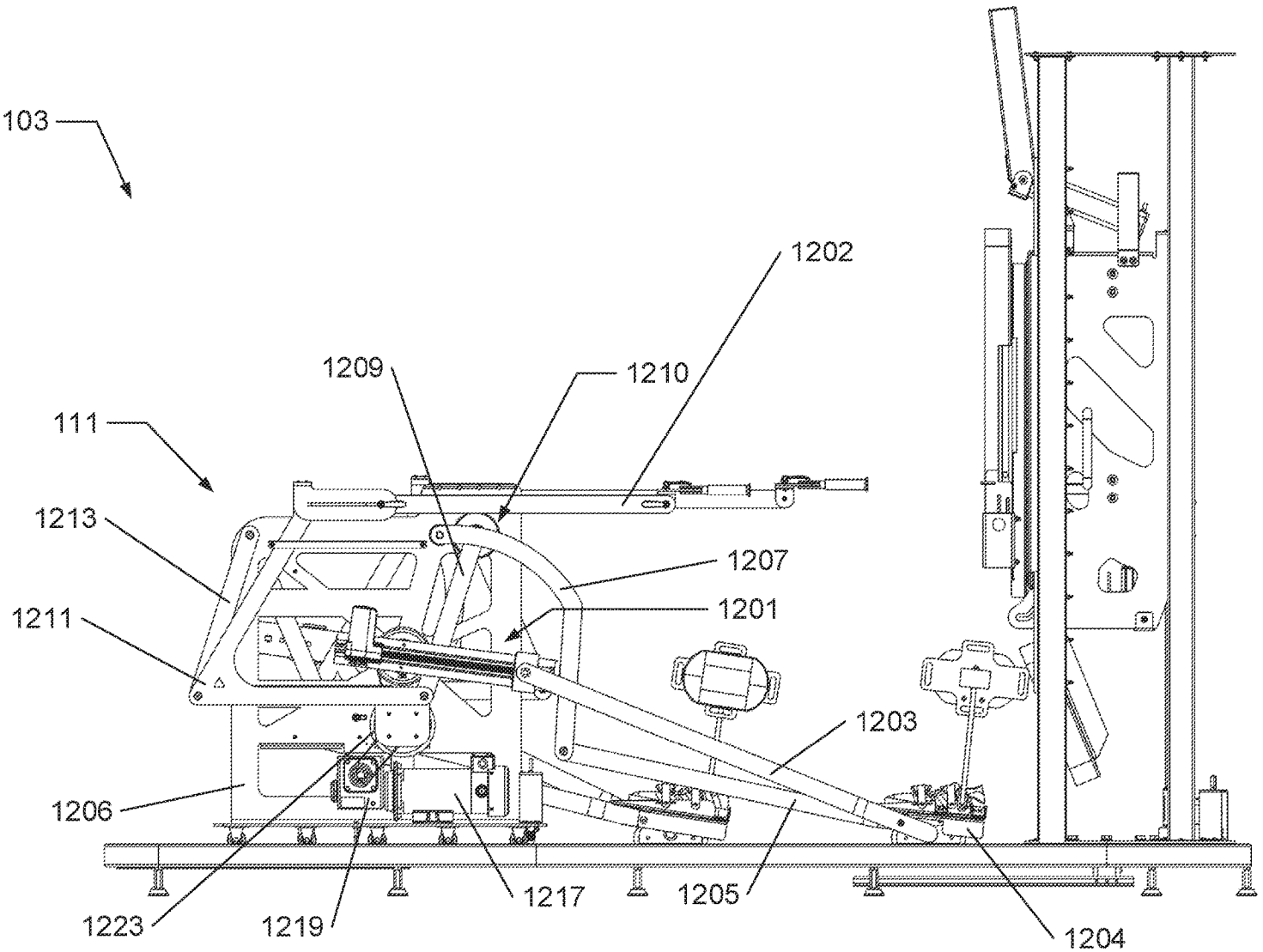
FIG. 13 is a side view of an exemplary rehabilitation device, according to one embodiment of the present disclosure.

FIG. 13 is a side view of an exemplary sled 103. For illustrative and descriptive purposes, in FIG. 13, one or more portions of the sled 103 may be excluded to allow for presentation and discussion of various internal system elements provided herein. In at least one embodiment, the exemplary sled 103 may include two linkage systems 111. In describing FIGS. 13-15, for illustrative and descriptive purposes, reference will be made to a single linkage system 111; however, it understood that an exemplary sled 103 may include an additional linkage system 111 in which locomotive operation therein occurs in a reciprocal manner to locomotive operations of the single linkage system 111 described herein.

In various embodiments the linkage system 111 may include a driving link 1201 connected to an outer footplate link 1203. In at least one embodiment, the outer footplate link 1203 may be connected to a footplate 1204 and an inner footplate link 1205. In one or more embodiments, the inner footplate link 1205 may be connected to a curved link 1207, and the curved link 1207 may be connected to a gear system 1210. In various embodiments, the gear system 1210 may be connected to a first connecting link 1209 connected to a handle link 1211. In at least one embodiment, the handle link 1211 may be connected to a second connecting link 1213, and may also be connected to a handle 1202.

In an exemplary scenario, as shown in FIG. 13, the linkage system 111 may be oriented at an initial position in which the driving link 1201 is oriented at a first angular position (e.g., 0 degrees of rotation). The footplate 1204, outer footplate link 1203, and inner footplate link 1205 may be located at a footplate maximum reverse translation point, and a curved link 1207 may be located at a curved link maximum counterclockwise rotation point. The first connecting link 1209 and second connecting link 1213 may be located at a connecting link maximum clockwise rotation point. The handle link 1211 may be located at a handle link maximum translation point, and the handle 1202 may be located at a handle maximum reverse translation point. In the exemplary scenario, FIG. 13 may show the handle 1202 and footplate 1204 positioned at a loading response and/or mid-stance phase (as described herein).

Figure 14:
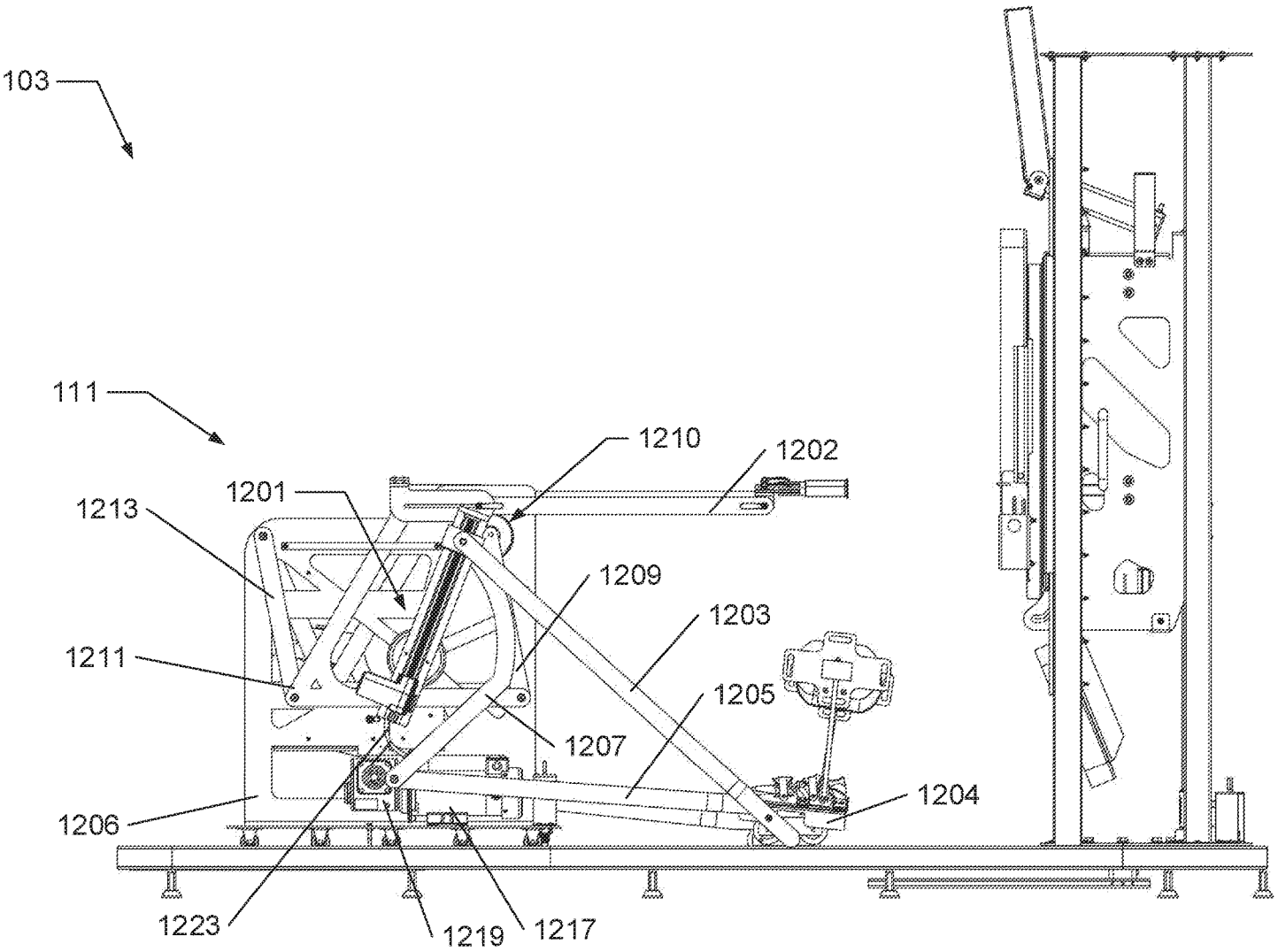
FIG. 14 is a side view of an exemplary rehabilitation device, according to one embodiment of the present disclosure.

FIG. 14 is a side view of an exemplary sled 103 that includes a linkage system 111. For illustrative and descriptive purposes, in FIG. 14, one or more portions of the sled 103 may be excluded to allow for presentation and discussion of various internal system elements provided herein. In at least one embodiment, FIG. 14 may show the exemplary sled 103 and linkage system 111 of FIG. 13, oriented at a subsequent point in a gait cycle shown in FIGS. 13-15. In various embodiments the linkage system 111 may include a driving link 1201 connected to an outer footplate link 1203. In at least one embodiment, the outer footplate link 1203 may be connected to a footplate 1204 and an inner footplate link 1205. In one or more embodiments, the inner footplate link 1205 may be connected to a curved link 1207, and the curved link 1207 may be connected to a gear system 1210. In various embodiments, the gear system 1210 may be connected to a first connecting link 1209 connected to a handle link 1211. In at least one embodiment, the handle link 1211 may be connected to a second connecting link 1213, and may also be connected to a handle 1202.

In an exemplary scenario, as shown in FIG. 14, the linkage system 111 may be oriented at a second angular position in which the driving link 1201 is rotated counterclockwise (e.g., by about 90 degrees) from the initial position shown in FIG. 13. The footplate 1204, outer footplate link 1203, and inner footplate link 1205 may be translated forward from the footplate maximum reverse translation point, and the curved link 1207 may be rotated clockwise from the curved link maximum counterclockwise rotation point. The first connecting link 1209 and second connecting link 1213 may be rotated counterclockwise from the connecting link maximum clockwise rotation point. The handle link 1211 may be translated backwards, in an arcuate manner, from the handle link maximum translation point, and the handle 1202 may be translated backwards, in an arcuate manner, from the handle maximum reverse translation point. In the exemplary scenario, FIG. 14 may show the handle 1202 and footplate 1204 positioned at a swing phase (as described herein).

Figure 15:
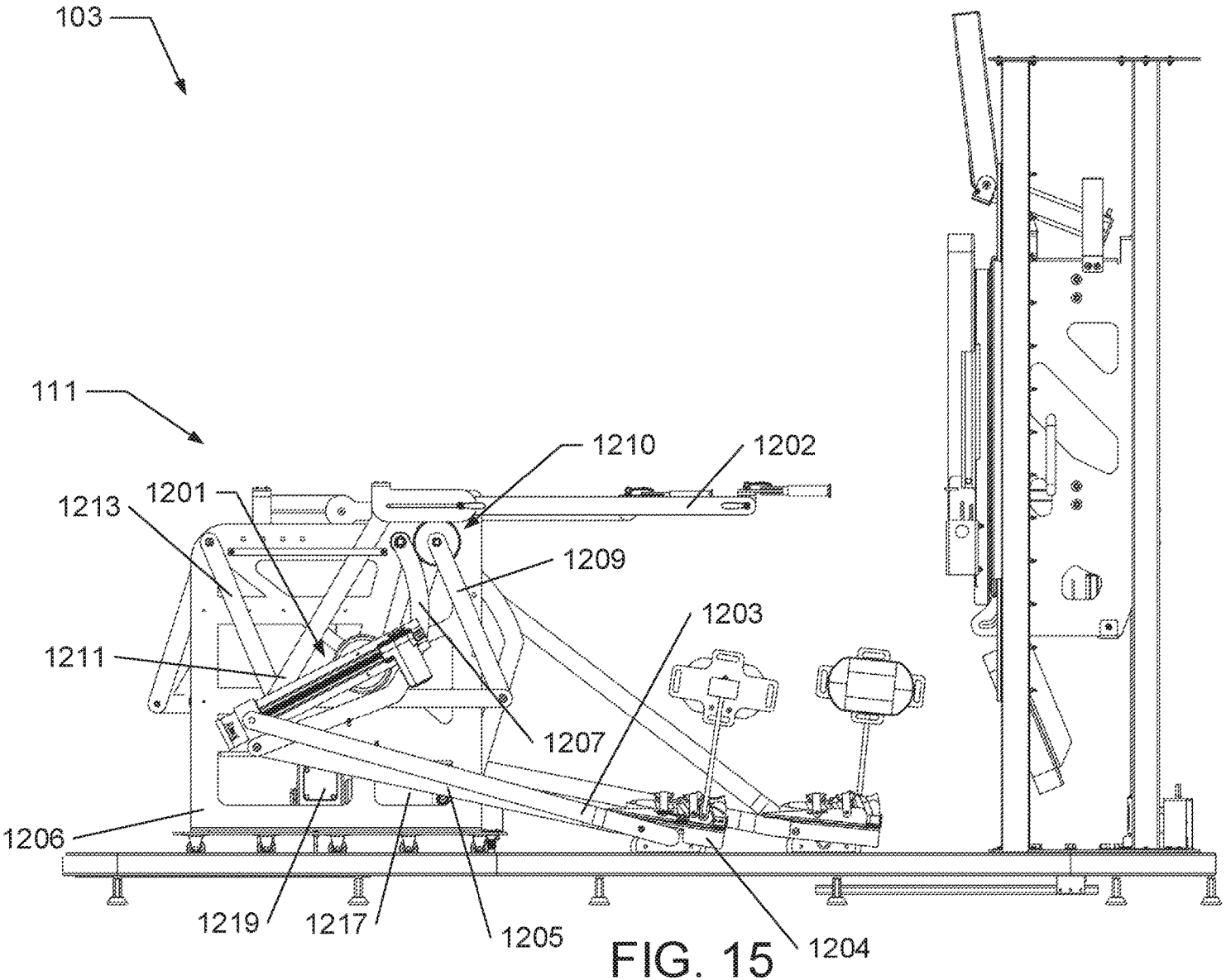
FIG. 15 is a side view of an exemplary rehabilitation device, according to one embodiment of the present disclosure.

FIG. 15 is a side view of an exemplary sled 103 that includes a linkage system 111. For illustrative and descriptive purposes, in FIG. 15, one or more portions of the sled 103 may be excluded to allow for presentation and discussion of various internal system elements provided herein. In at least one embodiment, FIG. 15 may show the exemplary sled 103 and linkage system 111 of FIG. 14, oriented at a subsequent point in a gait cycle shown in FIGS. 13-15. In various embodiments, the linkage system 111 may include a driving link 1201 connected to an outer footplate link 1203. In at least one embodiment, the outer footplate link 1203 may be connected to a footplate 1204 and an inner footplate link 1205. In one or more embodiments, the inner footplate link 1205 may be connected to a curved link 1207, and the curved link 1207 may be connected to a gear system 1210. In various embodiments, the gear system 1210 may be connected to a first connecting link 1209 connected to a handle link 1211. In at least one embodiment, the handle link 1211 may be connected to a second connecting link 1213, and may also be connected to a handle 1202.

In an exemplary scenario, as shown in FIG. 15, the linkage system 111 may be oriented at a third angular position in which the driving link 1201 is rotated counterclockwise (e.g., by about 90 degrees) from the second angular position shown in FIG. 14. The footplate 1204, outer footplate link 1203, and inner footplate link 1205 may have reached a footplate maximum translation point, and may be subsequently reverse-translated back towards the footplate maximum reverse translation point. The curved link 1207 may have reached a curved link maximum clockwise rotation point, and may be subsequently rotated counterclockwise back towards the curved link maximum counterclockwise rotation point. The first connecting link 1209 and second connecting link 1213 may have reached a connecting link maximum clockwise rotation point, and may be subsequently rotated counterclockwise back towards the connecting link maximum counterclockwise rotation point. The handle link 1211 may be have reached a handle link maximum reverse translation point (e.g., an end of a traced arc), and may be subsequently translated forwards, in an arcuate manner) towards the handle link maximum translation point (e.g., towards an opposite end of a traced arc). The handle 1202 may have reached a handle maximum translation point, and may be subsequently reverse-translated back towards the handle maximum reverse translation point. In the exemplary scenario, FIG. 15 may show the handle 1202 and footplate 1204 positioned after an initial contact phase and at a loading response phase (as described herein).

Figure 16:
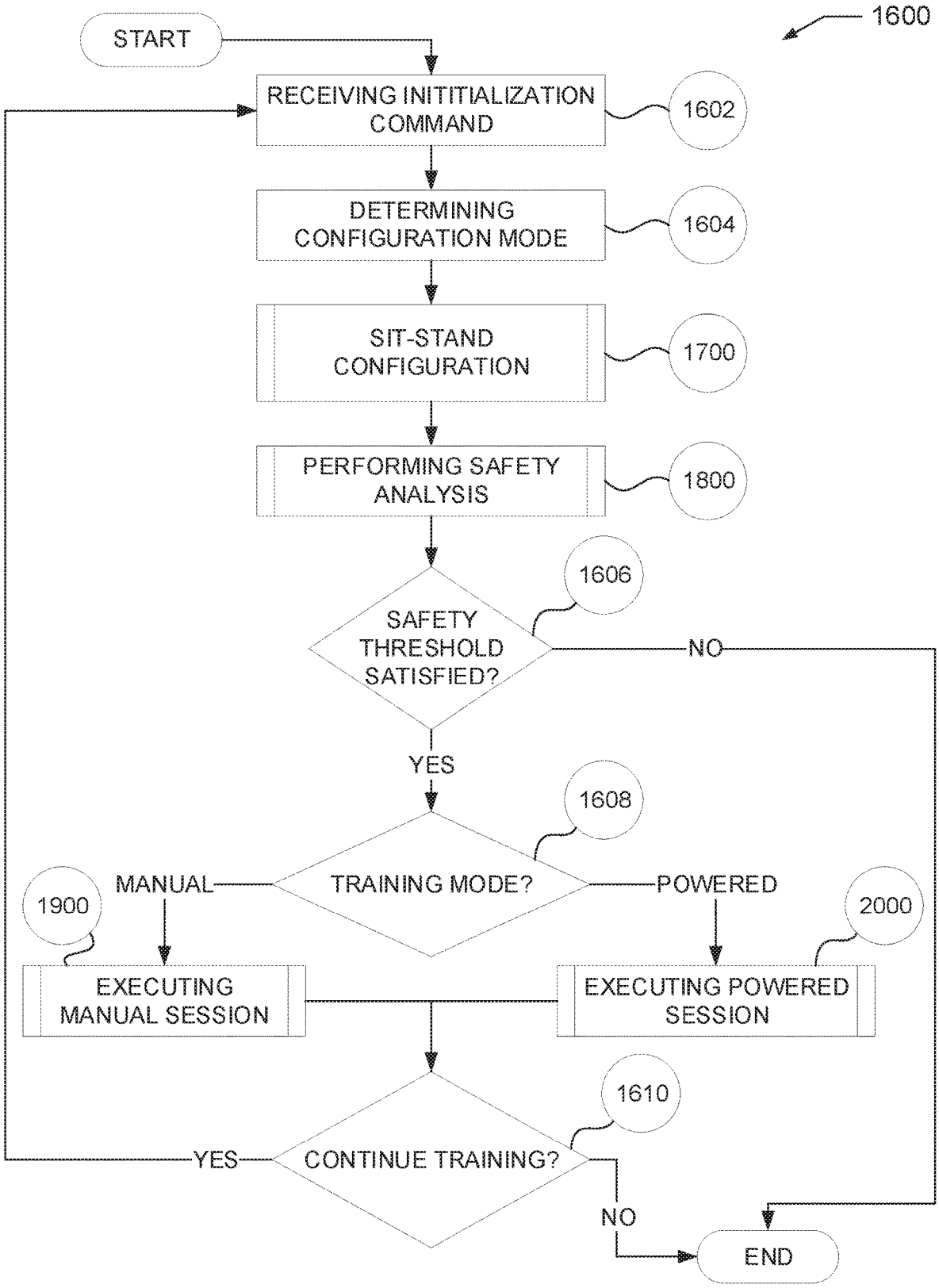
FIG. 16 is a flowchart showing an exemplary training process, according to one embodiment.

As will be understood by one having ordinary skill in the art, the steps and processes shown in FIG. 16 (and those of all other flowcharts and sequence diagrams shown and described herein) may operate concurrently and continuously, are generally asynchronous and independent, and are not necessarily performed in the order shown.

FIG. 16 is a flowchart showing an exemplary training process 1600, according to one embodiment of the present disclosure. At step 1602, the training process 1600 includes receiving an initialization command. An initialization command may be received from an input device, from an electronic device, or may be generated automatically (e.g., in response to recordings from one or more sensors). As an example, the system may receive a "Start Training" selection from a subject, via an input device. As another example, the system may receive an initialization command from a subject's and/or a trainer's smartphone. In another example, the system may include one or more proximity sensors that detect when a subject approaches or positions and/or positions themselves within the system. The one or more proximity sensors may detect a subject's approach and, in response to the detection, cause the system to generate and/or retrieve an initialization command.

In various embodiments, an initialization command may include, but is not limited to: 1) configuration information, including whether a subject wishes to train in a standing or a seated configuration; 2) configuration parameters, including but not limited to: A) one or more seat tilt parameters; B) one or more seat height parameters; C) one or more stride lengths; and D) one or more additional parameters (e.g., for example, gait width); 3) session mode information, including, but not limited to: A) whether a subject wishes to train in a manual or powered session; B) one or more resistance levels; C) one or more session resistance schedules; D) one or more assistance levels; and E) one or more session assistance schedules; 4) body weight support (BWS) information including, but not limited to: A) one or more offset percentage; and B) one or more session offset schedules (as described herein); 5) session information, including a session duration parameter; and 6) a subject identifier (as described herein).

At step 1602, the training process 1600 may include processing the received initialization command to parse and extract information therein.

At step 1604, the training process 1600 includes determining a configuration mode. In at least one embodiment, a configuration mode may be specified in configuration information include in the initialization command received at step 1602. For example, the initialization command may include a seated vs. standing threshold, and the initialization command may include the seated vs. standing threshold configured to specify a sitting configuration mode. In one or more embodiments, the system may determine a configuration mode by processing a configuration selection (e.g., received via an input device, a network communication, an electronic device, etc.). For example, the system may include a "Seated" button and a "Standing" button (each located on an input device). The system may receive and process a subject's selection of the "Seated" button and, thereby, determine a seated configuration mode.

Figure 17:
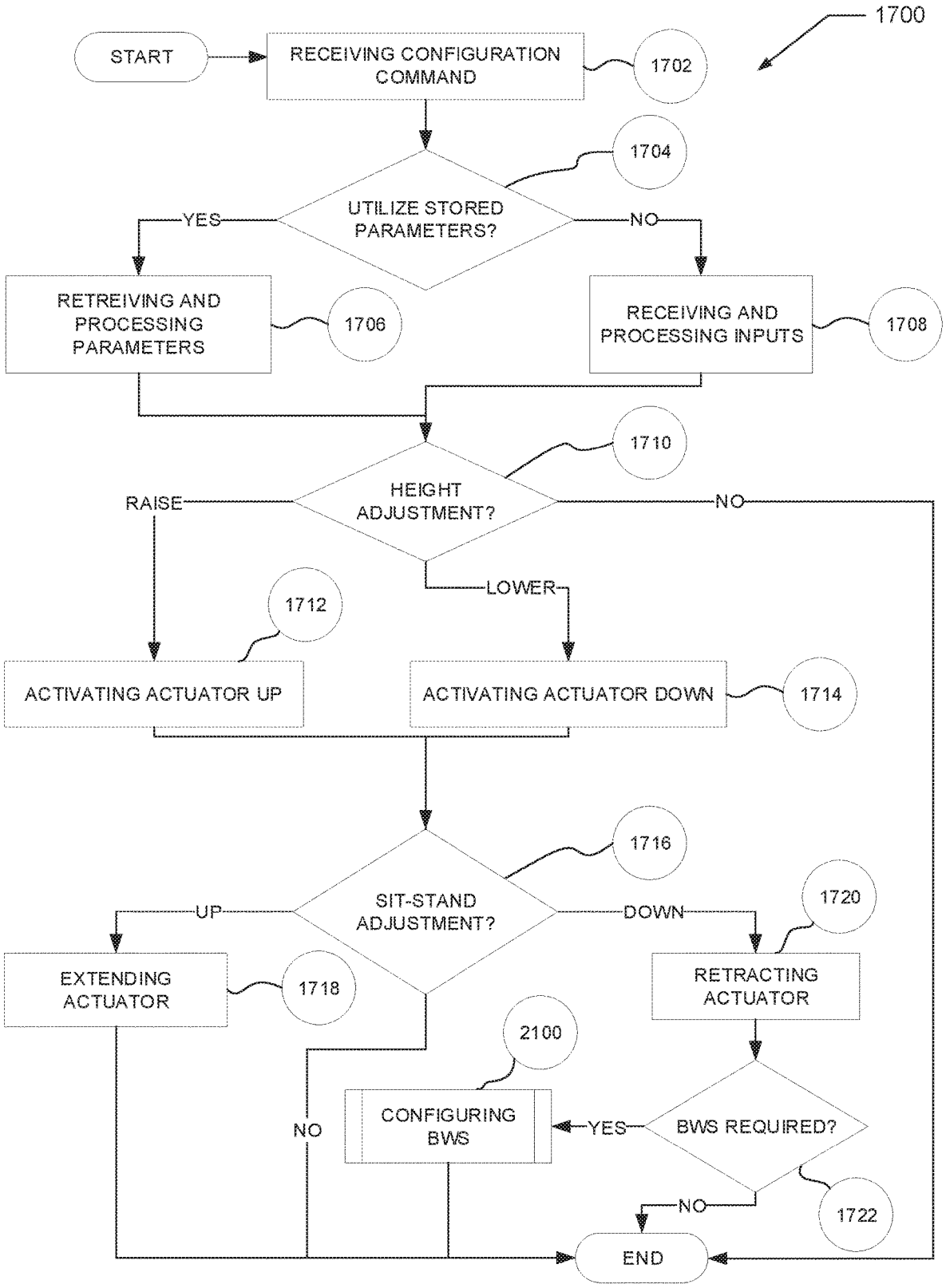
FIG. 17 is a flowchart showing an exemplary system configuration process, according to one embodiment.

Following determination of the configuration mode, the training process 1600 includes performing a sit-stand configuration process 1700 (FIG. 17).

Figure 18:
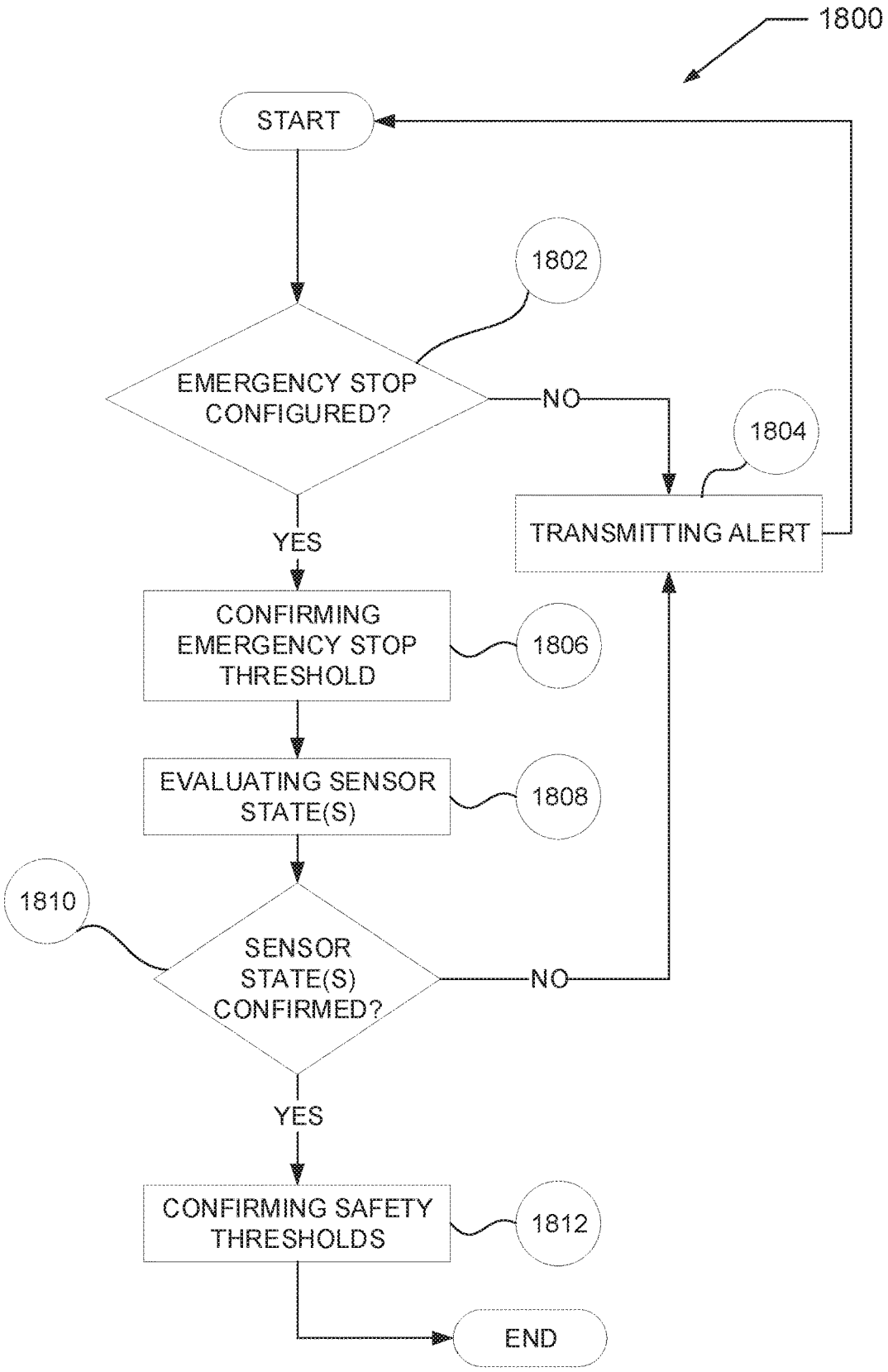
FIG. 18 is a flowchart showing an exemplary safety process, according to one embodiment.

Following performance of the sit-stand configuration process 1700, the training process 1600 includes performing a safety analysis process 1800 (FIG. 18).

At step 1606, the training process 1600 includes determining, based on the safety analysis process 1800, if one or more safety thresholds are satisfied. In at least one embodiment, the one or more safety thresholds may include, but are not limited to: 1) a safety contactor threshold; 2) a seat pivot threshold; 3) a harness safety threshold; 4) a BWS threshold; and 5) one or more additional thresholds. In one or more embodiments, if the system determines that each of the one or more safety thresholds is satisfied, the system proceeds to step 1608. In various embodiments, if the system determines that any of the one or more safety thresholds is not satisfied, the training process 1600 is suspended.

In at least one embodiment, if the system determines that any of the one or more safety thresholds are not satisfied, the system may take one or more supplementary actions. The one or more supplementary actions may include, but are not limited to: 1) generating and transmitting an alert including one or more safety thresholds determined to be unsatisfied; 2) emitting an alarm; 3) updating a user interface with a notification including the one or more unsatisfied safety thresholds and/or instructions for inspecting one or more safety sensors.

At step 1608, the training process 1600 includes determining a training mode. In at least one embodiment, a training mode may include, but is not limited to, a manual mode or a powered mode. The system may determine the training mode by receiving a training mode selection, and/or by processing session mode information included in a received initialization command. For example, the system may process session mode information and determine that the session information includes a "Manual" training mode selection. As another example, the system may include a "Manual" button and a "Powered" button (each located on an input device). The system may receive and process a subject's selection of the "Powered" button and, thereby, determine a powered training mode. In at least one embodiment, if the system determines a manual training mode, the system executes a manual training process 1900. In one or more embodiments, if the system determines a powered training mode, the system executes a powered process 2000.

At step 1610, following execution of a manual training process 1900 and/or a powered process 2000, the system determines if a subject wishes to continue training. In at least one embodiment, if the system determines that a subject wishes to continue training, the system returns to step 1602, thereby restarting the training process 1600. In one or more embodiments, if the system determines that a subject does not wish to continue training, the system suspends the training process 1600. For example, the system may include a "Continue Training" button and a "Do Not Continue Training" button (e.g., each included on an operatively connected input device). The system may receive and process a subject's selection of the "Continue Training" button and may return to step 1602 (e.g., to receive and process a subsequent initialization command).

FIG. 17 is a flowchart showing an exemplary configuration process 1700, according to one embodiment of the present disclosure. At step 1702, the configuration process 1700 includes receiving a configuration command. In at least one embodiment, a configuration command may include, but is not limited to, configuration information and/or one or more configuration parameters included in a received initialization command. In one or more embodiments, a configuration command may be generated, by the system, using processed configuration information and/or configuration parameters. In various embodiments, a configuration command may specify whether a subject wishes to perform training in a seated mode or a standing mode.

At step 1704, the configuration process 1700 includes determining whether or not to utilize stored parameters while executing subsequent process steps. In at least one embodiment, the system may formulate a determination by receiving a selection from an input device. For example, the system may include a "Use Stored Settings" button and a "Configure Manually" button. The system may receive and process a subject's selection of the "Use Stored Settings" button and determine that the subject wishes to utilize stored parameters while the system performs subsequent steps of the configuration process 1700. Alternatively, the system may receive and process a subject's selection of the "Configure Manually" button and determine that the subject does not wish to utilize stored parameters. In one or more embodiments, if the system determines that stored parameters are to be used, the system proceeds to step 1706. In various embodiments, if the system determines that stored parameters are to be used, the system may automatically load and/or configure stored parameters, a subject identifier, one or more stored session programs, connected accounts, sensor configurations, and other stored information. In at least one embodiment, if the system determines that stored parameters are not to be utilized, the system proceeds to step 1708.

At step 1706, the system retrieves and processes seating configuration parameters. In at least one embodiment, the seating configuration parameters may be retrieved from one or more databases and/or other computer memory. In at least one embodiment, the configuration command received at step 1702 may include a subject identifier that is associated, in a database, or the like, with a set of seating configuration parameters. For example, a subject identifier may be parsed from a received configuration command, and the subject identifier may be used to index a database and retrieve seating configuration parameters associated with the subject identifier.

At step 1708, the system receives and processes one or more configuration inputs. Exemplary configuration inputs may include, but are not limited to, seating configuration mode, seat height, seat rotation, and seat translation. In one or more embodiments, the one or more configuration inputs may be received via one or more input devices connected to the system. For example, the system may include a display and one or more buttons, and, at step 1708, the system may render a graphical user interface (GUI). The system may receive, via the GUI the one or more buttons, configuration inputs for various configuration parameters. The configuration parameters can include, but are not limited to, seat height, BWS offset, and stride length. In one or more embodiments, the system may process received configuration inputs to generate and record the one or more configuration parameters. In at least one embodiment, the system may provide the one or more configuration parameters to a configuration controller (for example, a computing environment) that translates the one or more configuration parameters into electronic commands that may be sent to one or more system components (e.g., actuators, etc.) to produce a desired configuration.

At step 1710, the system determines, based on processed configuration parameters (obtained at either step 1706 or 1708), whether to adjust a seat height. In one or more embodiments, a height adjustment may be performed to accommodate a subject's dimensions and/or anatomy. In at least one embodiment, the system may be configured for subjects measuring between about 4.5 feet-6.5 feet in height. In various embodiments, the system may determine if the processed configuration parameters include a seat height parameter. In at least one embodiment, the system may make a determination based on selection of a seat height parameter field on a rendered GUI display. For example, if the system receives any input in a seat height parameter field, the system may determine that a seat height adjustment is to be performed. In various embodiments, upon determining that a seat height adjustment is to be performed, the system may also determine whether the to-be-performed seat height adjustment includes a height increase or a height decrease. In at least one embodiment, the system may store a current height of a seating system (e.g., sourced from a hall sensor configured in a seat height actuator). In one or more embodiments, the system may compare the stored current height to a seat height parameter. In various embodiments, if the seat height parameter is greater than the stored current height, the system proceeds to step 1712. In one or more embodiments, if the seat height parameter is less than the stored current height, the system proceeds to step 1714. In at least one embodiment, if the sum or difference of the stored current height and the seat height parameter exceeds a maximum height threshold and/or falls beneath a minimum height threshold, the system may generate an alert. In one or more embodiments, if the stored current height is equal to the seat height parameter, or if a seat height parameter is not inputted to the system or retrieved, the system may suspend the configuration process 1700.

At step 1712, the system processes a received seat height parameter, determines a seat height actuator parameter, and commands a seat height actuator to activate according to the determined seat height actuator parameter. In one or more embodiments, the system may determine the seat height actuation parameter by calculating a seat height solution including, but not limited to, a duration of actuator activation required to reach the seat height parameter (e.g., also taking a current seat height and/or seat height actuator position into account). In at least one embodiment, the system generates and transmits a seat height actuator command, including the seat height solution, to a seat height actuator that processes the command and activates for the calculated duration and/or raises a seat height arm to a calculated height, thereby raising a height of a seating system connected thereto (e.g., and also raising a height of a BWS system connected to the seating system). In at least one embodiment, the system may perform seat system configuration processes without adjusting a seat height. For example, a system may configure a seating system from a seated configuration to a standing configuration (and vice versa) without adjusting a seat height.

At step 1714, the system processes a received seat height parameter, determines a seat height actuator parameter, and commands a seat height actuator to activate according to the determined seat height actuator parameter. In one or more embodiments, the system may determine the seat height actuation parameter by calculating a seat height solution including, but not limited to, a duration of actuator activation required to obtain the seat height parameter (e.g., also taking a current seat height and/or seat height actuator position into account). In at least one embodiment, the system generates and transmits a seat height actuator command, including the seat height solution, to a seat height actuator that processes the command and activates for the calculated duration and/or lowers a seat height arm to a calculated height, thereby decreasing a height of a seating system connected thereto (e.g., and also decreasing a height of a BWS system connected to the seating system).

At step 1716, the system determines if a sit-stand adjustment is required. In at least one embodiment, the system receives a configuration mode. For example, the system may receive or retrieve a configuration mode determined at step 1604. In various embodiments, the system may also retrieve a stored current configuration mode that describes a current configuration of the system (e.g., either a seated configuration or a standing configuration). In one or embodiments, the system compares the received configuration mode to the stored configuration mode, and, if the modes match, the system proceeds to step 1722. In at least one embodiment, if the stored configuration is "Standing" and the received configuration mode is "Seated," the system proceeds to step 1718. In various embodiments, if the stored configuration is "Seated" and the received configuration mode is "Standing," the system proceeds to step 1720.

At step 1718, the system generates and transmits a command to a sit-stand actuator. In at least one embodiment, upon receiving the command, the sit-stand actuator activates and extends to a fully extended position. In one or more embodiments, as described herein, full extension of the sit-stand actuator may cause a seat back assembly to project outward from the system (e.g., from a tower thereof) and may cause a seat bottom assembly to rotate clockwise until positioned orthogonal to the seat back assembly. In at least one embodiment, the system may command a sit-stand actuator to perform a partial extension. For example, based on a height, or other dimension, of a subject, the system may command a sit-stand actuator to partially extend, thereby partially translating a seat back assembly and partially rotating a seat bottom assembly clockwise.

At step 1720, the system generates and transmits a command to a sit-stand actuator. In at least one embodiment, upon receiving the command, the sit-stand actuator activates and retracts to a fully retracted position. In one or more embodiments, as described herein, full retraction of the sit-stand actuator may cause a seat back assembly to withdraw inward towards the system (e.g., towards a tower thereof) and may cause a seat bottom assembly to rotate counterclockwise until positioned obtuse to the seat back assembly. In at least one embodiment, the system may command a sit-stand actuator to perform a partial retracting. For example, based on a height, or other dimension, of a subject, the system may command a sit-stand actuator to partially extend, thereby partially translating a seat back assembly (e.g., in a direction opposite a translation performed at step 1718) and partially rotating a seat bottom assembly counterclockwise.

Following step 1720, the system may proceed to step 1722.

Figure 21:
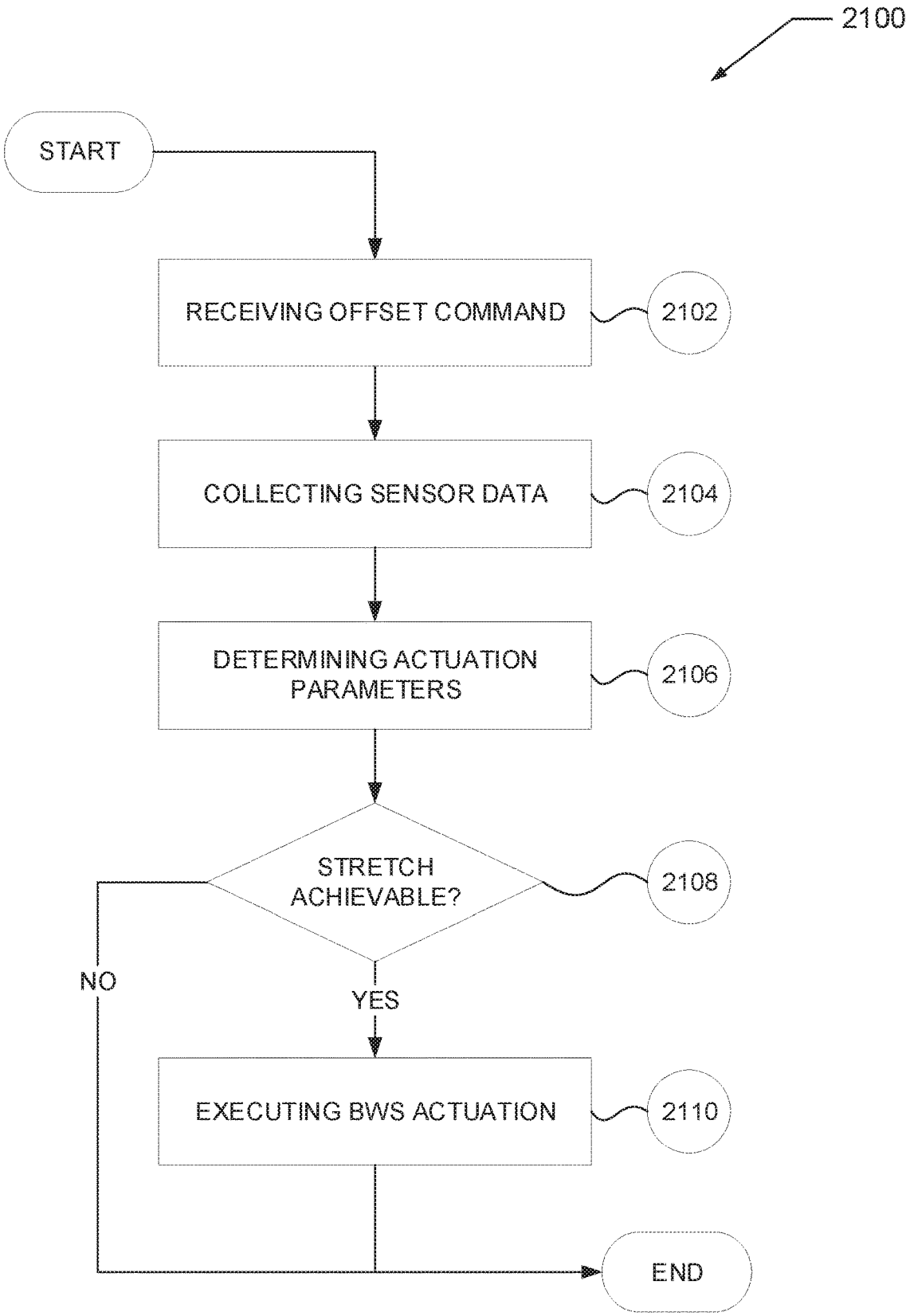
FIG. 21 is a flowchart showing an exemplary BWS configuration process, according to one embodiment.

At step 1722, the system determines if activation of a body weight support system (BWS) is to be performed. In at least one embodiment, the system may formulate the determination based on processing one or more configuration parameters and/or by receiving a BWS selection on a rendered GUI. If the system determines that the BWS system is to be engaged, the system performs a BWS configuration process 2100 (FIG. 21). If the system determines that the BWS system is not required, the system concludes the configuration process 1700. In at least one embodiment, the system may perform a BWS configuration process 2100 in a standing configuration or a sitting configuration (e.g., or in partial configurations therebetween).

FIG. 18 is a flowchart showing an exemplary safety process 1800, according to one embodiment of the present disclosure. At step 1802, the safety process 1800 includes evaluating configurations of one or more emergency stops. In at least one embodiment, an emergency stop refers to a system (e.g., such as, for example, a safety relay circuit) that, upon being triggered (e.g., disconnected or connected), causes an emergency shutdown including, but not limited to, suspension of all powered assistance processes, application of one or more emergency brakes (e.g., ceasing motion of one or more mechanical components), and execution of one or more shutdown procedures (as described herein). In various embodiments, an emergency stop may include, but is not limited to, one or more safety contactors.

In at least one embodiment, determining that an emergency stop is configured can include, but is not limited to, determining if one or more safety contactors have been properly positioned (e.g., on a subject, on one or more system components, etc.). For example, the system may include a safety contactor that, when attached to a subject, completes an emergency stop circuit. To determine that the emergency stop circuit is properly configured, the system may determine if the emergency stop circuit is completed (e.g., by sending a test signal through the circuit and/or by sampling the circuit's voltage, current, resistance, etc.). In various embodiments, if the system determines that the emergency stop is configured, the system proceeds to step 1806 (e.g., skipping step 1804). In one or more embodiments, if the system determines that the emergency stop is not configured, the system may proceed to step 1804.

At step 1804, the system may generate and transmit an alert. In one or more embodiments, an alert may include, but is not limited to: 1) an electronic notification (e.g., a push alert, text, email, etc.); 2) a displayed alert that is rendered on a display connected to the system; 3) an audible tone and/or voice recording; and 4) a vibrational alert that may be felt by a system operator and/or subject. In at least one embodiment, the alert may include a description of the alert's cause (e.g., non-configuration of an emergency stop, anomalous sensor states, unsatisfactory sensor-threshold pair, etc.). In various embodiments, after transmitting an alert, the system may restart the safety process 1800.

At step 1806, the system confirms an emergency stop threshold. In one or more embodiments, prior to confirmation of an emergency stop threshold, the system may be configured to prevent operation of system elements (e.g., footplates, handles, a motor, etc.). For example, the system may include a lockout system that prevents operation of system elements unless an emergency stop threshold is confirmed. In at least one embodiment, an emergency stop threshold may be reset following each training process 1600 and/or following each configuration process 1700.

At step 1808, the system evaluates states of one or more system sensors. In at least one embodiment, the one or more system sensors may include, but are not limited to, hall sensors, inductive sensors, infrared alignment sensors, weight sensors, and one or more additional sensors that transduce physical phenomena into electrical signals and/or measure positions and orientations of system elements. In various embodiments, the system may retrieve one or more sensor thresholds. For example, the system may retrieve a set of thresholds related to alignment and function of various system elements.

In an exemplary scenario, the system retrieves a threshold for rotational alignment of a rotatable tower and a base. The system may retrieve data from an inductive sensor that records an angle of rotation between the tower and the base. The system may evaluate the data and determine that a current angle of rotation between the tower and the base is 0 degrees. The retrieved threshold may specify a rotation of 0 degrees as satisfying the threshold. Accordingly, the system may compare the evaluated rotation angle of 0 degrees to the retrieved threshold, and may determine that the threshold is satisfied.

In one or more embodiments, the system may include a set of sensors and sensor thresholds that must be satisfied for confirmation of one or more safety thresholds. For example, the set of sensors and sensors thresholds may include the above described inductive sensor and tower rotation threshold. The set of sensors and sensor thresholds may also include, but is not limited to: 1) a seat pivot sensor and a seat pivot threshold; 2) a harness safety sensor and a harness safety threshold; and 3) a BWS sensor and a BWS threshold. The seat pivot sensor may determine a rotational position of a seat bottom assembly, and the seat pivot threshold may be satisfied by a rotation between about 0-120 degrees. The harness safety sensor may determine if a safety harness is properly attached to a subject, the safety harness threshold may be satisfied by confirmation of proper safety harness attachment. The BWS sensor may determine if a BWS system is properly functioning, and the BWS threshold may be satisfied by confirmation of proper BWS system function. For example, the BWS sensor may be a force sensor that records a tensile force between a spring and a spring anchor. The BWS threshold may be a range of acceptable baseline forces (e.g., baseline referring to a BWS system without a subject). In the same example, if the BWS sensor reports a force within the range of acceptable baseline forces, the BWS threshold may be satisfied.

In at least one embodiment, the system evaluates each sensor and sensor threshold included in a set of sensors and thresholds. In various embodiments, for each sensor-threshold pair, or the like, the system may update the set to include a "PASS" parameter, indicating that the threshold is met, or a "FAIL" parameter, indicating that a threshold is not satisfied.

At step 1810, the system determines if any sensors failed to satisfy a threshold. In various embodiments, to formulate a determination, the system may process the sensor evaluations generated at step 1810 (e.g., formatted as a set of sensors and thresholds) and determine if any sensors failed to satisfy an associated threshold. In an exemplary scenario, the system may process an updated set of sensors and index all sensor-threshold pairs that include a "FAIL" parameter. If the returned index is empty, the system determines that all sensors pass evaluation and the system proceeds to step 1812. If one or more embodiments, if the returned index is not empty (e.g., at least one sensor-threshold pair is included), the system proceeds to step 1804.

At step 1812, the system confirms one or more safety thresholds. In one or more embodiments, the system may include a safety threshold for each sensor evaluated at step 1808. In at least one embodiment, the system may process an updated set of sensors and thresholds (e.g., all sensor-threshold pairs including a "PASS" parameter) to confirm one or more safety thresholds. In various embodiments, upon confirming the one or more safety thresholds, the system may receive a subject.

Figure 19:
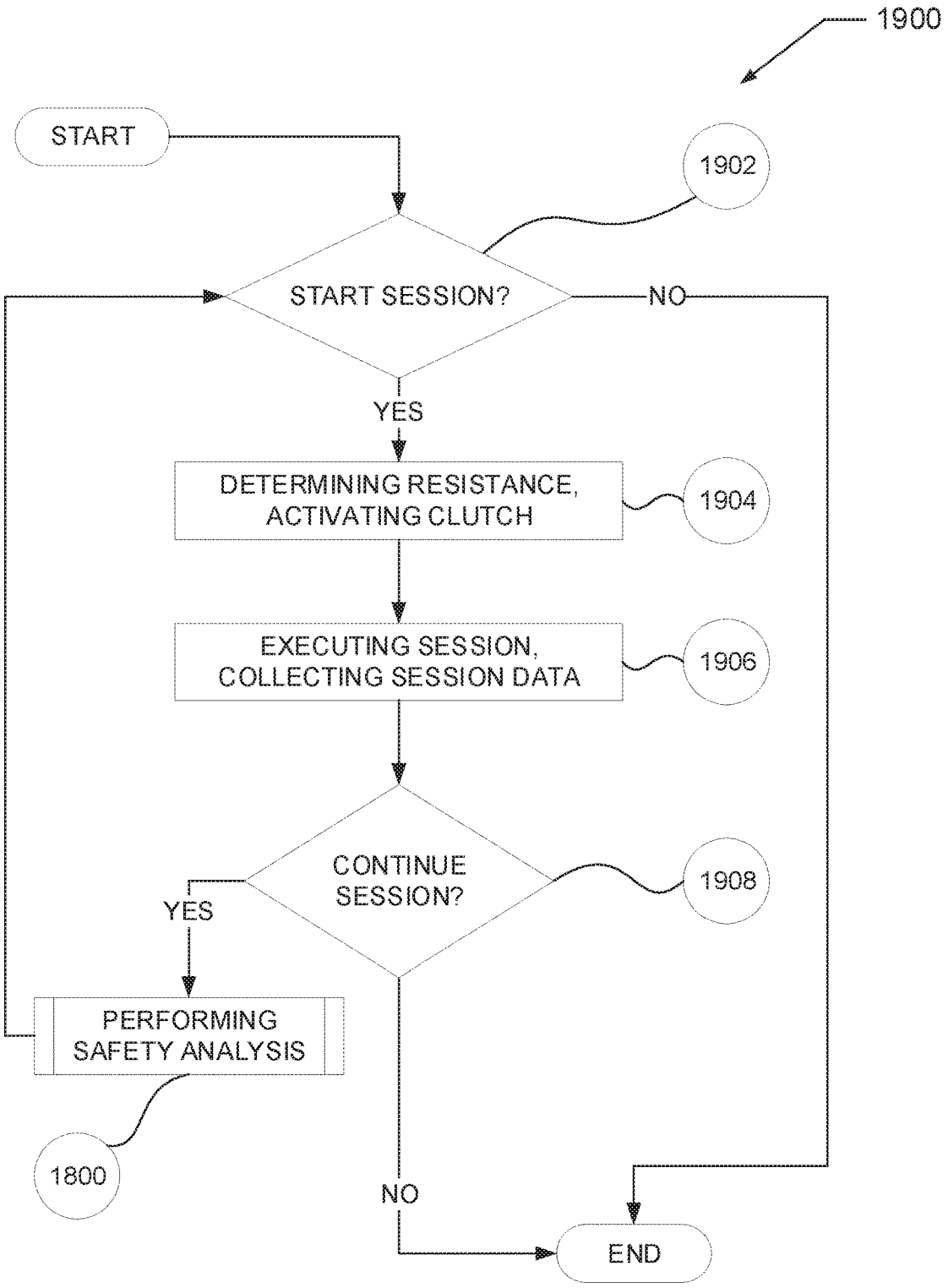
FIG. 19 is a flowchart showing an exemplary manual training process, according to one embodiment.

FIG. 19 is a flowchart showing an exemplary manual training process 1900. At step 1902, the system determines whether or not a subject wishes to begin a training session. In one or more embodiments, the system may receive a session initialization command that causes the system to begin a training session. For example, the system may receive a session initialization command via selections made on a rendered GUI. In at least one embodiment, a session initialization command may include a session duration, resistance parameters, and one or more other training parameters. In one or more embodiments, if the system determines that the subject wishes to begin a training session, the system proceeds to step 1904. In one or more embodiments, if the system determines that the subject does not wish to begin a training session, the system suspends the manual training process 1900.

At step 1904, the system determines a desired resistance level and configures a clutch to achieve the desired resistance level. In or more embodiments, the system may retrieve a desired resistance level from a session initialization command received at step 1902. In at least one embodiment, the system may render, on a connected display, a GUI containing a field for inputting a resistance level. In various embodiments, the system may receive a resistance level via selections and/or information made in a resistance level field included in a GUI. In one or more embodiments, the system may process a subject identifier to retrieve a stored resistance level.

In at least one embodiment, the system processes a resistance level and activates a clutch. In one or more embodiments, the resistance command may cause a clutch (as described herein) to enter an activated state and generate resistance equal to a processed resistance level. In an exemplary scenario, the clutch is a magnetic particle clutch, and the resistance command may cause the magnetic particle clutch to generate a magnetic field of a particular strength. The system may determine the particular strength of the magnetic field by converting the desired resistance level into a magnetic field strength (e.g., via one or more calculations). The system may cause the magnetic particle clutch to generate the particular strength by calculating, based on the particular strength, a magnitude of electricity (e.g., a voltage, current, etc.) required to generate a magnetic field of the particular strength (e.g., at the magnetic particle clutch). In various embodiments, the system may configure a magnetic particle clutch by supplying (or causing an additional system to supply) a calculated magnitude of electricity to the magnetic particle clutch. As will be understood from discussions herein, the resistance level may be set at zero (e.g., or very low resistance).

At step 1906, the system executes a training session and records session data throughout the training session. In at least one embodiment, the training session may be automatically executed upon detection of movement at one or more footplates, one or more handles, and or upon detection of rotation of a linkage and/or linkage components (e.g., as describe herein). For example, a subject oriented in the system may move a footplate, and the system, upon detecting the footplate movement, may automatically execute the training session and begin recording session data. In various embodiments, recorded session data may include, but is not limited to: 1) a training duration; 2) a step count metric; 3) a step rate metric; 4) a peak period metric that identifies and/or describes a period of highest step rate, step count, etc.; and 5) one or more additional training metrics.

In at least one embodiment, throughout a training session, the system may continue to monitor and evaluate states of one or more sensors (e.g., as described herein). For example, a system may continuously monitor an emergency stop to confirm proper configuration, and may suspend a training session should the system determine that the emergency stop is not properly configured. In various embodiments, the system may include one or more switches and/or trip-able sensors that are only activated and/or tripped in response to system malfunctions. For example, the BWS system 107 may include a switch sensor for detecting improper rotation of the overhead support 205, the central support 206, or one or more connected components. In an exemplary scenario, the switch may be activated if the overhead support 205 and/or central support 206 is rotated and/or pivoted to a perpendicular position (e.g., which may occur due to a component failure, weight overload, etc.). Upon the switch being activated, the system may trigger an emergency shutdown including, but not limited to, disconnecting and/or powering down a motor unit, and applying one or more brakes, or the like, to stop linkage motions.

At step 1908, the system determines if the subject wishes to continue a training session. In one or more embodiments, the system may proceed to step 1908 following elapse of a predefined or subject-defined training session period. In at least one embodiment, the system may proceed to step 1908 upon detecting that a linkage (as described herein) has ceased all translational and/or rotational movement (e.g., as indicated by position and/or rotational sensors distributed therein).

In various embodiments, the system may formulate a determination by rendering a GUI that includes fields for electing to continue or suspend the training session (e.g., a "Yes" field and a "No" field). In at least one embodiment, the system may receive and process a field selection to determine if the subject desires to suspend the session (e.g., a "Yes" selection indicating training session continuation and a "No" selection indicating training session suspension). In one or more embodiments, if the system determines that the subject wishes to continue a training session, the system performs a safety analysis process 1800 and returns to step 1902. In at least one embodiment, if the system determines that the subject does not wish to continue the training session, the system suspends the manual training process 1900.

Figure 20:
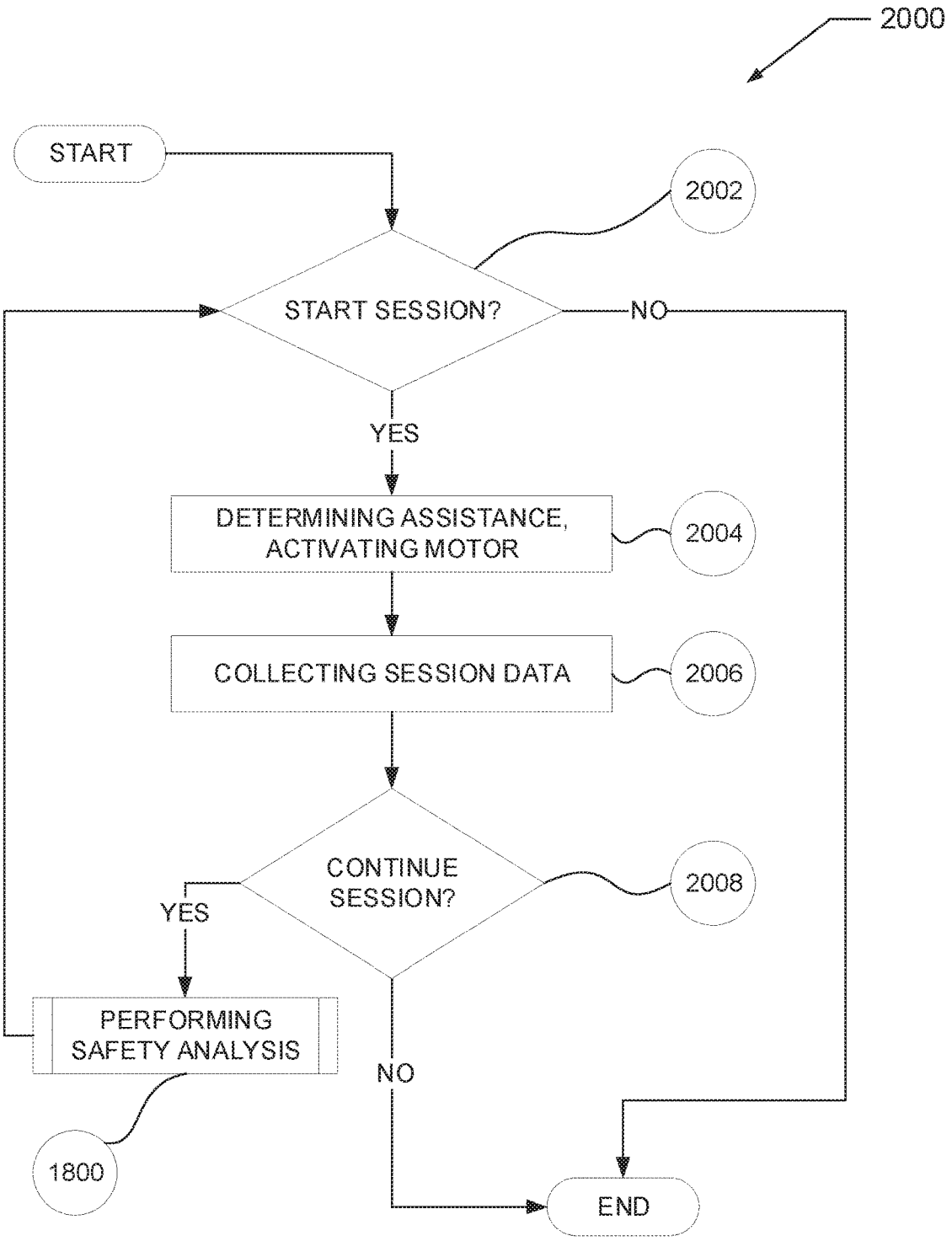
FIG. 20 is a flowchart showing an exemplary powered training process, according to one embodiment.

FIG. 20 is a flowchart showing an exemplary powered training process 2000. At step 2002, determines whether or not a subject wishes to begin a training session. In one or more embodiments, the system may receive a session initialization command that causes the system to begin a training session. For example, the system may receive a session initialization command via selections made on a rendered GUI. In at least one embodiment, a session initialization command may include a session duration, resistance parameters, and one or more other training parameters. In one or more embodiments, if the system determines that the subject wishes to begin a training session, the system proceeds to step 2004. In one or more embodiments, if the system determines that the subject does not wish to begin a training session, the system suspends the manual training process 2000.

At step 2004, the system determines a desired assistance level and configures a motor unit and a clutch to achieve the desired assistance level. In or more embodiments, the system may retrieve a desired assistance level from a session initialization command received at step 2002. In at least one embodiment, the system may render, on a connected display, a GUI containing a field for inputting an assistance level. In various embodiments, the system may receive an assistance level via selections and/or information made in an assistance level field included in a GUI. In one or more embodiments, the system may process a subject identifier to retrieve a stored assistance level.

In at least one embodiment, the system processes an assistance level and activates a motor unit and a clutch. In one or more embodiments, the system may activate a mechanism that engages an output of the motor unit and/or subsequent connected element (e.g., a transmission), thereby causing the motor unit to provide power to a driving link mechanism and rotate one or more driving links (e.g., thereby activing one or more linkages, as described herein). In at least one embodiment, the motor unit may provide a fixed output of power (e.g., assistance), and the clutch may be configured to step down the outputted power to obtain a desired assistance level. In one or more embodiments, the system may cause a clutch (as described herein) to enter an activated state and generate assistance equal to a processed assistance level. In an exemplary scenario, the clutch is a magnetic particle clutch, and the system may cause the magnetic particle clutch to generate a magnetic field of a particular strength. The system may determine the particular strength of the magnetic field by converting the desired assistance level into a magnetic field strength (e.g., via one or more calculations). The system may cause the magnetic particle clutch to generate the particular strength by calculating, based on the particular strength, a magnitude of electricity (e.g., a voltage, current, etc.) required to generate a magnetic field of the particular strength (e.g., at the magnetic particle clutch). In various embodiments, the system may configure a magnetic particle clutch by supplying (or causing an additional system to supply) a calculated magnitude of electricity to the magnetic particle clutch.

At step 2006, the system executes a training session and records session data throughout the training session. In at least one embodiment, the training session may be automatically executed upon detection of movement at one or more footplates, one or more handles, and or upon detection of rotation of a linkage and/or linkage components (e.g., as describe herein). In at least one embodiment, the system may await detection of movement before engaging a motor unit and clutch at step 2004. For example, a subject oriented in the system may move a footplate, and the system, upon detecting the footplate movement, may automatically engage a motor unit and a clutch, thereby providing powered assistance to the subject. In various embodiments, recorded session data may include, but is not limited to: 1) a training duration; 2) a step count metric; 3) a step rate metric; 4) a peak period metric that identifies and/or describes a period of highest step rate, step count, etc.; and 5) one or more additional training metrics.

At step 2008, the system determines if the subject wishes to continue a training session. In one or more embodiments, the system may proceed to step 2008 following elapse of a predefined or subject-defined training session period. In at least one embodiment, the system may proceed to step 2008 upon detecting that a linkage (as described herein) has ceased all translational and/or rotational movement (e.g., as indicated by position and/or rotational sensors distributed therein).

In various embodiments, the system may formulate a determination by rendering a GUI that includes fields for electing to continue or suspend the training session (e.g., a "Yes" field and a "No" field). In at least one embodiment, the system may receive and process a field selection to determine if the subject desires to suspend the session (e.g., a "Yes" selectin indicating training session continuation and a "No" selection indicating training session suspension). In one or more embodiments, if the system determines that the subject wishes to continue a training session, the system performs a safety analysis process 1800 and returns to step 2002. In at least one embodiment, if the system determines that the subject does not wish to continue the training session, the system suspends the powered training process 2000.

FIG. 21 is a flowchart showing an exemplary BWS configuration process 2100. In various embodiments, the body weight support process may include operation of a BWS system 107, as described herein.

At step 2102, the system may receive an offset command. In one or more embodiments, an offset command may be received following a determination (e.g., formulated during a configuration process 1700) that a BWS system is to be used by a subject. In at least one embodiment, the offset command may include, but is not limited to, a subject weight and an offset percentage (e.g., between 0-100%). In various embodiments, an offset percentage refers to a proportion of a subject's weight to be offloaded via a BWS system. For example, an offset command may include a subject weight of 200 pounds and an offset percentage of 50%, thereby indicating that the subject wishes to offload 100 pounds via a BWS system. In at least one embodiment, the system may receive an offset command by: 1) rendering, on a connected display, a GUI including a subject weight field and an offload percentage field; and 2) receiving and processing inputs to each field. In one or more embodiments, the system may process a subject identifier and retrieve a stored offset command (or information included therein) from a database, or the like.

At step 2104, the system collects sensor data from a BWS system. In various embodiments, the system may collect sensor data from sensors including, but not limited to, position sensors and/or force sensors configured within the BWS system. For example, the system may collect force data from sensors that measure forces between a spring and a spring anchor, between a spring anchor and a force transfer beam, and/or between a harness or strap system and an overhead support. As another example, the system may collect position data from sensors that measure a stretch length of a spring and/or that measure a position of a spring actuator rod. As an additional example, the system may collect weight data from one or more weight sensors disposed in a portion of a track positioned beneath a BWS system. Because a subject may be situated above the track portion, the one or more weight sensors may measure and record the subject's weight.

At step 2106, the system determines one or more actuation parameters. In various embodiments, an actuation parameter may include determining an offset, a spring stretch distance, and a spring actuator solution. In at least one embodiment, an offset refers to a metric calculated by multiplying a subject weight by an offset percentage. For example, the system may calculate, for a subject weighing 200 pounds and desiring an offset percentage of 50%, and offset equal to 100 pounds. In one or more embodiments, a spring stretch refers to a length to which a spring must be stretched to generate an offloading force equal to a calculated offset. In various embodiments, the system may calculate the spring stretch by solving Equation 1, where k represents a spring constant, F represents an offset, and x represents the spring stretch.

$$F=-k*x \quad \text{(Equation 1)}$$

For example, a subject may require an offset of 100 pounds and a spring may present a spring constant of 85 lbs./in. The system may solve Equation 1 for x and calculate a spring stretch of about 1.18 inches, thereby indicating that a spring must be stretched by at least about 1.18 inches to generate an offloading force sufficient to provide the subject's required offset. Because the spring stretch may be facilitated via an attached spring actuator rod, the offset may also refer to a contraction or extension distance required by a spring actuator and a spring actuator rod to achieve the offset. In the above example, the 1.18 inch offset may also describe a distance that a spring actuator rod must retract to cause the spring to generate the 100 pound offset.

In various embodiments, the system may store one or more spring constants (e.g., for purposes of calculating a spring offset). In various embodiments, configuration of a spring within a BWS system may inherently include partial stretching of the spring, thereby generating a baseline offloading force. In at least one embodiment, before solving Equation 1, the system may adjust "F" by subtracting a baseline offset force currently generated by a spring. To continue the above example, the system, prior to solving Equation 1, may retrieve a baseline offset force of 15 pounds (e.g., recorded via one or more sensors, as described herein). The system may subtract the 15 pound offset force from the 100 pound offset to generate an adjusted offset of 85 pounds. The system may then solve Equation 1 using the adjusted offset, and may calculate a spring stretch of about 1.0 inch.

In one or more embodiments, the system may use a look-up table or the like to determine the one or more actuator parameters (e.g., opposed to, or in addition to, an equation or equations). For example, the system may include a table stored in local or remote (e.g., cloud) memory including system or one or more actuator parameters (e.g., spring stretch) matched with subject inputs (e.g., subject weight). Continuing with this example, upon receiving the subject inputs, the system uses a look-up table to determine corresponding system or one or more actuator parameters (e.g., spring stretch or other parameters).

In at least one embodiment, the system determines a spring actuator solution that may include a spring actuator rod position and/or a spring actuator activation duration. In various embodiments, a spring actuator solution may be based, in part, on a calculated spring stretch and sensor data describing a current orientation of a spring actuator. To continue the above example, the system may determine that a spring actuator rod is extended to a length of about 6 inches. The system may subtract the 1 inch calculated spring stretch from the 6 inch current position to identify a stretch position of 5 inches. In various embodiments, the system may calculate a spring actuator activation duration by solving a stored actuation position equation (e.g., using the calculated stretch as an input). To continue the above example, the system may retrieve an actuation constant that describes a magnitude of actuation extension or retraction produced for a given length of time (e.g., 1 second). The retrieved actuation constant may be about 1.3 seconds per inch. The system may calculate a spring actuator activation duration by multiplying the 1 inch calculated stretch by the 1.3 seconds/inch actuation constant, thereby outputting a spring actuator activation duration of 1.3 seconds. In at least one embodiment, a spring actuator may be configured to automatically calculate a spring actuator solution upon receipt of a calculated stretch (e.g., included in a spring actuator solution transmitted by the system to the spring actuator). In at least one embodiment, because the system may store data regarding positions and other parameters of the spring and spring actuator, the system may calculate a spring stretch solution without calculation (e.g., based on historical parameters).

In some embodiments, the system may calculate an actuator rod movement, based on a known length of the actuator rod. In these embodiments (and others), the system may move an actuator rod to correspond to the calculated spring stretch.

At step 2108, the system determines if the stretch calculated at step 2106 is achievable. In various embodiments, a stretch may be unachievable if the stretch magnitude is greater than a maximum spring actuator extension distance, or is greater than a minimum spring actuation retraction distance. In various embodiments, the system may retrieve: 1) a maximum contraction distance (associated with the spring actuator and spring actuator rod) that describes a maximum length to which a spring actuator rod may be retracted (e.g., from a current and/or rest position); and 2) a maximum extension distance that describes a maximum length to which a spring actuator rod may be extended (e.g., from an initial or current position). In one or more embodiments, if the system determines that a calculated stretch is greater than a maximum contraction distance and/or greater than a maximum extension distance, the system may determine that the stretch is unachievable and suspend the BWS configuration process 2100. In at least one embodiment, if the system determines that a calculated stretch is less than a maximum contraction distance and/or less than a maximum extension distance, the system determines that the stretch is achievable and proceeds to step 2110.

In an exemplary scenario, at step 2106, the system may calculate a stretch of 6.0 inches, thereby indicating that a spring actuator must retract a spring actuator rod by a length of 6.0 inches to generate a sufficient offset force. In the above scenario, the system may compare a retrieved maximum contraction distance of 5 inches to the calculated 6.0 inch stretch. Because the required stretch is greater than the maximum contraction distance, the system may determine that the stretch is unachievable. In at least one embodiment, if the system determines that a stretch is unachievable, the system may suspend the BWS configuration process 2100. In at least one embodiment, if the system determines that a stretch is unachievable, the system may also generate and translate an alert (as described herein) notifying a subject and/or operator that a desired offset is unachievable.

At step 2110, the system executes BWS actuation by activating a spring actuator. In at least one embodiment, the system may generate and transmit, to the spring actuator, a command that includes the stretch determined at step 2106. In one or more embodiments, the command may cause the spring actuator to extend or retract a spring actuator rod by a magnitude equal to the transmitted stretch. In various embodiments, extension or retraction of the spring actuator rod may cause a corresponding retraction or extension of the spring, thereby providing the calculated offset via tensile forces transferred to a subject connected to the BWS system (as described herein).

Figure 22:
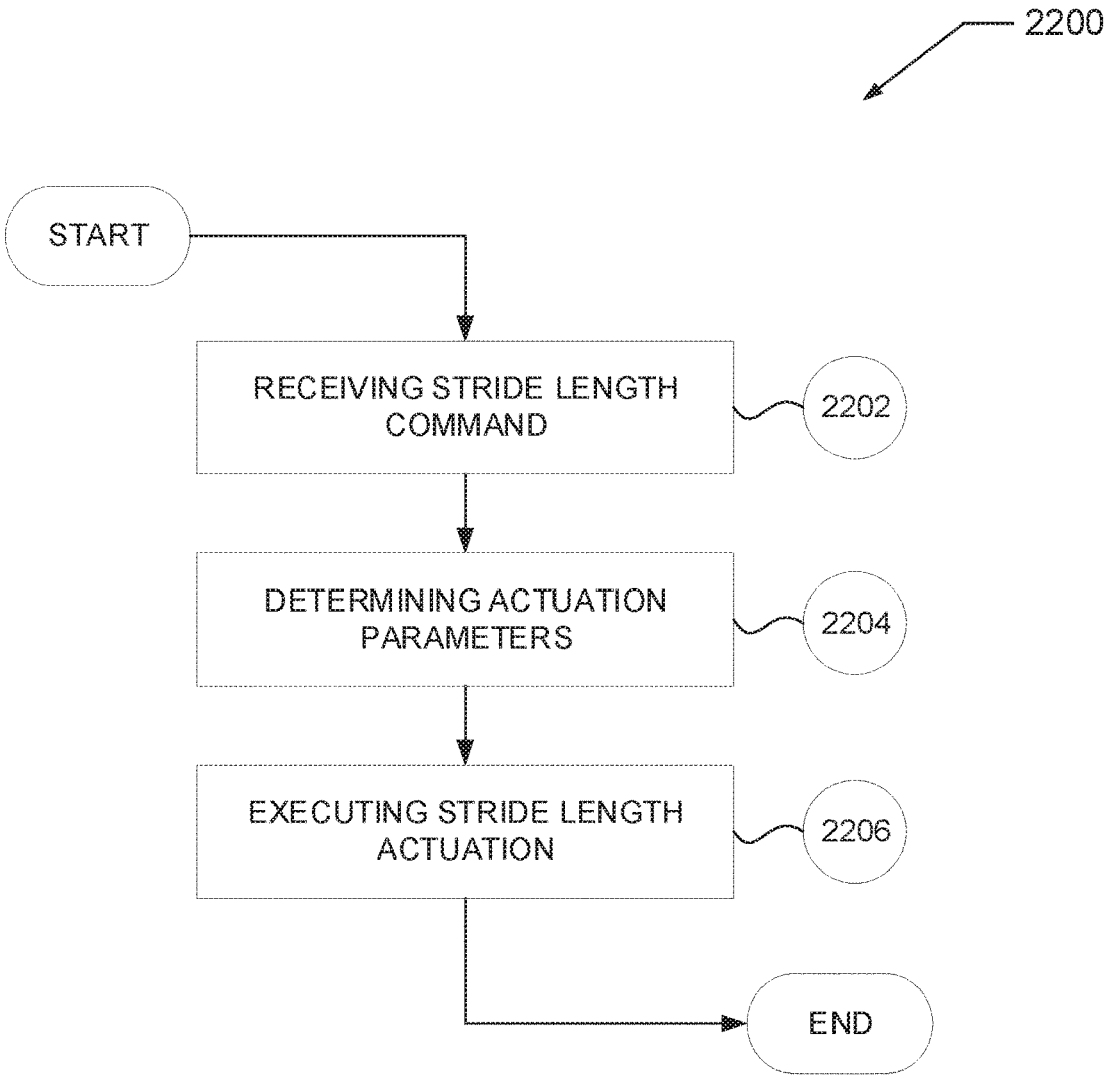
FIG. 22 is a flowchart showing an exemplary stride length configuration process, according to one embodiment.

FIG. 22 is a flowchart showing an exemplary stride length configuration process 2200. In various embodiments, a stride length configuration process 2200 may be performed to adjust a stride length provided to a subject via the present system. In at least one embodiment, adjustment of stride length may be required due to variances in subject dimensions and gait cycles. In one or more embodiments, stride length configuration may be achieved via positioning of a driving linkage along a stride length track (e.g., facilitated via activation of a stride length actuator). Because a stride length may be determined by a radius of rotation of an outer footplate link, decreasing the outer footplate link's radius of rotation may decrease the stride length, and increasing the outer footplate link's radius of rotation may increase the stride length.

At step 2202, the system receives a stride length command that includes a desired stride length. In at least one embodiment, the system may receive a stride length command by: 1) rendering, on a connected display, a GUI including a stride length field; and 2) receiving and processing input to the field. In various embodiments, a GUI may include a selector and/or slider interface that allows a subject or operator to iteratively and incrementally adjust a stride length. In at least one embodiment, each input to a selector and/or slider may cause the system to generate a subsequent stride length command. In one or more embodiments, the system may process a subject identifier and retrieve a stored stride length command from a database, or the like. As will be understood from discussions herein, in various embodiments, the system may calculate a stride length based on a subject's height, weight, etc.

At step 2204, the system determines an actuation parameter. In various embodiments, the actuation parameter may refer to an actuation position and/or an actuation activation duration required to achieve the received stride length and/or incremental input. In at least one embodiment, the actuator parameter may be based on a received stride length and/or a received incremental input. In one or more embodiments, the system may determine the actuation parameter by calculating: 1) a radius of rotation required to achieve the stride length and/or increment; and 2) a direction and magnitude of translation by which to translate a stride length linkage to achieve the calculated radius. In various embodiments, the system may compute a radius of rotation by performing one or more actions, including but not limited to, mathematical computations, table lookups, or other computational methods. For example, the system may solve an equation relating radius of rotation, stride length linkage position and/or translation, and stride length. An exemplary stride length equation may be Equation 2, where $L_s$ represents a stride length, r represents a radius of rotation, and c represents a constant ratio between $L_s$ and r.

$$L_s = r*c \quad \text{(Equation 2)}$$

In the same example, a subject may input a stride length ($L_s$) of 30 inches. The system may calculate, based on the stride length and a constant ratio (c) of 0.6, a radius of rotation of 18 inches. In another example, the system may determine a radius of rotation based on one or more tables relating stride length and radius of rotation.

In various embodiments, upon determining a radius of rotation, the system may determine an actuation parameter including a direction and magnitude of translation. In at least one embodiment, determining the direction and magnitude of translation may include, but is not limited to: 1) determining a current radius of rotation by determining a current position of a driving linkage; and 2) determining an actuation parameter by comparing the current radius of rotation to the calculated radius of rotation. To continue the above example, the system may determine, via one or more sensors, a current radius of rotation of 15 inches. The system may compare the current radius to the calculated radius and determine an actuation parameter of (+) 3 inches, thereby establishing that a driving linkage must translate away from a center of rotation by 3 inches. In at least one embodiment, the system may convert a length-based actuation parameter to an activation duration actuation parameter, or conversion may be performed automatically by a stride length actuator.

At step 2206, the system executes stride length actuation. In various embodiments, executing stride length actuation may include, but is not limited to, transmitting, to a stride length actuator, an actuation command that includes an actuation parameter determined at step 2204. In various embodiments, the actuation command may cause the stride length actuator to engage and translate a driving linkage in the determined direction and by the determined translation magnitude, thereby positioning the stride length linkage at the calculated radius of rotation and achieving the desired stride length. In one or more embodiments, if a subject or operator performs stride length configuration via incremental inputs to a GUI, the system may cause the stride length actuator to, in response to each input, engage and translate the driving linkage by a preprogrammed distance and in a direction determined via the incremental input.

DESCRIPTION OF ADDITIONAL EMBODIMENTS

In at least one embodiment, a gear system 1210 may provide for synchronized subject arm motion (e.g., via handles 1202) and leg motion (e.g., via footplates 1204) at a ratio proportional to a ratio of an average person's arm length and leg length. In at least one embodiment, an average person's arm length may measure about 23-27 inches and an average person's arm length may measure about 31-35 inches. In various embodiments, one or more gear ratios within the gear system 1210 may determine a ratio between a translation of the footplate 1204 and a corresponding, reverse translation of the handle 1202. For example, the gear system 1210 may include two gears with a particular gear ratio. The particular gear ratio may cause translations of the footplate 1204 to be proportionally greater than corresponding, reverse translations of the handle 1202. In at least one embodiment, the particular gear ratio may be selected, because, in typical gait cycles, a foot stride length (e.g., magnitude of a forward translation of a foot) may be of greater magnitude than a corresponding hand stride length. Accordingly, to provide a realistic gait cycle, the gear system 1210 may be configured such that a stride length of a footplate 1204 is greater than a stride length of a handle 1202. In at least one embodiment, a stride length of a handle 1202 may be calculated by: 1) determining an average (e.g., $90^{th}$ percentile) arm length from a pool of subjects; and 2) selecting a gear ratio of the gear system 1210 to facilitate typical gait cycle foot/hand translations that would be experienced by a subject that demonstrates the determined average arm length. In various embodiments, the gear system 1210 may include one or more mechanisms for changing a ratio between a footplate 1204 translation and a handle 1202 reverse translation). For example, the gear system 1210 may include a mechanism for manipulating one or more gear ratios therein. In at least one embodiment, the one or more mechanisms may include, but are not limited to: 1) transmissions; 2) gear switching mechanisms (e.g., for example, a mechanism similar to a bicycle gear change mechanism); 3) torque converters (e.g., for example, a magnetic particle clutch; and 4) additional mechanisms for configuring and/or modifying a gear ratio and/or modifying translation ratios.

In at least one embodiment, the lock-pin system 119 may include one or more triggering mechanisms that allow a subject and/or operator to disengage the lock system 119. For example, a spring-loaded lock-pin mechanism within the lock-pin system 119 may be connected to a first end of a cable that, when pulled, withdraws the lock-pin mechanism from a locking void (as described herein), thereby disengaging the lock-pin system 119. In the same example, the cable may be connected, at a second end, to a trigger, and the cable may be configured such that pulling the trigger pulls the cable with sufficient displacement to disengage the lock-pin system 119. The trigger may be configured within a handle attached to an exterior surface of the rehabilitation device 100. In various embodiments, translation of the sled 103 and rotation of the tower 101 may each be controlled via the above described lock disengagement mechanisms.

The system may include an electronically controlled lock-pin and/or tower rotation system. In at least one embodiment, the system includes actuators and/or motors that allows a user to select a rotation position of the tower (e.g., via a GUI) and the system will substantially automatically rotate the tower to the selected rotation position.

In at least one embodiment, an outer footplate link 1203 may raise and/or lower a connected footplate 1204 as the outer footplate link 1203 proceeds through forward and reverse translations (e.g., as a result of linkage 111 operations). For example, an outer footplate link 1203 may be positioned at a maximum reverse translation point (e.g., as shown in FIG. 13). At the maximum reverse translation point, the outer footplate link 1203 may drive a connected footplate 1204 downwards to a lowered position. In the same example, as the outer footplate link 1203 experiences a forward translation (e.g., as shown in FIG. 14), the outer footplate link 1203 may drive the footplate 1204 upwards to a raised position. After reaching a maximum forward translation point, the outer footplate link 1203 may experience a reverse translation, and the outer footplate link 1203 may drive the footplate 1204 may drive footplate 1204 downwards throughout the reverse translation.

In various embodiments, the one or more linkages and/or the footplate 1204 may be configured in a manner such that raising and lowering actions are similar to raising and lowering actions experienced by a foot progressing through a natural gait cycle. For example, as shown in FIG. 13, a footplate 1204 may be oriented at a lowered position when a linkage 111 is configured in a position analogous to a gait cycle's loading response and/or mid-stance phase. As another example, as shown in FIG. 14, a footplate 1204 may be oriented at a raised position when a linkage 111 is configured in a position analogous to a gait cycle's swing phase. As an additional example, as shown in FIG. 15, a footplate 1204 may be positioned at a partially lowered position when a linkage 111 is configured in a position analogous to a gait cycle's loading response phase. In at least one embodiment, vertical travel of a footplate 1204, throughout a gait cycle, may be adjusted manually and/or automatically. In one or more embodiments, vertical travel may be determined by a distance between an end of an outer footplate link 1203 and an end of an inner footplate link 1205 connected along a shared axis. In at least one embodiment, vertical travel (of a connected footplate 1204) may be increased by increasing distance, along the shared axis, between the end of the outer footplate link 1203 and the end of the inner footplate link 1205. In various embodiments, the distance may be adjusted via a screw system, a wheel system, a quick pin system, or one or more other systems and/or methods. In one or more embodiments, adjustment of the vertical travel may allow a rehabilitation 100 to more comfortably accommodate subjects of varying dimensions.

In one or more embodiments, a footplate 1204 may also include a pivoting apparatus. In at least one embodiment, the pivoting apparatus may allow the footplate 1204 to pivot as the footplate 1204 proceeds through a gait cycle. In various embodiments, the pivoting apparatus may advantageously provide a pivot motion analogous to pivoting motions experienced by a foot proceeding through a natural gait cycle. In one or more embodiments, the pivoting mechanism may also be translatable along the footplate 1204, and may be locked at a particular translation point. For example, a pivoting mechanism may be translated along a footplate 1204 in a manner such that the pivoting mechanism is aligned with a ball of a subject's foot configured within the footplate 1204 (and include a "toe end" nearest the sled and a "heel end" furthest from the sled). In one or more embodiments, positioning of a pivoting mechanism in alignment with a subject's foot may further provide for realistic movements throughout a gait cycle. For example, in a natural gait cycle, during a transition between an initial contact phase and a loading response phase, a subject's foot may pivot about a ball of the foot until the foot is positioned flat. Accordingly, during an artificial gait cycle and during the same transition, a pivoting mechanism may permit a footplate 1204 to pivot about a pivot point, orienting to a more substantially horizontal position, and, thus, mimicking motions of the natural gait cycle.

In one or more embodiments, the rehabilitation system 100 may include a virtual reality system that provides a virtual training experience to a subject positioned therein. In various embodiments, the virtual reality system may include, but is not limited to: 1) a visual accessory, such as, for example, a helmet, glasses, a screen, and/or a combination thereof; and 2) a virtual reality engine, such as, for example, a computing environment capable of rendering dynamic virtual reality environments on a visual accessory. In one or more embodiments, a virtual reality engine may also receive outputs from one or more sensors that measure performance of the subject during a training activity. For example, the virtual reality engine may receive a step frequency and may adjust one or more virtual reality content parameters to reflect an effective speed with which the subject is moving. In at least one embodiment, the virtual reality system may further include one or more input devices that allow a subject to interact and interface with virtual environments and content therein. In one or more embodiments, the virtual reality system (and/or the rehabilitation system 100) may further include one or more eye tracking sub-systems that determine where a subject is looking (e.g., on a display, GUI, etc.) and allow a subject to provide inputs via the eye tracking sub-system and/or one or more input accessories.

In at least one embodiment, motion one or more handles 1202 (as show in FIGS. 13-15) may provide an accurate simulation of hand motion as would be experienced in a healthy, natural gait cycle. In various embodiments, a healthy gait cycle may include, but is not limited to: 1) a ratio between hand translation and foot translation that is within a range demonstrated in natural gait cycles; 2) an average hand height that is within a range demonstrated in natural gait cycles; and 3) a hand position that is substantially similar to hand positions demonstrated in natural gait cycle. For example, an elliptical machine may present an unhealthy gait cycle including: 1) an inaccurate hand translation-foot translation ratio (e.g., a hand translation is overly minimal for a corresponding foot translation); 2) an average hand height that exceeds a range demonstrated in natural gait cycles (e.g., an average hand height is at or above mid-torso height, whereas a healthy range may fall around hip height); and 3) a hand position that is not representative of hand positions in a healthy gait cycle (e.g., hands are oriented to positions above mid-torso). Accordingly, the present rehabilitation system 100 may demonstrate an artificial gait that is distinct from movement demonstrated by an elliptical machine. In at least one embodiment, a gait demonstrated by the rehabilitation system 100 may be more physiologically accurate and/or more facilitative of locomotive rehabilitation than movements provided via an elliptical machine. In one or more embodiments, a hand gait motion demonstrated by the rehabilitation system 100 and a natural hand gait motion may be substantially similar, noting that an elliptical machine's hand gait motion may be substantially dissimilar to a natural hand gait motion.

DESCRIPTION OF ALTERNATE EMBODIMENTS

In various embodiments, the present system may receive communications, inputs, selections, and/or commands from one or more input systems. In at least one embodiment, the one or more input systems may include, but are not limited to: 1) voice-based systems; 2) optical-based systems; and 3) brain-computer interfaces (BCIs). In one example, voice-based systems may receive and process audio signals (for example, a subject's voice) to determine an action, selection, or other input that a subject wishes to perform and/or provide. In one embodiment, a voice-based system may process vocal inputs to cause actions including, but not limited to, receiving configuration and session selections (as described herein). As another example, an optical-based system may track and process movements and behaviors of a subject's eye(s) to identify movements and behaviors (e.g., inputs) that may correspond with one or more actions (e.g., such as selecting various system parameters and/or commands). As an additional example, a BCI may record and process a subject's neural signals to translate and/or generate various system inputs. In an exemplary scenario, a BCI may be trained to recognize and correlate neural signals with system actions, and configuration and session selections.

In one or more embodiments, the system may automatically adjust session parameters based on collected session data. For example, the system may include one or more force sensors to detect force being applied by a subject to one or more footplates, handles, grips, etc. In the same example, the system may process measurements from the one or more force sensors to identify performance and fatigue of a subject and adjust session parameters according to one or more locomotion rehabilitation protocols (e.g., programmed into the system and/or configured by a system operator). In an exemplary scenario, during a powered session, force sensors may detect that a subject's applied forces at the footplates has decreased by a particular proportion (e.g., 50% of a peak force). Upon detecting the diminished force, the system may identify that the subject requires increased assistance, and may automatically increase assistance provided to the subject (as described herein). In another exemplary scenario, force sensors in one or more handles may detect that a subject is partially supporting themselves by leaning on the handles. In the same scenario, the system may determine that the subject requires additional BWS-enabled offloading, and may automatically configured a BWS system to increase an offloading force experienced by the subject. As another example, the system may automatically adjust resistance or assistance parameters based on session parameters including, but not limited to: 1) a step count (e.g., as compared to a predefined step threshold); 2) a step frequency (e.g., as compared to a predefined step frequency threshold; and 3) a peak step period (e.g., as compared to a peak step period threshold). In one example, the system may automatically taper and/or incrementally increase resistance or assistance during a session, and may perform tapers and/or increases according to dynamic calculations or according to one or more preprogrammed taper/increase schedules.

In at least one embodiment, the system may be capable of operation via telemedicine. For example, the system may include controllers and outputs (e.g., displays, speakers, etc.) that allow a system operator (e.g., a physical trainer, etc.) to remotely provide assistance, guidance, and encouragement to a subject performing a session. As another example, the system may be operative to transmit subject performance readings (e.g., in real time, or otherwise) to a remote systems operator for evaluation. In various embodiments, the system may include one or more analytical, statistical, and/or machine learning environments for processing, evaluating, and model collected subject data (e.g., session performance, session parameters, etc.). For example, the system may perform one or more machine learning techniques to model historic session parameters and session performance (e.g., sourced from both individually-based and aggregated data), and identify a rehabilitation training program that may be most beneficial to a subject.

In one or more embodiments, the system may include a digital social platform, or the like, that allows subjects to upload session performance data, and observe session performance data uploaded by others. For example, the system may include a social media platform that allows system subjects to interact, provide encouragement, and share session parameters (e.g., training programs, etc.). In at least one embodiment, the system may be operative to communicate with one or more wearable fitness accessories that record physical performance. For example, the system may be operative to transmit session parameter and performance data to an electronic fitness band.

In various embodiments, gait motions produced at a sled 103 may be generated by a linkage 111 (as described herein), or may be generated by a modified linkage, or other gait motion systems. In at least one embodiment, a modified linkage system may omit and/or combine elements of a linkage 111. For example, a modified linkage system may omit a first connecting link and a second connecting link. Instead, a handle link 1211 may be connected to a gear system 1210 via a single connecting that rotates and directs the handle link 1211 along a track, thereby tracing and guiding the handle link 1211 along an arc representative of a natural hand gait motion. As another example, handle gait motions may be produced via independently operating, but coordinated actuator systems that synchronizes translation of a handle 1202 to translation of a footplate 1204. In one or more embodiments, handle gait motions may be produced via a system independent of a sled 103. For example, handle gait motions may be generated via a handle system that is separate and distinct from a sled 103, but synchronizes handle motion to footplate motions thereof.

In one or more embodiments, a sled 103 may include multiple linkages 111 that receive independently configured and programmed assistive and resistive forces (e.g., via a motor unit 1217 and one or more clutches 1223). For example, a sled 103 may include a left linkage 111 and a right linkage 111. Each linkage 111 may receive assistance from a connected motor unit 1217, but a magnitude of assistance and/or resistance may be independently calibrated for each linkage 111 by a clutch 1223 configured within each linkage.

Conclusion

Aspects, features, and benefits of the systems, methods, processes, formulations, apparatuses, and products discussed herein will become apparent from the information disclosed in the exhibits and the other applications as incorporated by reference. Variations and modifications to the disclosed systems and methods may be effected without departing from the spirit and scope of the novel concepts of the disclosure.

It will, nevertheless, be understood that no limitation of the scope of the disclosure is intended by the information disclosed in the exhibits or the applications incorporated by reference; any alterations and further modifications of the described or illustrated embodiments, and any further applications of the principles of the disclosure as illustrated therein are contemplated as would normally occur to one skilled in the art to which the disclosure relates.

The foregoing description of the exemplary embodiments has been presented only for the purposes of illustration and description and is not intended to be exhaustive or to limit the inventions to the precise forms disclosed. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

From the foregoing, it will be understood that various aspects of the processes described herein are software processes that execute on computer systems that form parts of the system. Accordingly, it will be understood that various embodiments of the system described herein are generally implemented as specially-configured computers including various computer hardware components and, in many cases, significant additional features as compared to conventional or known computers, processes, or the like, as discussed in greater detail herein. Embodiments within the scope of the present disclosure also include computer-readable media for carrying or having computer-executable instructions or data structures stored thereon. Such computer-readable media can be any available media which can be accessed by a computer, or downloadable through communication networks. By way of example, and not limitation, such computer-readable media can comprise various forms of data storage devices or media such as RAM, ROM, flash memory, EEPROM, CD-ROM, DVD, or other optical disk storage, magnetic disk storage, solid state drives (SSDs) or other data storage devices, any type of removable non-volatile memories such as secure digital (SD), flash memory, memory stick, etc., or any other medium which can be used to carry or store computer program code in the form of computer-executable instructions or data structures and which can be accessed by a computer.

When information is transferred or provided over a network or another communications connection (either hardwired, wireless, or a combination of hardwired or wireless) to a computer, the computer properly views the connection as a computer-readable medium. Thus, any such a connection is properly termed and considered a computer-readable medium. Combinations of the above should also be included within the scope of computer-readable media. Computer-executable instructions comprise, for example, instructions and data which cause a computer to perform one specific function or a group of functions.

Those skilled in the art will understand the features and aspects of a suitable computing environment in which aspects of the disclosure may be implemented. Although not required, some of the embodiments of the claimed inventions may be described in the context of computer-executable instructions, such as program modules or engines, as described earlier, being executed by computers in networked environments. Such program modules are often reflected and illustrated by flow charts, sequence diagrams, exemplary screen displays, and other techniques used by those skilled in the art to communicate how to make and use such computer program modules. Generally, program modules include routines, programs, functions, objects, components, data structures, application programming interface (API) calls to other computers whether local or remote, etc. that perform particular tasks or implement particular defined data types, within the computer. Computer-executable instructions, associated data structures and/or schemas, and program modules represent examples of the program code for executing steps of the methods disclosed herein. The particular sequence of such executable instructions or associated data structures represent examples of corresponding acts for implementing the functions described in such steps.

Those skilled in the art will also appreciate that the claimed and/or described systems and methods may be practiced in network computing environments with many types of computer system configurations, including personal computers, smartphones, tablets, hand-held devices, multiprocessor systems, microprocessor-based or programmable consumer electronics, networked PCs, minicomputers, mainframe computers, and the like. Embodiments of the claimed invention are practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing various aspects of the described operations, which is not illustrated, includes a computing device including a processing unit, a system memory, and a system bus that couples various system components including the system memory to the processing unit. The computer will typically include one or more data storage devices for reading data from and writing data to. The data storage devices provide nonvolatile storage of computer-executable instructions, data structures, program modules, and other data for the computer.

Computer program code that implements the functionality described herein typically comprises one or more program modules that may be stored on a data storage device. This program code, as is known to those skilled in the art, usually includes an operating system, one or more application programs, other program modules, and program data. A user may enter commands and information into the computer through keyboard, touch screen, pointing device, a script containing computer program code written in a scripting language or other input devices (not shown), such as a microphone, etc. These and other input devices are often connected to the processing unit through known electrical, optical, or wireless connections.

The computer that effects many aspects of the described processes will typically operate in a networked environment using logical connections to one or more remote computers or data sources, which are described further below. Remote computers may be another personal computer, a server, a router, a network PC, a peer device or other common network node, and typically include many or all of the elements described above relative to the main computer system in which the inventions are embodied. The logical connections between computers include a local area network (LAN), a wide area network (WAN), virtual networks (WAN or LAN), and wireless LANs (WLAN) that are presented here by way of example and not limitation. Such networking environments are commonplace in office-wide or enterprise-wide computer networks, intranets, and the Internet.

When used in a LAN or WLAN networking environment, a computer system implementing aspects of the invention is connected to the local network through a network interface or adapter. When used in a WAN or WLAN networking environment, the computer may include a modem, a wireless link, or other mechanisms for establishing communications over the wide area network, such as the Internet. In a networked environment, program modules depicted relative to the computer, or portions thereof, may be stored in a remote data storage device. It will be appreciated that the network connections described or shown are exemplary and other mechanisms of establishing communications over wide area networks or the Internet may be used.

While various aspects have been described in the context of a preferred embodiment, additional aspects, features, and methodologies of the claimed inventions will be readily discernible from the description herein, by those of ordinary skill in the art. Many embodiments and adaptations of the disclosure and claimed inventions other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed inventions. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed inventions. In addition, some steps may be carried out simultaneously, contemporaneously, or in synchronization with other steps.

The embodiments were chosen and described in order to explain the principles of the claimed inventions and their practical application so as to enable others skilled in the art to utilize the inventions and various embodiments and with various modifications as are suited to the particular use contemplated. Alternative embodiments will become apparent to those skilled in the art to which the claimed inventions pertain without departing from their spirit and scope. Accordingly, the scope of the claimed inventions is defined by the appended claims rather than the foregoing description and the exemplary embodiments described therein.

What is claimed is:

1. A gait training device for seated or standing gait training comprising:

a sled coupled to a base, the sled comprising:

a handle for training arm motion; and a linkage and gear system operatively connected to the handle for synchronizing arm motion with leg motion, the linkage and gear system operatively connected to at least one footplate;

the at least one footplate operatively connected to the base, the at least one footplate for securing a foot of a user for gait training; and a tower operatively connected to the base, the tower comprising a body weight system and a seat for supporting a weight of the user during the gait training, wherein when the user is in a standing position:

the linkage and gear system causes the handle to trace a single arc from a first maximum translational point to a second maximum translational point through a terminal stance phase and a toe-off phase at a height of the user's hip; and the handle traces the single arc through a point below both the first maximum translational point and the second maximum translational point.

2. The gait training device of claim 1, wherein the at least one footplate:

comprises a toe end nearest the sled and a heel end furthest from the sled; and is configured to pivot such that the toe end and heel end raise or lower as the at least one footplate moves along the base.

3. The gait training device of claim 2, wherein moving the at least one footplate a first distance causes the handle to translate via the linkage and gear system a second distance, wherein the second distance is less than the first distance.

4. The gait training device of claim 3, wherein a ratio between the second distance and the first distance is at least partially controlled by the linkage and gear system.

5. The gait training device of claim 1, wherein:

the tower is configured to rotate from a first position to a second position;

in the first position, the tower is positioned approximately 90 degrees with respect to the base; and in the second position, the tower is positioned approximately 0 degrees with respect to the base.

6. The gait training device of claim 5, wherein:

in the first position the seat is configured to allow a user to sit on a portion of the seat; and in the second position the seat is configured to allow the user to sit on the portion of the seat and attach the foot of the user to the at least one footplate.

7. The gait training device of claim 1, wherein the gait training device does not include a flywheel.

8. The gait cycle training device of claim 1, wherein the first maximum translational point and the second maximum translational point lie within a horizontal plane parallel to the sled.

9. A gait cycle training device comprising:

a footplate for training leg motion in contact with a base;

a handle operatively connected to the footplate via a linkage and gear system, wherein:

the linkage and gear system causes the handle to move a handle distance substantially parallel to the base in response to movement of the footplate a footplate distance along the base; and a tower operatively connected to the base, the tower comprising a body weight system and a seat for supporting a weight of a user during gait training, wherein when the user is in a standing position:

the linkage and gear system causes the handle to trace a single arc from a first maximum translational point to a second maximum translational point a terminal stance phase and a toe-off phase at a height of the user's hip; the handle traces the single arc through a point below both the first maximum translational point and the second maximum translational point; and the handle remains below the user's chest during gait training.

10. The gait cycle training device of claim 9, wherein:

the tower is configured to rotate from a first position to a second position;

in the first position, the tower is positioned approximately 90 degrees with respect to the base; and in the second position, the tower is positioned approximately 0 degrees with respect to the base.

11. The gait cycle training device of claim 10, wherein:

in the first position the seat is configured to allow a user to sit on a portion of the seat; and in the second position the seat is configured to allow the user to sit on the portion of the seat and attach a foot of the user to the footplate.

12. The gait cycle training device of claim 10, wherein the tower comprises a lock-pin system for locking to tower in the first position or the second position.

13. The gait cycle training device of claim 9, wherein the gait training device does not include a flywheel.

* * * * *